US012091918B2

(12) United States Patent
Steele

(10) Patent No.: US 12,091,918 B2
(45) **Date of Patent: *Sep. 17, 2024**

(54) DOWNHOLE ROTARY SLIP RING JOINT TO ALLOW ROTATION OF ASSEMBLIES WITH MULTIPLE CONTROL LINES

(71) Applicant: Halliburton Energy Services, Inc., Houston, TX (US)

(72) Inventor: David Joe Steele, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/721,182

(22) Filed: Apr. 14, 2022

(65) Prior Publication Data

US 2022/0333447 A1 Oct. 20, 2022

Related U.S. Application Data

(60) Provisional application No. 63/175,411, filed on Apr. 15, 2021.

(51) Int. Cl.
*E21B 17/02* (2006.01)
*E21B 33/124* (2006.01)
(Continued)

(52) U.S. Cl.
CPC ..... *E21B 17/028* (2013.01); *E21B 17/025* (2013.01); *E21B 17/026* (2013.01);
(Continued)

(58) Field of Classification Search
CPC .... E21B 17/028; E21B 17/025; E21B 17/026; E21B 33/124; E21B 41/0035; E21B 47/135; E21B 43/26
See application file for complete search history.

(56) References Cited

U.S. PATENT DOCUMENTS 4,052,555 A 10/1977 Mears et al.
6,050,349 A 4/2000 Rountree et al.
(Continued)

FOREIGN PATENT DOCUMENTS

CN 111577175 A 8/2020
EP 1222359 B1 1/2007
(Continued)

*Primary Examiner* — D. Andrews
(74) *Attorney, Agent, or Firm* — Scott Richardson; Parker Justiss, P.C.

(57) ABSTRACT

Provided is a downhole rotary slip ring joint, a well system, and a method for accessing a wellbore. The downhole rotary slip ring joint, in one aspect, includes an outer mandrel, an inner mandrel operable to rotate relative to the outer mandrel, first and second outer mandrel communication connections coupled to the outer mandrel. The downhole rotary slip ring joint, according to this aspect, further includes first and second inner mandrel communication connections coupled to the inner mandrel, a first and second passageway extending through the outer mandrel and the inner mandrel, the first and second passageway configured to provide continuous coupling between the second outer mandrel communication connection and the second inner mandrel communication connection regardless of a rotation of the inner mandrel relative to the outer mandrel, wherein the downhole rotary slip ring joint is operable to be coupled to a wellbore access tool.

35 Claims, 60 Drawing Sheets

(51) Int. Cl.
*E21B 41/00* (2006.01)
*E21B 43/26* (2006.01)
*E21B 47/135* (2012.01)

(52) U.S. Cl.
CPC ..... *E21B 33/124* (2013.01); *E21B 41/0035* (2013.01); *E21B 43/26* (2013.01); *E21B 47/135* (2020.05)

(56) References Cited

U.S. PATENT DOCUMENTS

| | | | | |
|---|---|---|---|---|
| 7,487,830 | B2 | 2/2009 | Wolters et al. | |
| 8,162,044 | B2 | 4/2012 | Sihler | |
| 9,284,793 | B2 | 3/2016 | D'Silva et al. | |
| 10,364,617 | B2 | 7/2019 | Kirkhope | |
| 10,472,933 | B2 | 11/2019 | Steele | |
| 10,527,104 | B2 | 1/2020 | Liess | |
| 2006/0021799 | A1 | 2/2006 | Hall et al. | |
| 2007/0030167 | A1* | 2/2007 | Li | E21B 17/003 340/854.4 |
| 2011/0017473 | A1 | 1/2011 | Clarkson et al. | |
| 2015/0229087 | A1 | 8/2015 | Sihler | |
| 2016/0290059 | A1 | 10/2016 | Hardin, Jr. et al. | |
| 2017/0107794 | A1* | 4/2017 | Steele | E21B 34/06 |
| 2017/0321544 | A1 | 11/2017 | Wilson et al. | |
| 2020/0032620 | A1 | 1/2020 | Steele | |
| 2022/0333445 | A1* | 10/2022 | Steele | E21B 17/026 |
| 2022/0333463 | A1* | 10/2022 | Steele | E21B 41/0035 |

FOREIGN PATENT DOCUMENTS

| | | | |
|---|---|---|---|
| WO | 2012028864 | A2 | 3/2012 |
| WO | 2017058027 | A1 | 4/2017 |

* cited by examiner

DOWNHOLE ROTARY SLIP RING JOINT TO ALLOW ROTATION OF ASSEMBLIES WITH MULTIPLE CONTROL LINES

CROSS-REFERENCE TO RELATED APPLICATION

This application claims priority to U.S. Application Ser. No. 63/175,411, filed on Apr. 15, 2021, entitled "DOWNHOLE ROTARY SLIP RING JOINT TO ALLOW ROTATION OF ASSEMBLIES WITH ELECTRICAL AND FIBER OPTIC CONTROL LINES," commonly assigned with this application and incorporated herein by reference in its entirety.

BACKGROUND

A variety of borehole operations require selective access to specific areas of the wellbore. One such selective borehole operation is horizontal multistage hydraulic stimulation, as well as multistage hydraulic fracturing ("frac" or "fracking"). In multilateral wells, the multistage stimulation treatments are performed inside multiple lateral wellbores. Efficient access to all lateral wellbores after their drilling is critical to complete a successful pressure stimulation treatment, as well as is critical to selectively enter the multiple lateral wellbores with other downhole devices.

BRIEF DESCRIPTION

Reference is now made to the following descriptions taken in conjunction with the accompanying drawings, in which.

Figure 5:
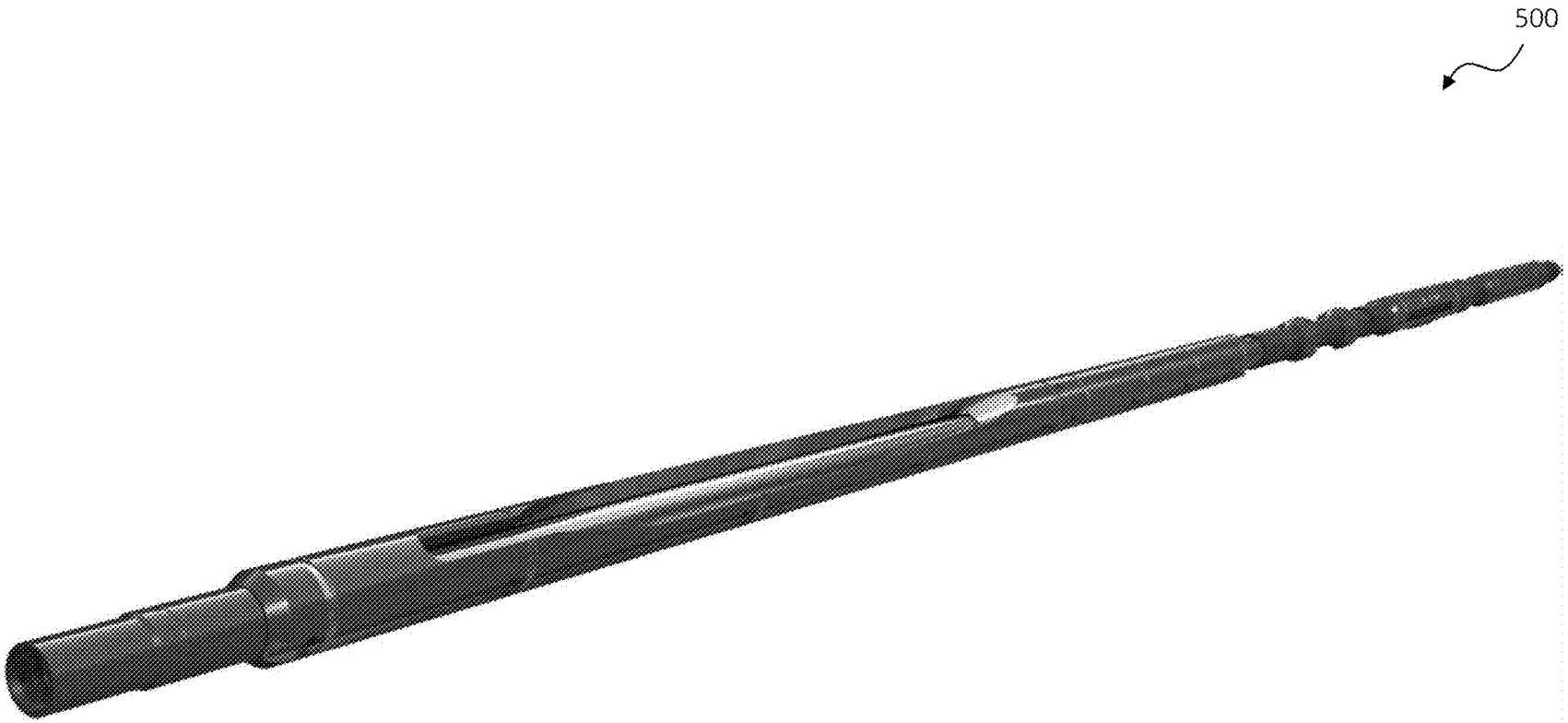
Figure 6:
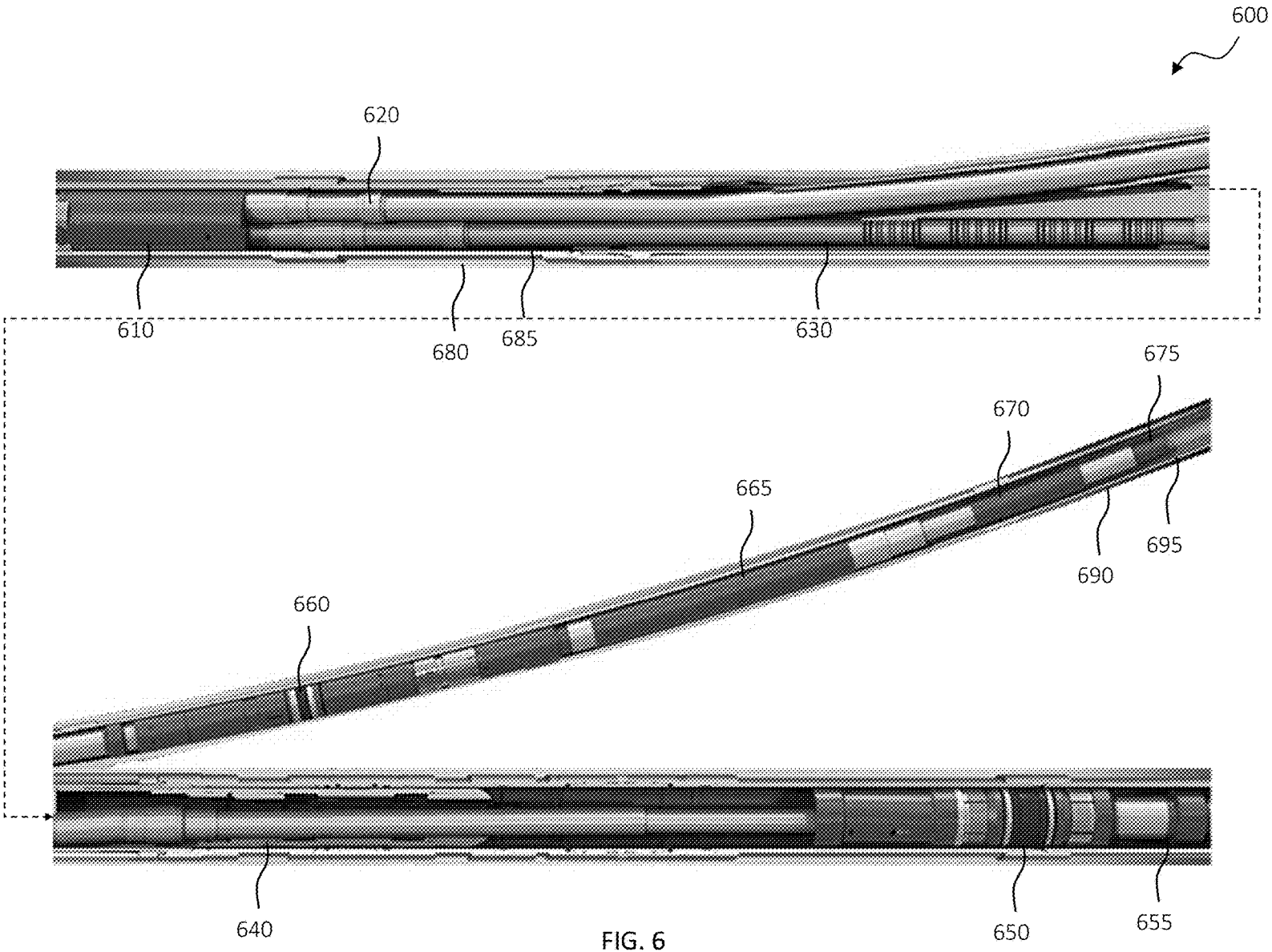

FIGS. 4A through 4EE illustrate multitude of different views of a DRSRJ designed, manufactured and operated according to one or more embodiments of the disclosure, and as might be used with a wellbore access tool as described herein;

FIG. 5 illustrates an illustration of an IsoRite® sleeve, as might employ a DRSRJ according to the present disclosure;

FIG. 6 illustrates a depiction of a FloRite® system, as might employ a DRSRJ according to the present disclosure, and be located within a main wellbore having main wellbore production tubing (e.g., main bore tubing with short seal assembly) and a lateral wellbore having lateral wellbore production tubing (e.g., lateral bore tubing with long seal assembly); and FIGS. 7A through 25 illustrate one or more methods for forming, accessing, potentially fracturing, and producing from a well system.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water. The term wellbore, in one or more embodiments, includes a main wellbore, a lateral wellbore, a rat hole, a worm hole, etc.

The present disclosure, for the first time, has recognized that it is helpful to rotate some downhole assemblies that have control lines relative to other uphole assemblies, for example as the tools pass through tortuous wellbores, windows, doglegs, etc. Further to this recognition, the present disclosure has recognized that it may be disadvantageous to allow control lines to rotate more than 360-degrees, if not more than 180-degrees or more than 90-degrees. The present disclosure has thus, for the first time, recognized that a downhole rotary slip ring joint (DRSRJ) may advantageously be used for wellbore access, for example as part of a wellbore access tool. The term wellbore access or wellbore access tool, as used herein, is intended to include any access or tool that accesses into a main wellbore or lateral wellbore after the main wellbore or lateral wellbore has been drilled, respectively. Accordingly, wellbore access includes accessing a main wellbore or lateral wellbore during the completion stage, stimulation stage, workover stage, and production stage, but excludes including the DRSRJ as part of a drill string using a drill bit to form a main wellbore or lateral wellbore. In at least one embodiment, the wellbore access tool is operable to pull at least 4,536 Kg (e.g., about 10,000 lbs.), at least 9,072 Kg (e.g., about 20,000 lbs.), at least 22,680 Kg (e.g., about 50,000 lbs.), and/or at least 34,019 Kg (e.g., about 75,000 lbs.). In at least one other embodiment, the wellbore access tool is operable to withstand internal fluid pressures of at least 68 atmospheres (e.g., 1,000 psi), if not at least 136 atmospheres (e.g., 2,000 psi), if not at least 340 atmospheres (e.g., 5,000 psi), if not at least at least 680 atmospheres (e.g., 10,000 psi), among others. Furthermore, the DRSRJ is configured to be employed with thinner walled tubing, as is generally not used in the drill string. For example, the term thinner walled tubing, in at least one embodiment, is defined as tubing have an outside diameter to wall thickness (D/t) ratio of 25 or less, if not 17 or less. Given the foregoing, in at least one embodiment, a DRSRJ may be used with an intelligent FlexRite® Junction with control lines, IsoRite® Feed Thru (FT), and the Flo-Rite® IC, among others, which will all benefit from having the ability to rotate the control lines while running in hole and setting. Specifically, alignment with the window is important with the IsoRite® Feed Thru (FT) and the Flo-Rite® IC, wherein the DRSRJ would allow the tool to rotate relative to the control line when making alignment with the window.

In at least one embodiment, the DRSRJ may allow the rotation of one or more control lines about the axis of another item. In at least one embodiment, the other item may (e.g., without limitation) includes a tubular member, for example including tubing, drill string, liner, casing, screen assembly, etc. In at least one embodiment, the DRSRJ may have one portion (e.g., the uphole end) that does not rotate while another portion (e.g., the downhole end) does rotate. Thus, the DRSRJ may allow a portion of one or more control lines to remain stationary with respect to the portion of the DRSRJ. For example, in at least one embodiment, the upper control lines will not rotate. The DRSRJ may also allow a portion of one or more control lines to rotate with respect to another portion of the DRSRJ. For example, in at least one embodiment, the lower control lines will rotate.

The DRSRJ may have other improvements according to the disclosure. For example, in at least one embodiment the DRSRJ may include a pressure-compensated DRSRJ, which may reduce stresses on seals, housings, etc. Moreover, the pressure-compensated DRSRJ may allow for thin-walled housings, etc. The DRSRJ may additionally include various configurations to allow various rotational scenarios. For example, in one embodiment, the DRSRJ may be setup to allow continuous, unlimited rotation, limited rotation (e.g., 345-degrees, 300-degrees, 240-degrees, 180-degrees, 120-degrees, 90-degrees or less), unlimited and/or limited bi-directional rotation (e.g., +/−300-degrees, +/−150-degrees, +/−185-degrees, +/−27 degrees), right-hand-only rotation, or left-hand-only rotation. In yet another embodiment, the DRSRJ includes a torsion limiter (e.g., adjustable-torsion limiter) to limit the amount of rotation torque. In at least one embodiment, the torsion limiter is a clutch or slip that only allows rotation after enough rotational torque is applied thereto.

In at least one other embodiment, the DRSRJ may include redundant slip ring contacts to ensure fail-safe operation. In yet another embodiment, the DRSRJ may include continuous slip ring contact so communications can be monitored continuously while running-in-hole, manipulating tools, etc. Furthermore, the DRSRJ may include sensors above, below, and in the tool, for example to monitor health of one or more tools/sensors, observe the orientation of tools while running-in-hole, etc.

In at least one other embodiment, the DRSRJ may include an actuated switch to latch long-term contacts, for example as traditional slip ring contacts may not be the best contacts for a long-term use. The actuated switch, in one embodiment, can be "switched on" to provide a more-reliable long-term contact or connection. In at least one embodiment, the actuated switch is a knife blade contact, and may be surface-actuated, automatically-actuated, or manually-actuated. In at least one embodiment, the actuated switch provides redundancy to the slip ring contacts.

In at least one other embodiment, the DRSRJ may include non-conductive (e.g., dielectric) fluid surrounding the slip ring contacts. For example, portions of the DRSRJ (e.g., the slip rings and/or wires) may be submerged in the non-conductive fluid, and thus provide electrical insulation, suppress corona and arcing, and to serve as a coolant. In at least one embodiment, mineral oil is used, and in at least one other embodiment silicon oil is used. In at least one other embodiment, the DRSRJ may include a fluid, such as the non-conductive fluid, as a pressure compensation fluid. For example, the pressure compensation fluid might be located in a reservoir to provide extra fluid in case of minor leakage. The reservoir including the pressure compensation fluid might have redundant seals to ensure good sealability, and/or a slight positive-pressure compensation for the same reasons. In at least one other embodiment, the DRSRJ may include a non-conductive fluid which is not a pressure-compensation fluid. In at least one other embodiment, the DRSRJ may include a pressure-compensation fluid which is a conductive fluid, or slightly conductive fluid. In at least one other embodiment, the DRSRJ may use two or more fluids which one is a pressure-compensation fluid, and another is a non-conductive fluid. In at least one other embodiment, the DRSRJ may use one fluid as a non-conductive (e.g., dielectric) and pressure-compensation fluid.

In at least one other embodiment, the DRSRJ might include a travel joint feature. The travel joint feature, in this embodiment, may allow for axial movement to be integrated into the design. In at least one embodiment, slip rings lands may be wide so the movement (travel) is taken in the slip rings & contacts. A coiled control line or coiled wire may be used to provide travel within the control feature.

Figure 1:
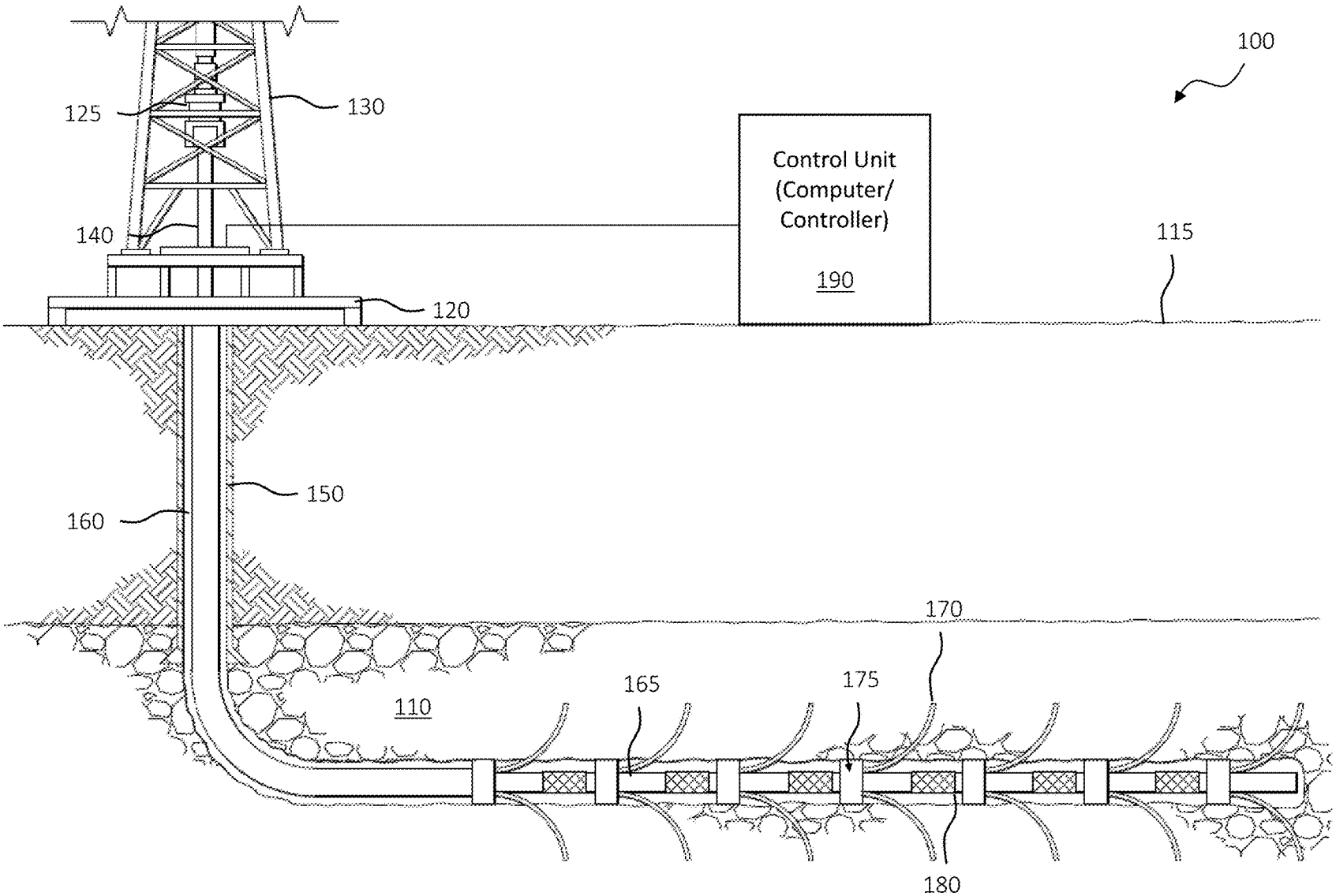
FIG. 1 illustrates a well system designed, manufactured, and operated according to one or more embodiments of the disclosure, and including a DRSRJ (not shown) designed, manufactured and operated according to one or more embodiments of the disclosure.

Turning to FIG. 1, illustrated is a well system 100 designed, manufactured, and operated according to one or more embodiments of the disclosure, and including a DRSRJ (not shown) designed, manufactured and operated according to one or more embodiments of the disclosure. In accordance with at least one embodiment, the DRSRJ may include an outer mandrel, an outer mandrel communication connection (e.g., electrical, optical, hydraulic, etc.), an inner mandrel, and an inner mandrel communication connection (e.g., electrical, optical, hydraulic, etc.) according to any of the embodiments, aspects, applications, variations, designs, etc. disclosed in the following paragraphs. In accordance with this embodiment, the DRSRJ would allow a control line coupled to the inner mandrel communication connection (e.g., electrical, optical, hydraulic, etc.) to rotate relative to a control line coupled to the outer mandrel communication connection (e.g., electrical, optical, hydraulic, etc.). In another embodiment, fiber optic lines and fiber optic connection may be employed. The term communication connection, as used herein, is intended to include the communication of power, communication of commands, and simple communication of data (e.g., pulses, analog, frequency, modulated, phase-shift, amplitude-shift, etc.), among others.

The well system 100 includes a platform 120 positioned over a subterranean formation 110 located below the earth's surface 115. The platform 120, in at least one embodiment, has a hoisting apparatus 125 and a derrick 130 for raising and lowering a downhole conveyance 140, such as a drill string, casing string, tubing string, coiled tubing, intervention tool, etc. Although a land-based oil and gas platform 120 is illustrated in FIG. 1, the scope of this disclosure is not thereby limited, and thus could potentially apply to offshore applications. The teachings of this disclosure may also be applied to other land-based multilateral wells different from that illustrated.

The well system 100, in one or more embodiments, includes a main wellbore 150. The main wellbore 150, in the illustrated embodiment, includes tubing 160, 165, which may have differing tubular diameters. Extending from the main wellbore 150, in one or more embodiments, may be one or more lateral wellbores 170. Furthermore, a plurality of multilateral junctions 175 may be positioned at junctions (intersection of one wellbore with another wellbore) between the main wellbore 150 and the lateral wellbores 170. The well system 100 may additionally include one or more Interval Control Valve (ICVs) 180 positioned at various positions within the main wellbore 150 and/or one or more of the lateral wellbores 170. The ICVs 180 may comprise any ICV designed, manufactured or operated according to the disclosure. The well system 100 may additionally include a control unit 190. The control unit 190, in one embodiment, is operable to provide control to or received signals from, one or more downhole devices. In this embodiment, control unit 190 is also operable to provide power to one or more downhole devices.

Figure 2:
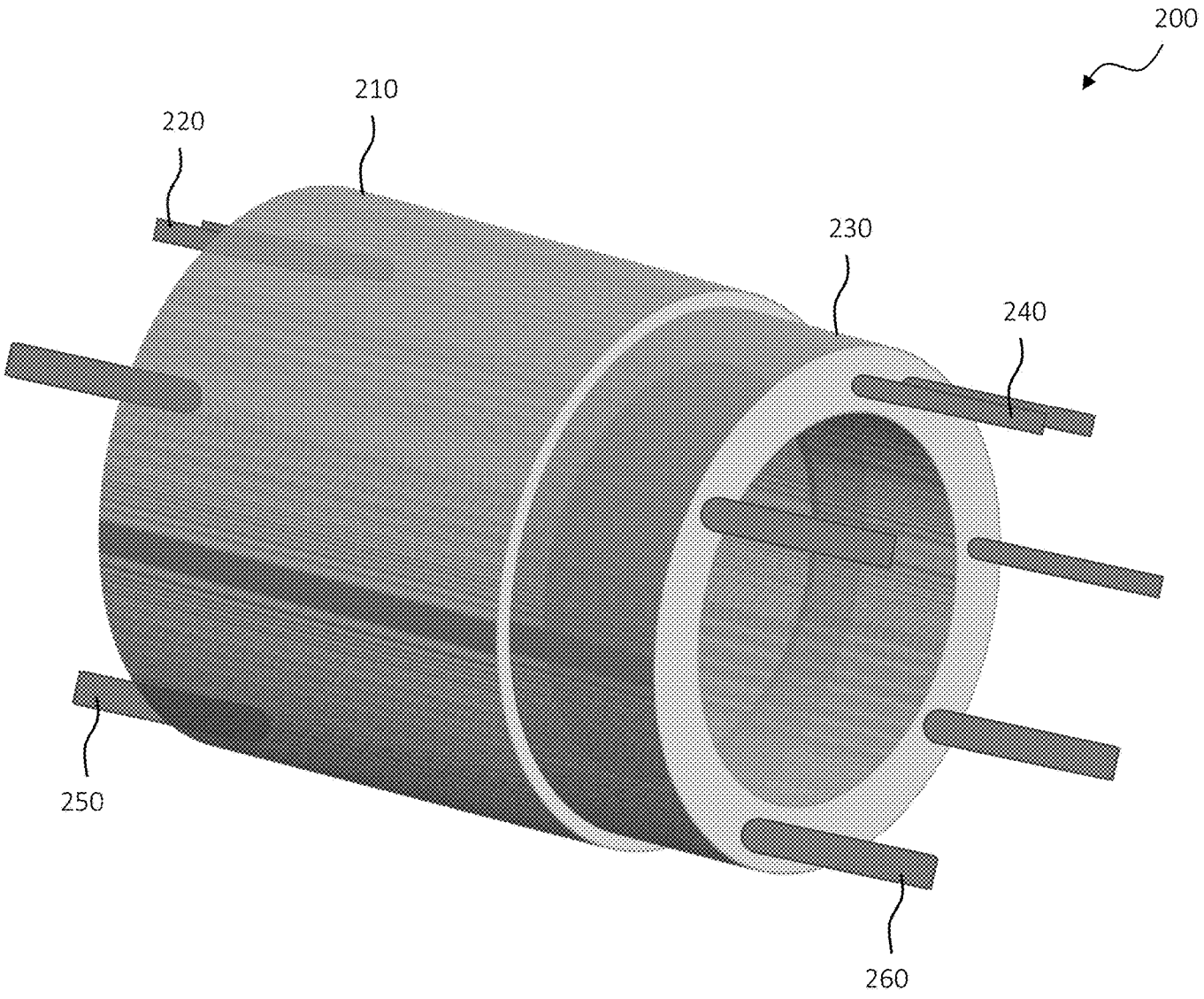
FIG. 2 illustrates one embodiment of a slip ring designed, manufactured and operated according to one or more embodiments of the disclosure.

Turning to FIG. 2, illustrated is one embodiment of a slip ring 200 designed, manufactured and operated according to one or more embodiments of the disclosure. The slip ring 200, in at least this illustrative embodiment, includes an outer mandrel 210, an outer mandrel communication connection (e.g., electrical, optical, hydraulic, etc.) 220, an inner mandrel 230, and an inner mandrel communication connection (e.g., electrical, optical, hydraulic, etc.) 240. In at least one embodiment, the outer and inner mandrel communication connections 220, 240 are electrical connections, optical connections, hydraulic connections, or any combination of the foregoing. In at least one example, the slip ring 200 is a Moog Model 303 Large Bore downhole slip ring, as might be obtained from Focal Technologies Corp., at 77 Frazee Avenue, Dartmouth NS, Canada, B3B 1Z4.

The slip ring 200, in at least one embodiment, may additionally include one or more outer mandrel torque limiters 250 and inner mandrel torque limiters 260. The outer mandrel torque limiters 250 could be fixedly coupled to one of an uphole tool/component or downhole tool/component, and the inner mandrel torque limiters 260 could be fixedly coupled to the other of the downhole tool/component or uphole tool/component.

Figure 3A:
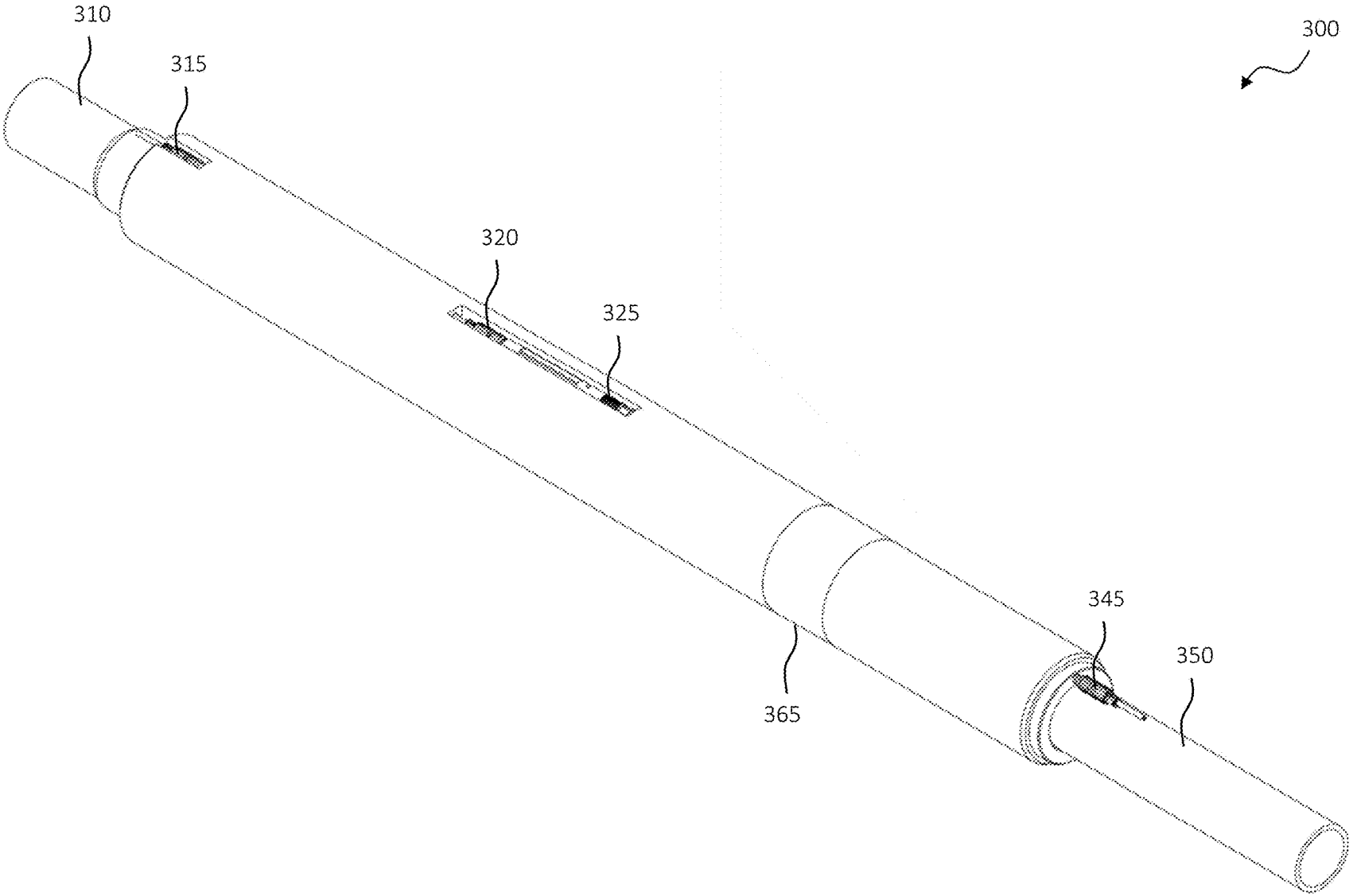
FIGS. 3A and 3B illustrate a perspective view and a cross-sectional view of one embodiment of a DRSRJ, respectively, designed, manufactured and operated according to one or more embodiments of the disclosure.
Figure 3B:
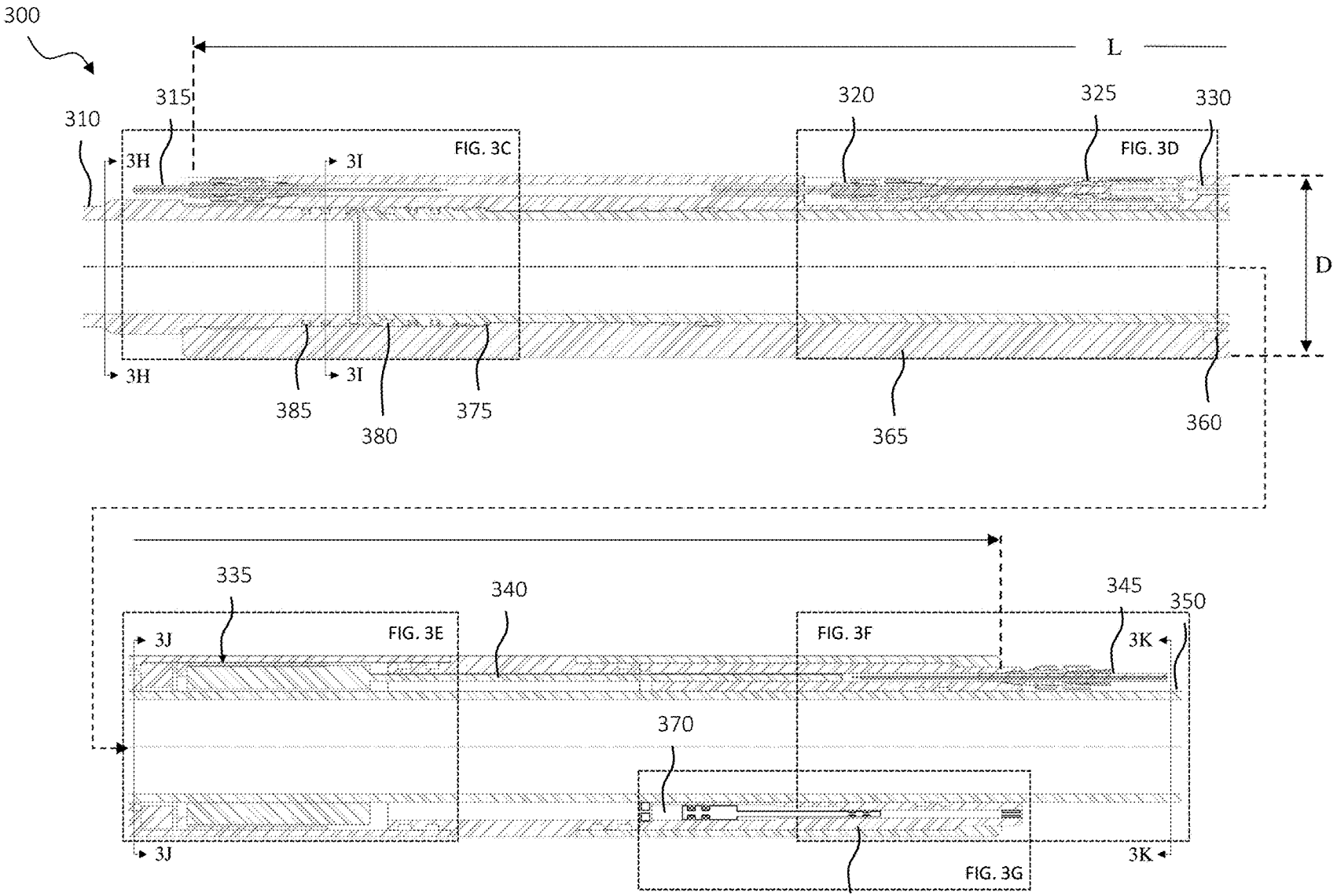

Turning to FIGS. 3A and 3B, illustrated is a perspective view and a cross-sectional view of one embodiment of a DRSRJ 300, respectively, designed, manufactured and operated according to one or more embodiments of the disclosure. The DRSRJ 300, in at least one embodiment, includes an uphole tubing mandrel 310. The uphole tubing mandrel 310, in one embodiment, may include an uphole premium connection. The uphole premium connection, in one or more embodiments, may comprise a standard premium connection, or in one or more other embodiments may comprise a 3½" VAM TOP box, among others. The uphole premium connection of the uphole tubing mandrel 310, in the embodiment shown, is configured to attach to an uphole tubing string.

The DRSRJ 300, in at least one embodiment, may further include an uphole connection 315, the uphole connection configured to couple to an uphole control line (not shown). The uphole connection 315, in one or more embodiments may transfer power, control signals and/or data signals, whether it be in the form of electrical, optical, fluid, mechanical, other form of energy etc. The uphole connection 315 may comprise a dual-pressure testable metal-to-metal seal similar to Halliburton's Full Metal Jacket (FMJ). For another example, the uphole connection 315 may be an electrical connection or fiber optic connection and remain within the scope of the disclosure. The uphole connection 315 may comprise a combination connection for combining one or more of the following connecting and transferring one or more energy forms inclusive of: electrical, optical, fluid, mechanical, other energy, and remain within the scope of the disclosure. Nevertheless, other connections other than a FMJ are within the scope of the disclosure. The DRSRJ 300, in at least one embodiment, may further include an internal connection 320. The internal connection 320, in the embodiment shown, is a crossover for the uphole connection 315 to an electrical or optical connection.

The DRSRJ 300, in at least one embodiment, may further include a cable termination 325. The cable termination 325, in one or more embodiments, is a cable termination. For example, the cable termination might be similar to a 03018465 Roc Gauge Family. The cable termination is operable for a 0-2,041 atmospheres (e.g., 0-30,000 PSIA) pressure rating and a 0-200 Deg. C temperature rating.

The DRSRJ 300, in at least one embodiment, may further include an uphole communications connector/anchor 330 (e.g., uphole electrical connector/anchor) for the top of slip ring 335 (FIG. 3B). In at least one embodiment, the uphole communications connector/anchor 330 connects electrical wire(s)/fiber optic cable(s)/hydraulic control line(s) from the cable termination(s) 325 to the slip ring 335. The uphole communications connector/anchor 330 also anchors the slip ring 335 via the threaded holes 360 in the housing 365.

The DRSRJ 300, in at least one embodiment, may further include the slip ring 335 designed, manufactured and operated according to one or more embodiments of the disclosure. The slip ring 335 may include, in at least one embodiment, an outer mandrel, an outer mandrel communication connection (e.g., electrical, optical, hydraulic, etc.), an inner mandrel, and an inner mandrel communication connection (e.g., electrical, optical, hydraulic, etc.), as discussed above with regard to FIG. 2.

The DRSRJ 300, in at least one embodiment, may further include a downhole communications connector/anchor 340 (FIG. 3B) for the bottom of slip ring 335. In at least one embodiment, the downhole communications connector/anchor 340 connects electrical wire(s)/fiber optic cable(s) from the slip ring 335 to a downhole tubing mandrel 350. The downhole communications connector/anchor 340 may also anchor the inner mandrel of the slip ring 335 via the torque limiters (not shown) in the control line swivel housing 355.

The DRSRJ 300, in at least one embodiment, may further include one or more of the downhole connections 345 (FIGS. 3A and 3B) to couple to one or more downhole control lines (not shown). The downhole connection 345, in one or more embodiments, is a typical FMJ (full metal jacket) connection. For example, the downhole connection 345 may be an electrical connection or fiber optic connection, or a combination thereof, and remain within the scope of the disclosure. Nevertheless, other connections other than a FMJ are within the scope of the disclosure.

The DRSRJ 300, in at least one embodiment, may further include the downhole tubing mandrel 350. The downhole tubing mandrel 350 in one embodiment includes a downhole premium connection. The downhole premium connection, in one or more embodiments, may comprise a standard premium connection, or in one or more other embodiments may comprise a 3½" VAM TOP box, among others. The downhole premium connection of the downhole tubing mandrel 350, in the embodiment shown, is configured to attach to a downhole tubing string.

The DRSRJ 300, in at least one embodiment, may further include the control line swivel housing 355 (FIG. 3B). The control line swivel housing 355, in one or more embodiments, is configured to allow the lower control lines to rotate around the tubing's axis. In at least one embodiment, the control line swivel housing 355 is connected to the inner mandrel of the slip ring 335, so the inner mandrel will turn as the downhole tubing mandrel 350 and associated downhole tubing string below are turned. The control line swivel housing 355 also seals against the downhole tubing mandrel 350 to provide a pressure-tight chamber and/or reservoir for the aforementioned non-conductive fluid.

In one or more embodiments of the disclosure, the fluid may comprise other properties. For example, the fluid may be a gel or liquid with a suitable refractive index so that light may pass through without degradation. For example, certain glycols (e.g., propylene glycol) have an index of refraction of approximately 1.43, which is close to the index of refraction of some fiber-optic cables used for telecommunications (e.g., approximately 1.53). Luxlink® OG-1001 is a non-curing optical coupling gel that has an index of refraction of approximately 1.457, which substantially matches the index for silica glass. The Luxlink® OG-1001 optical coupling gel has a high optical clarity with absorption loss less than about 0.0005% per micron of path length. In one or more embodiments of the disclosure, there may be multiple pressure-tight, pressure-compensation methodologies, systems and/or components. For example, there may one for isolation and protection of a fiber optic system or sub-system. Likewise, other pressure-tight, pressure-compensation methodologies, systems and/or components may employ a di-electric fluid, as mentioned previously, to offer protection for the electrical components, sub-system, system. Correspondingly, the hydraulic system may have its own pressure-tight, pressure-compensation items geared toward maximum survivability of the hydraulic components and system. Other properties/molecular components may be employed/added to the one or more fluids. For example, a thixotropic hydrogen scavenging compound to, for example, manage any level of free hydrogen that may be result from processing and/or deployment. An example fluid is LA6000; a thixotropic high temperature gel suitable for filling and/or flooding of optical fiber and energy cables. This gel primarily used in metal tubes and tubes manufactured with polybutylene terephthalate (PBT). LA6000 is suitable to temperatures up to and exceeding 310° C.

In accordance with one or more embodiments of the disclosure, the control line swivel housing 355 may include a pressure-compensation device 370 (FIG. 3B) (e.g., pressure-compensation piston) to equalize internal and external pressures within the DRSRJ 300. Accordingly, as a result of the pressure-compensation device 370, the DRSRJ 300 may employ thinner wall structures than might not otherwise be possible. In at least one embodiment, the pressure-compensation device 370 may provide slight positive pressure internally. In at least one embodiment, multiple pressure-compensation devices 370 maybe be used to prevent cross-contamination of fluids best-suited for the different energy-transfer systems (electric, hydraulic, fiber optic, etc.) The DRSRJ 300, in at least one embodiment, may further include anchor bolts 360 in the tubing swivel housing 365. The anchor bolts 360 (FIG. 3I) provide a method for securing the outer mandrel of the slip ring 335. Note that seals are located in the vicinity of the anchor bolts 360 for providing upper seals for the retention of the non-conductive fluid.

The DRSRJ 300, in at least one embodiment, may further include the tubing swivel housing 365. The tubing swivel housing 365 (FIGS. 3A and 3B), in one or more embodiments, may house the outer mandrel of the slip ring 335. The tubing swivel housing 365 may additionally provide a shoulder 375 for supporting the tubing swivel housing 365. The tubing swivel housing 365 may additionally provide an area for radial and axial support bushings for tubing swivel mandrel. The tubing swivel housing 365 may additionally provide seal surfaces for tubing swivel mandrel, and provide radial bushing/centering rings for tubing swivel seals. The tubing swivel housing 365 may also provide passageway for one or more control lines. In at least one embodiment, tubing swivel housing 365 inner ID's centerline may be offset from the centerline of the tubing swivel housing's 365.

Figure 3C:
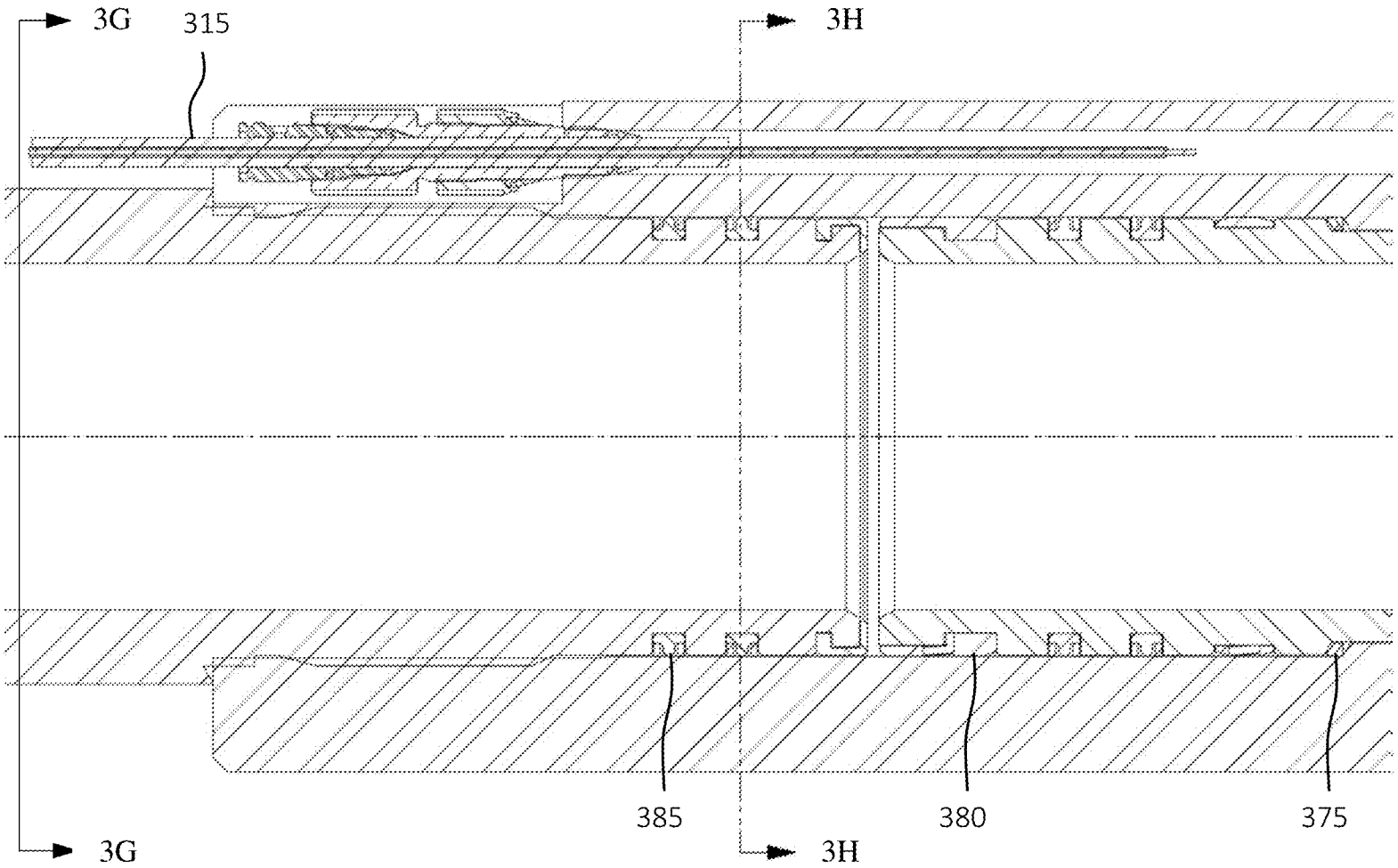
FIGS. 3C through 3G illustrate certain zoomed in views of the of the DRSRJ of FIG. 3B.
Figure 3D:
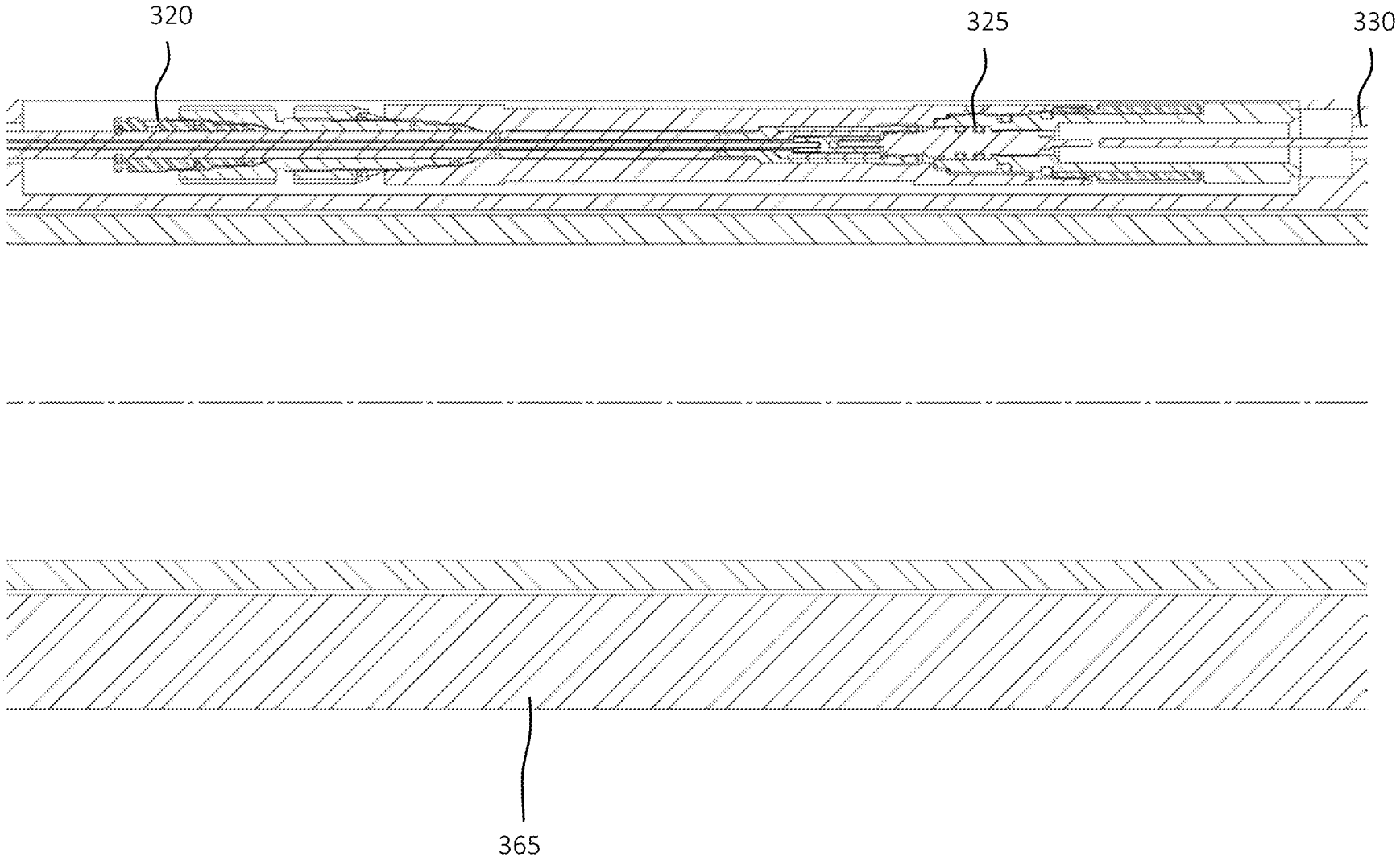
Figure 3E:
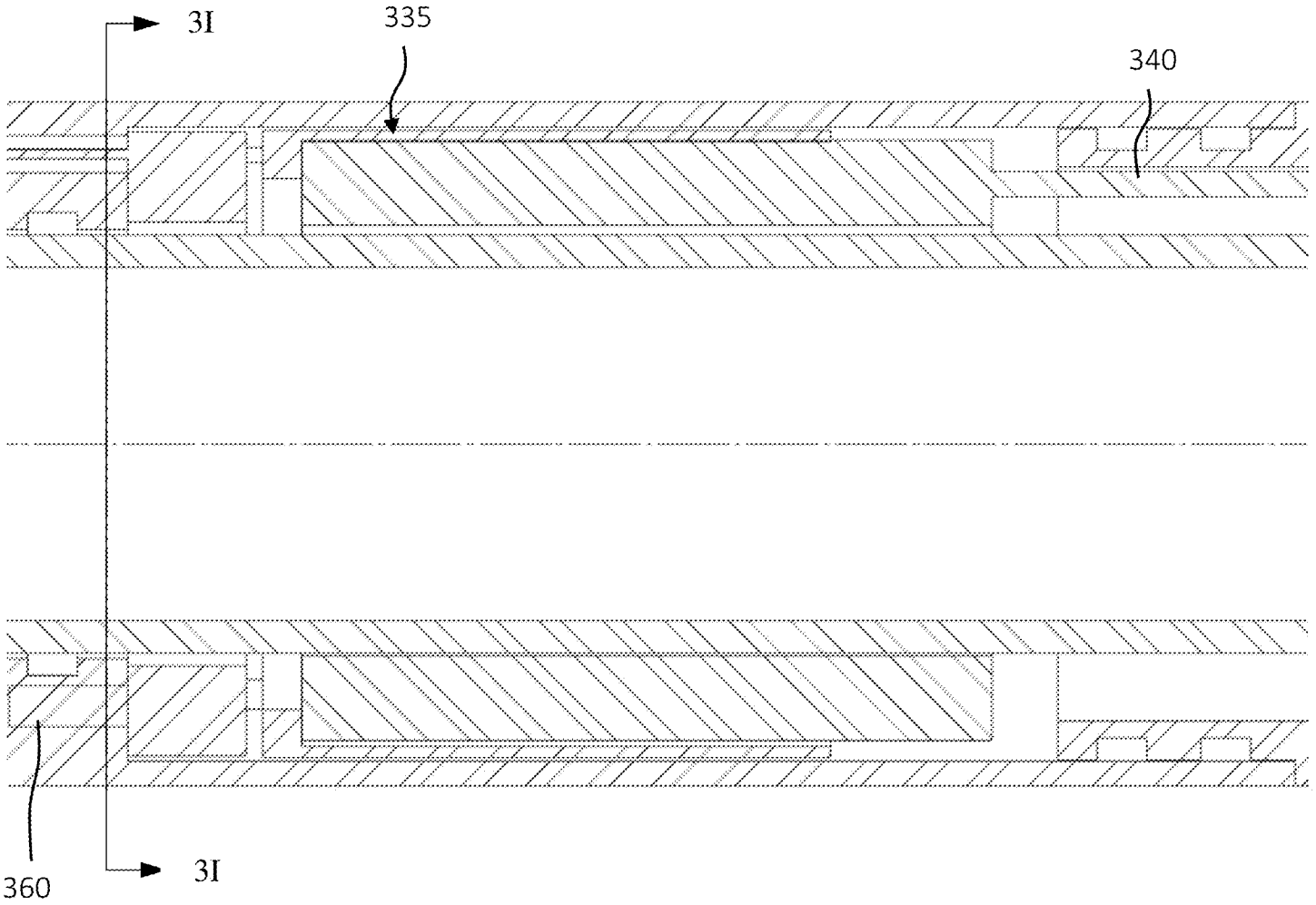
Figure 3F:
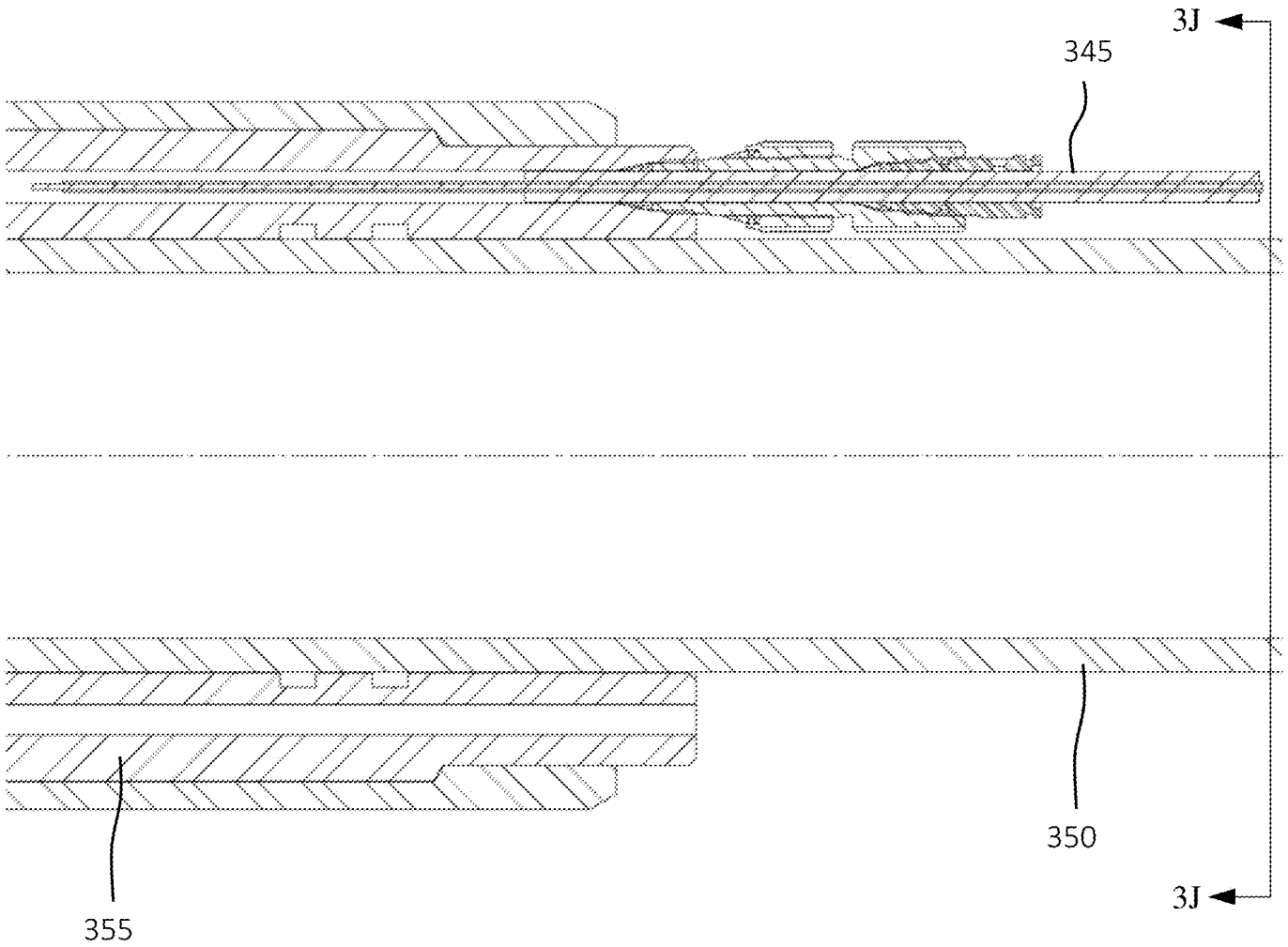

The DRSRJ 300, in at least one embodiment, may further include bushings 380 (FIG. 3B). The bushing 380 have a variety of different purposes. In one embodiment, the bushings 380 support the tubing swivel housing 365, and thus reduce the coefficient of friction of the swivel (e.g., such that it is less than steel on steel). In yet another embodiment, the bushings 380 provide a bearing area, which is primarily axially. The bushing 380 may also act as an end bushing, and thus provide a bearing area when a compressional load is applied for the tubing swivel housing 365. In at least one embodiment, a gap between the shoulder 375 and the bushings 380 may be increased to provide a travel joint feature, as is shown in FIG. 3L. If a travel joint feature were used, the contacts between the outer mandrel and the inner mandrel would need to accommodate this axial movement (e.g., by being allowed to move with the travel joint).

The DRSRJ 300, in at least one embodiment, allows the inner mandrel of the slip ring 335, the downhole connection 345, the downhole tubing mandrel 350 and the control line swivel housing 355 to rotate, relative to the other features, all the while retaining communication between the uphole connection 315 and the downhole connection 345. The DRSRJ 300 is also very applicable with tools with external control lines. Accordingly, in at least one embodiment the DRSRJ is applicable with tools that have no internal control lines. Accordingly, in at least one embodiment the DRSRJ is applicable with tools that have at least one external control line. Further to the disclosure, in at least one embodiment a length (L) of the DRSRJ 300 is greater than 24", greater than 60.96 cm (e.g., 36"), greater than 121.92 cm (e.g., 48"), greater than 152.4 cm (e.g., 60"), and greater than 203.2 cm (e.g., 80"). Further to the disclosure, a greatest outside diameter (D) of the DRSRJ 300, in at least one embodiment, is less than 16.51 cm (e.g., 6.5"), less than 13.97 cm (e.g., 5.5"), or less than 11.43 cm (e.g., 4.5"). Further to the disclosure, the slip ring 335 may not be watertight or waterproof, and thus may require two or more sets of O-rings 385, as shown in FIGS. 3B and 3C.

Figure 3G:
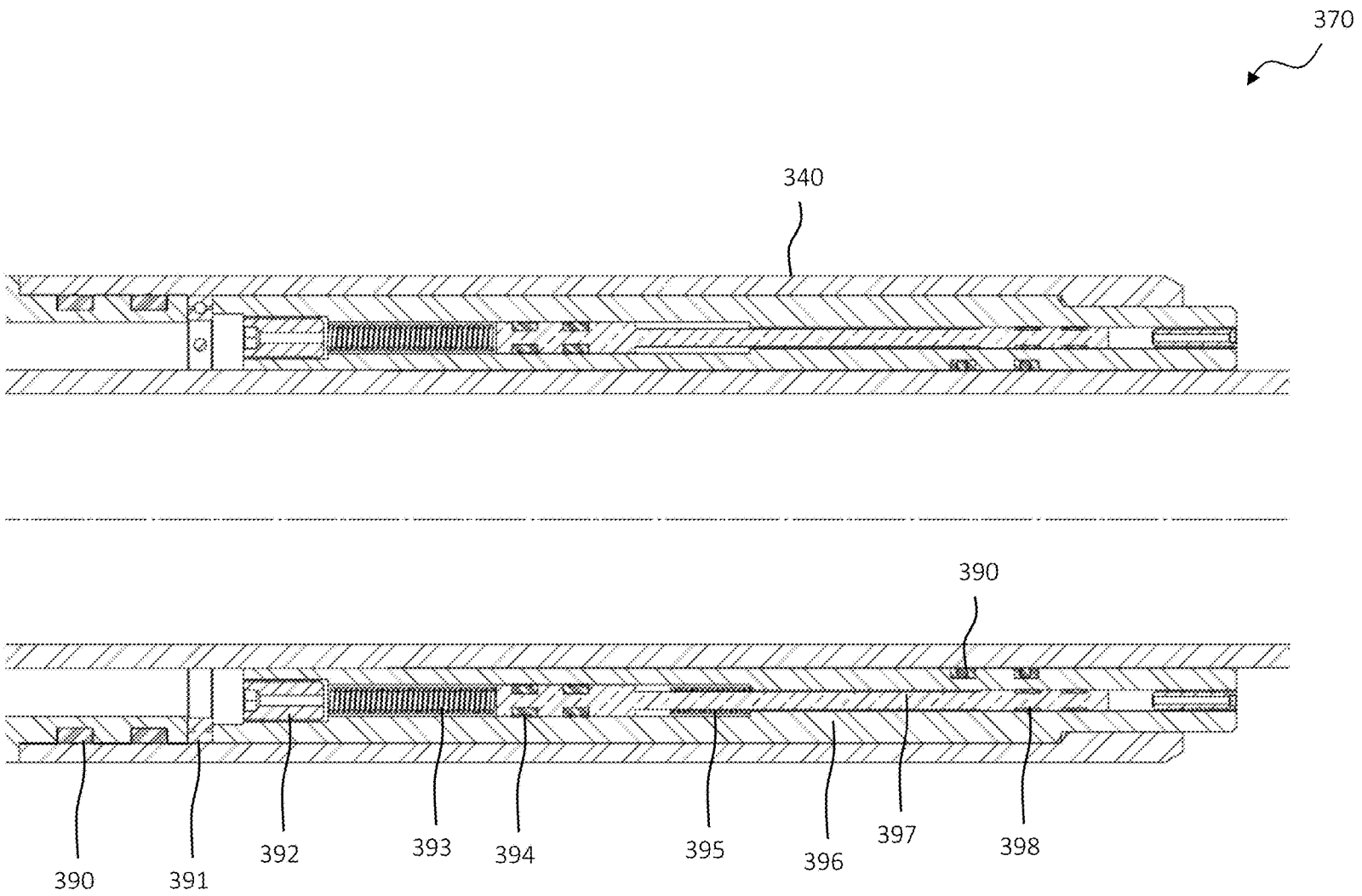
Figure 3I:
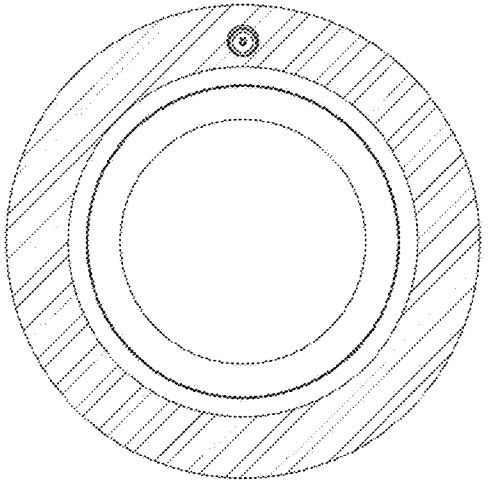
FIGS. 3H through 3K illustrate certain cross-sectional views of the DRSRJ of FIG. 3B taken through the lines 3H-3H, 3I-3I, 3J-3J and 3K-3K, respectively.
Figure 3K:
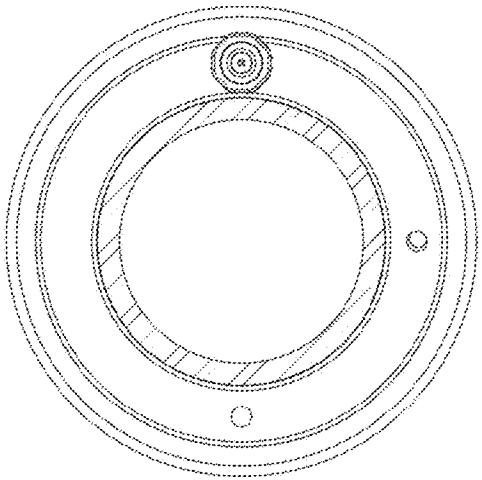
Figure 3H:
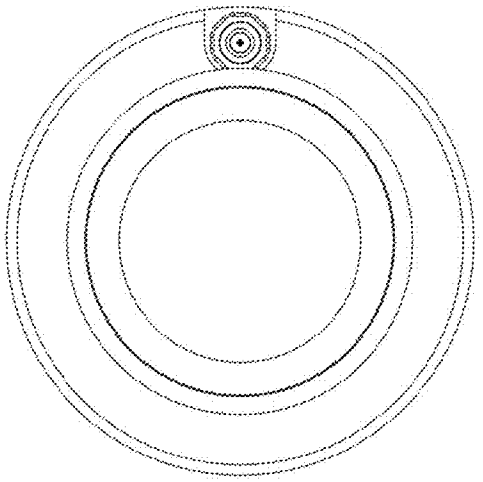
Figure 3J:
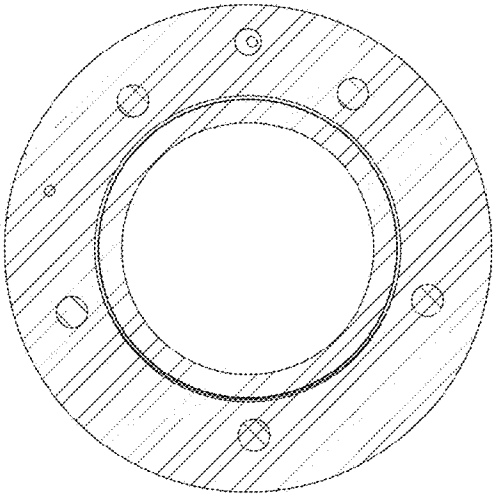
Figure 3L:
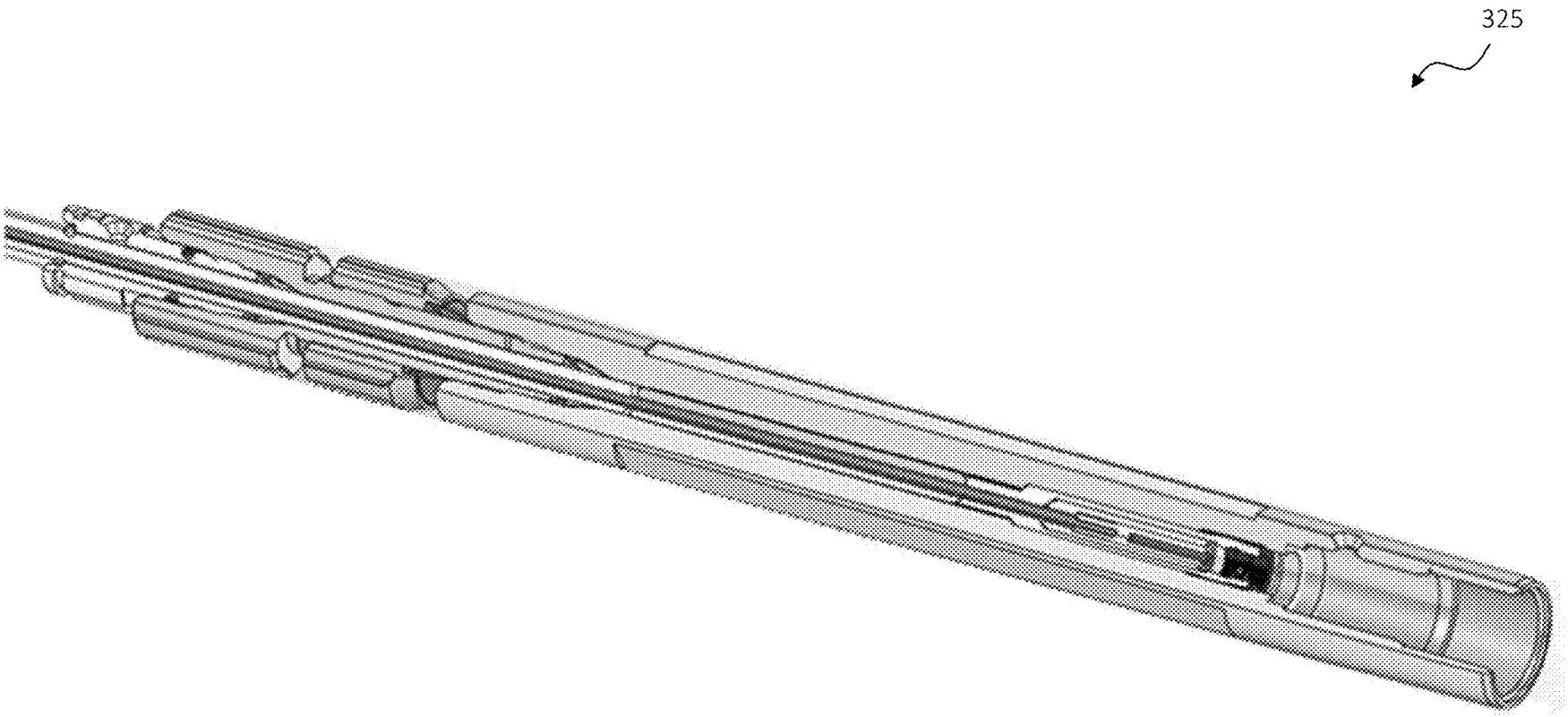
FIG. 3L illustrates one embodiment of a cable termination comprising a cable termination/connection, for example similar to the 03018465 Roc Gauge Family.

Turning to FIGS. 3C through 3G, illustrated are certain zoomed in views of the of the DRSRJ 300 of FIG. 3B. In the illustrated embodiment, FIG. 3G illustrates a zoomed in view of the pressure compensation device 370. In the illustrated embodiment of FIG. 3G, the pressure compensation device 370 includes one or more seals 390 that isolate the inner chamber from the wellbore fluids and pressures. In one embodiment, the one or more seals 390 may also comprise bearings, bushings, etc. to help reduce friction between the pressure-compensation device and the inner mandrel and/or or components. In some embodiments, there may be other seals to seal other areas. There may be other friction-reducing devices and methodologies.

In the illustrated embodiment of FIG. 3G, the pressure compensation device 370 further includes a thrust bearing 391 to reduce friction during rotation process. In the illustrated embodiment of FIG. 3G, the pressure compensation device 370 further includes a retainer 392 to retain the pressure compensation piston within its chamber. The retainer 392 may have other uses. In at least one embodiment, the retainer 392 may have a metering device to prevent sudden surges of pressure being applied to the inner chamber components. The retainer 392 may also a check valve arrangement to prevent fluid from flowing to the outside in the event of a failure of seal (394, 398). The retainer 392 may comprise a poppet valve arrangement that may only function after a particular "cracking" pressure is reached.

In the illustrated embodiment of FIG. 3G, the pressure compensation device 370 further includes a biasing spring 393. The biasing spring 393 may have multiple purposes, including preventing sudden surges, limiting the travel of the piston, etc. In the illustrated embodiment of FIG. 3G, the pressure compensation device 370 further includes 1 or more seals 394 to prevent the transfer of fluids from the inside to the outside and vice-versa. In the illustrated embodiment of FIG. 3G, the pressure compensation device 370 may further include another (optional) biasing device 395, which may be similar to the biasing spring 393 In the illustrated embodiment of FIG. 3G, the pressure compensation device 370 further includes a pressure-compensation housing 396. The pressure-compensation housing 396, in one embodiment, contains the pressure compensation components and also one or more control lines (communications lines) to pass between itself and the outer component 399.

In the illustrated embodiment of FIG. 3G, the pressure compensation device 370 further includes a pressure compensation piston 397. The pressure compensation piston 397, in one embodiment, is designed to control the pressure differential between the interior and exterior areas. Note in some embodiments, there may be one or more devices such as a diaphragm and/or biasing device to allow changes in volume of the area between the large-piston area and small-position area. The different diameters of the pressure compensation piston 397 provide one method for keeping a positive pressure in the internal chamber. By having a larger diameter (piston area) on the internal side, it may bias the piston to the right side. In some embodiment the pressure compensation piston 397 may have only one diameter to the inner and outer pressures act upon the same piston area. In some embodiments, there may not be a pressure compensation piston 397, but another device to provide the pressure-compensation—for example see the patent below. In one embodiment, the inner chamber may be pre-charged at the surface to keep a positive pressure on the inside.

In the illustrated embodiment of FIG. 3G, the pressure compensation device 370 further includes additional seals 398 or other devices to ensure the inner and outer fluids are kept isolated. In the illustrated embodiment of FIG. 3G, the pressure compensation device 370 further includes one or more upper (outer) components 399 that do not rotate (when the lower components are rotating).

Turning to FIGS. 3H through 3K, illustrated are certain cross-sectional views of the DRSRJ 300 of FIG. 3B taken through the lines 3H-3H, 3I-3I, 3J-3J and 3K-3K, respectively.

Turning briefly to FIG. 3L, illustrated is one embodiment of a cable termination 325 comprising a cable termination/connection, for example similar to the 03018465 Roc Gauge Family.

Figure 3M:
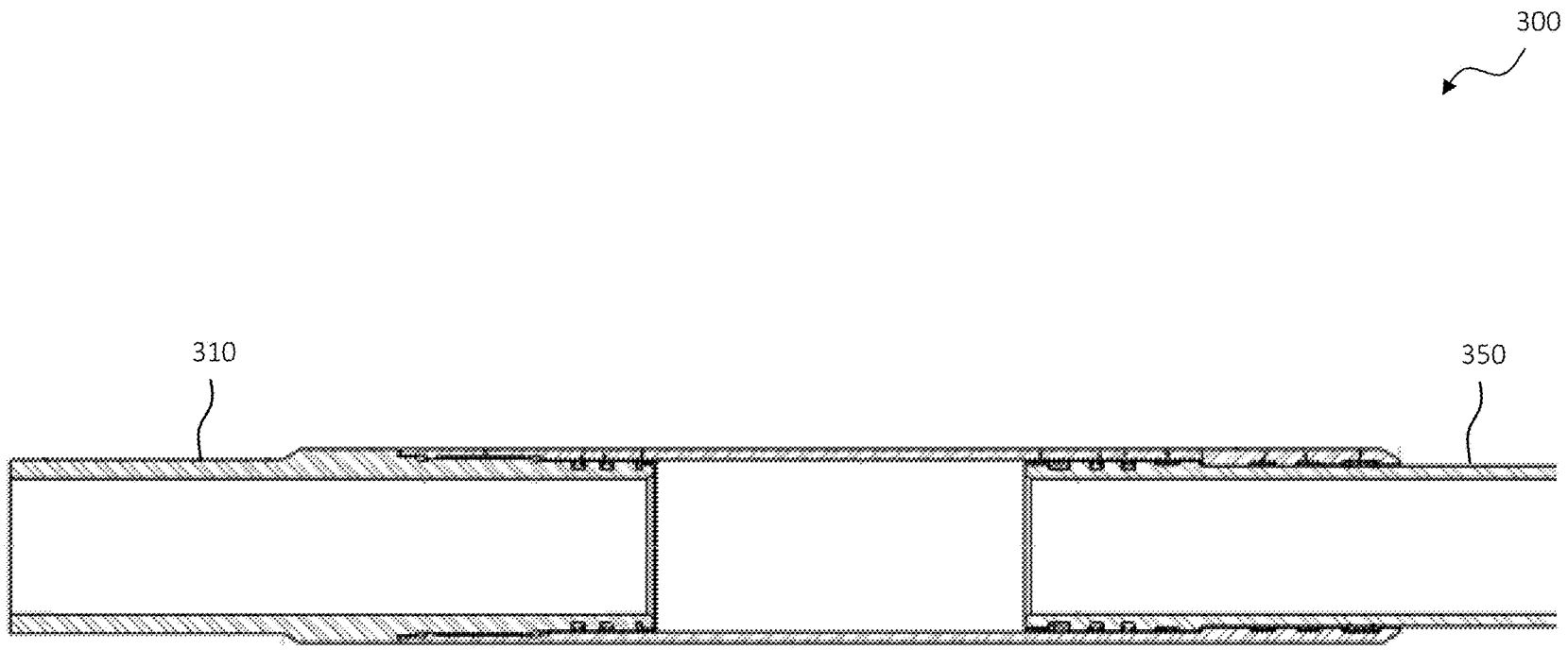
FIG. 3M illustrates a travel joint feature of the DRSRJ of FIGS. 3A and 3B.

Turning briefly to FIG. 3M, illustrated is a travel joint feature of the DRSRJ 300. In the embodiment of FIG. 3M, not only may the uphole tubing mandrel 310 rotate relative to the downhole tubing mandrel 350, but the uphole tubing mandrel 310 may axially translate relative to the downhole tubing mandrel 350. The DRSRJ 300, in this embodiment, includes the requisite seals, bushings wide slip rings, etc. to accomplish both relative rotation and relative translation. In at least one embodiment, the travel joint feature is operable to pull up to at least 22,680 Kg (e.g., about 50,000 lbs.).

Figure 4A:
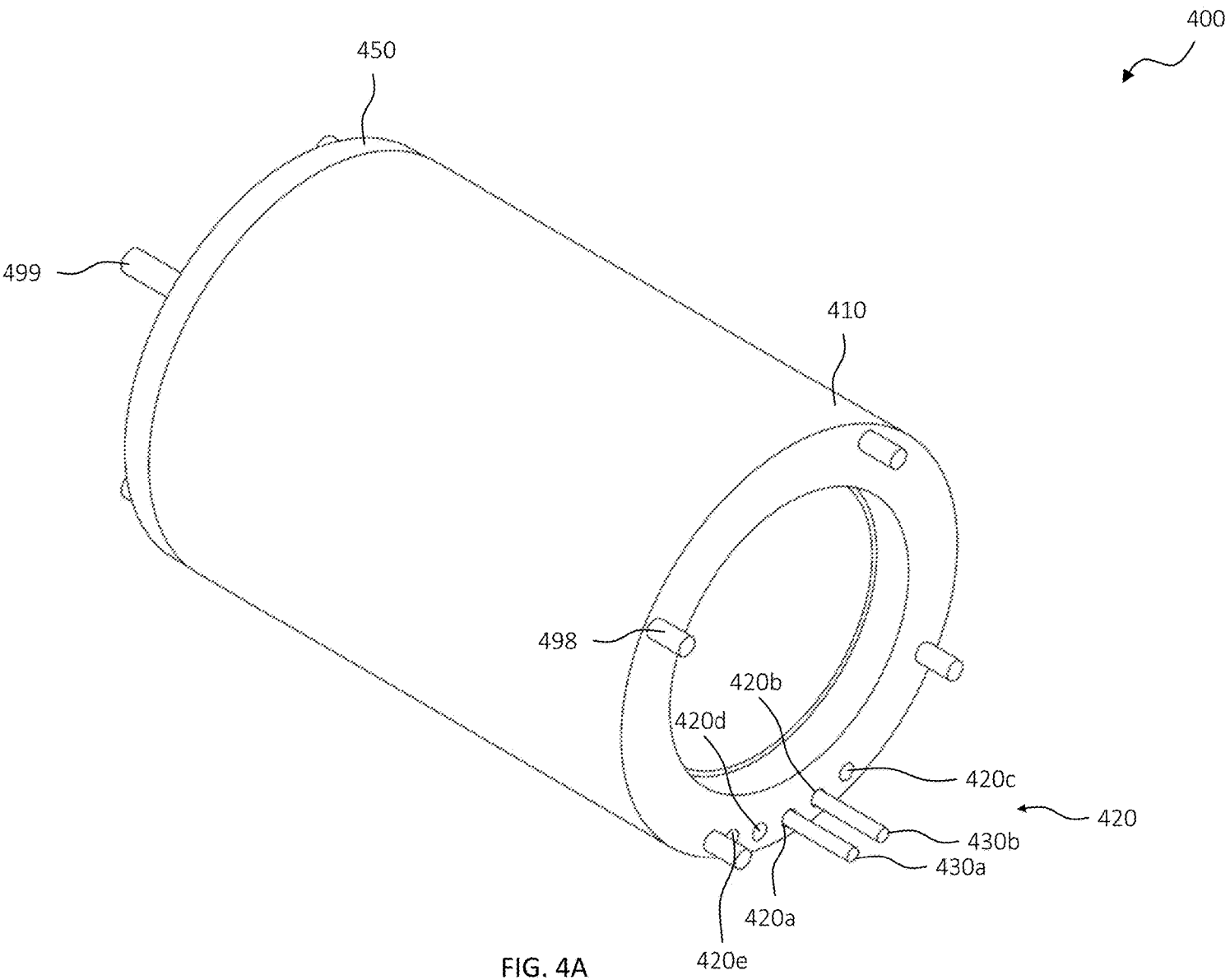

Turning to FIGS. 4A through 4EE, illustrated are a multitude of different views of a DRSRJ 400 designed, manufactured and operated according to one or more embodiments of the disclosure, and as might be used with a wellbore access tool as described herein. The DRSRJ 400 is similar in certain respects to the DRSRJ 300 disclosed above. With initial reference to FIG. 4A, illustrated is a perspective view of an upper end of the DRSRJ 400. The DRSRJ 400 includes an outer mandrel 410, as well as an inner mandrel 450 operable to rotate relative to the outer mandrel 410. In the illustrated embodiment, the outer mandrel 410 is the upper mandrel, wherein the inner mandrel 450 is the lower mandrel. Nevertheless, other embodiments exist wherein the opposite is true.

In the illustrated embodiment, one or more outer mandrel communication connections 420 are coupled to the outer mandrel 410. The outer mandrel communication connections 420, in accordance with one embodiment of the disclosure, may be one or more of electrical connections, optical connections, hydraulic connections, etc. In the illustrated embodiment, the DRSRJ 400 includes five outer mandrel communication connections 420*a*, 420*b*, 420*c*, 420*d*, 420*e*. For example, in at least one embodiment, as shown, the first outer mandrel communication connection 420*a* is a first electrical outer mandrel communication connection, and the second outer mandrel communication connection 420*b* is a second electrical outer mandrel communication connection. Thus, in the embodiment shown, the first outer mandrel communication connection 420*a* includes a first outer mandrel electrical line 430*a* entering it, as well as the second outer mandrel communication connection 420*b* includes a second outer mandrel electrical line 430*b* entering it.

In at least one embodiment, the first outer mandrel communication connection 420*a* is configured is configured as a power source, whereas the second outer mandrel communication connection 420*b* is configured as a data/signal source. In at least one embodiment, the power source requires a higher voltage and amperage rating, as compared to the data/signal source. In contrast, the data/signal source, in at least one embodiment, requires faster rise-and-lower times to switch from a "one" (e.g., positive) to a "zero" (e.g., no voltage or a voltage level different than the "one" voltage). In some embodiments, the "ones" and "zeros" can be produced by varying the amperage of the electricity passing through the electrical conductors. While certain details have been given, it is within the scope of this disclosure to cover any and all forms of electricity—and uses of electricity—that may benefit from this disclosure. For example, in one embodiment this disclosure may be used to transmit data (pulses of electricity, etc.) for control, monitoring, recording, transmitting, computing, comparing, reporting, and other activities know by those skilled in the art of electricity, electronics, power, controls, etc. Likewise, in at least one embodiment the power source may be used for powering motors, prime movers, actuators, controllers, valves, switches, comparators, Pulse Width Modulations (PWM) devices, etc., without departing from the scope of the disclosure. Further to the embodiment of FIG. 4A, the third outer mandrel communication connection 420*c* is a first hydraulic outer mandrel communication connection, the fourth outer mandrel communication connection 420*d* is a second hydraulic outer mandrel communication connection, and the fifth outer mandrel communication connection 420*e* is a third hydraulic outer mandrel communication connection.

The DRSRJ 400, in the illustrated embodiment, additionally includes one or more (e.g., typically two or more) upper mounting/alignment features 498 and one or more (e.g., typically two or more) lower mounting/alignment features 499. The one or more upper mounting/alignment features 498, in the illustrated embodiment, are configured to mount the outer mandrel 410 to upper components coupled thereto, including without limitation upper components of a swivel. The one or more lower mounting/alignment features 499, in the illustrated embodiment, are configured to mount the inner mandrel 450 to lower components coupled thereto, including without limitation lower components of a swivel. The use of the one or more upper and lower mounting/alignment features 498, 499 may be employed to ensure rotation between the outer mandrel 410 and the inner mandrel 450. The one or more upper and lower mounting/alignment features 498, 499 may further be used to help align the one or more outer/inner communications connections 420, 460 with their associated mating parts/lines.

Figure 4B:
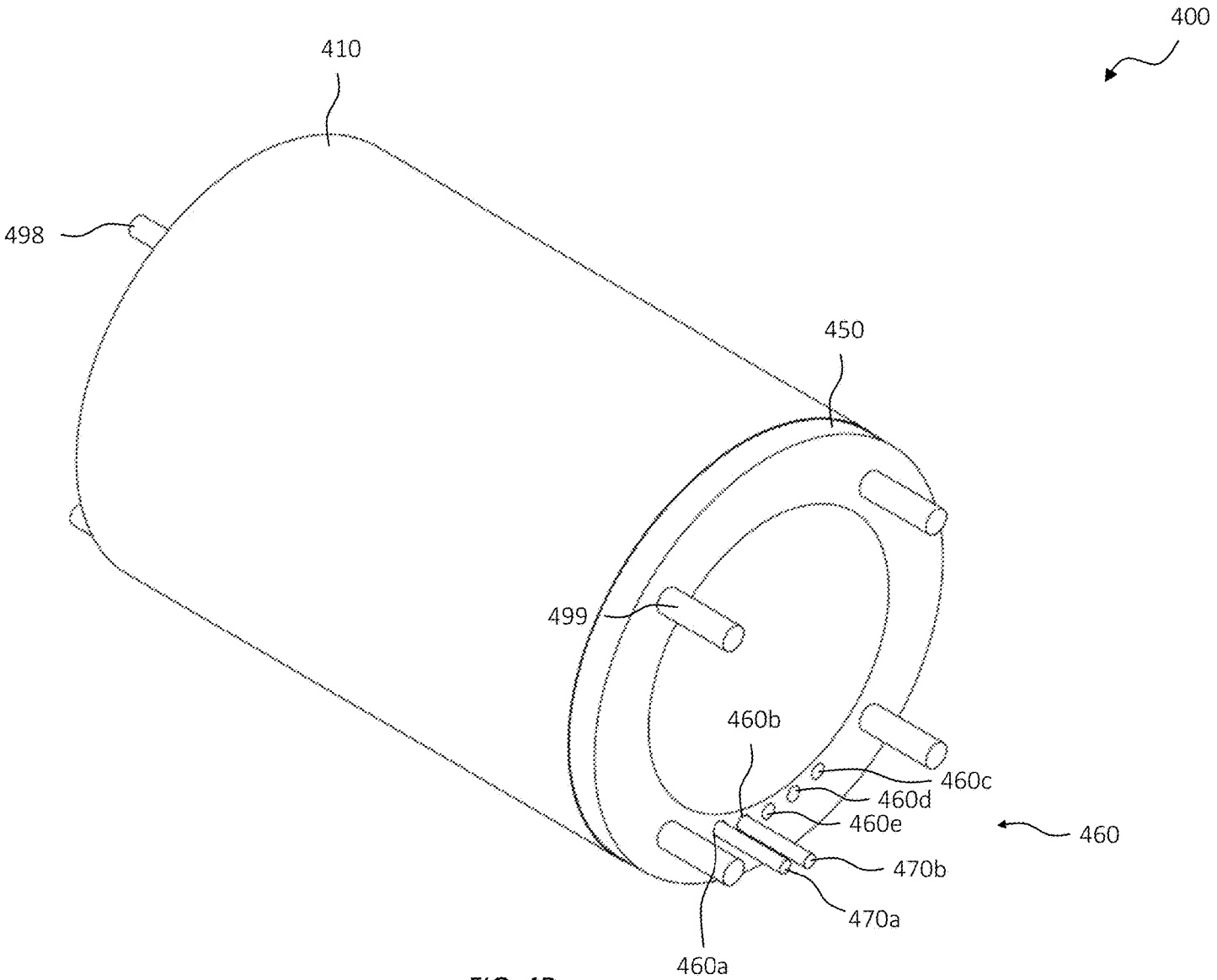

With reference to FIG. 4B, illustrated is a perspective view of a lower end of the DRSRJ 400. In the illustrated embodiment, one or more inner mandrel communication connections 460 are coupled to the inner mandrel 450. The inner mandrel communication connections 460, in accordance with one embodiment of the disclosure, may also be one or more of electrical connections, optical connections, hydraulic connections, etc. In the illustrated embodiment, the DRSRJ 400 includes five inner mandrel communication connections 460*a*, 460*b*, 460*c*, 460*d*, 460*e*, which in fact are rotationally coupled to the five outer mandrel communication connections 420*a*, 420*b*, 420*c*, 420*d*, 420*e*. Accordingly, in at least one embodiment, as shown, the first inner mandrel communication connection 460*a* is a first electrical inner mandrel communication connection, and the second inner mandrel communication connection 460*b* is a second electrical inner mandrel communication connection. Thus, in the embodiment shown, the first inner mandrel communication connection 460*a* includes a first inner mandrel electrical line 470*a* entering it, as well as the second inner mandrel communication connection 460*b* includes a second inner mandrel electrical line 470*b* entering it. Further to the embodiment of FIG. 4B, the third inner mandrel communication connection 460*c* is a first hydraulic inner mandrel communication connection, the fourth inner mandrel communication connection 460*d* is a second hydraulic inner mandrel communication connection, and the fifth inner mandrel communication connection 460*e* is a third hydraulic inner mandrel communication connection.

The DRSRJ 400, in the illustrated embodiment, includes five outer/inner mandrel communication connections 420, 460. Nevertheless, there may be more or less outer/inner communication connections 420, 460 and remain within the purview of the disclosure. The communication connections 420, 460 may be used to transfer power (hydraulic, electrical, light, electromagnetic, pressure, flow, and all other sources of energy or combinations thereof). The word power, energy and all related terms means to be applicable forms of energy and to all uses of energy (including but not limited to power transmission and use, data transmission and use, controlling signal transmission and use, and all other forms and uses mentioned here within this disclosure and other uses know to ones skilled in the art, skilled in one or other arts, future uses both existing and not-yet-invented.

Additionally, the outer/inner communications connections 420, 460 are shown arrange in one particular order and grouped in one local. However, the number and placement may be changed and still remains within the scope of this disclosure. For example, the outer/inner communications connections 420, 460 maybe located equidistant 360-degree around the face of the DRSRJ 400. In some examples, the outer/inner communications connections 420, 460 may be place on different surfaces, positions, orientations, etc. For example, one or more outer/inner communications connections 420, 460 may be located on an OD wall of the DRSRJ 400.

Furthermore, while the terms outer mandrel and inner mandrel have been used, other terms such as housing and rotor could be used. Similarly, as indicated above, the outer mandrel (e.g., housing) may be the upper mandrel (e.g., upper housing) and the inner mandrel (e.g., rotor) may be the lower mandrel (e.g., lower rotor), or vice versa.

Figure 4C:
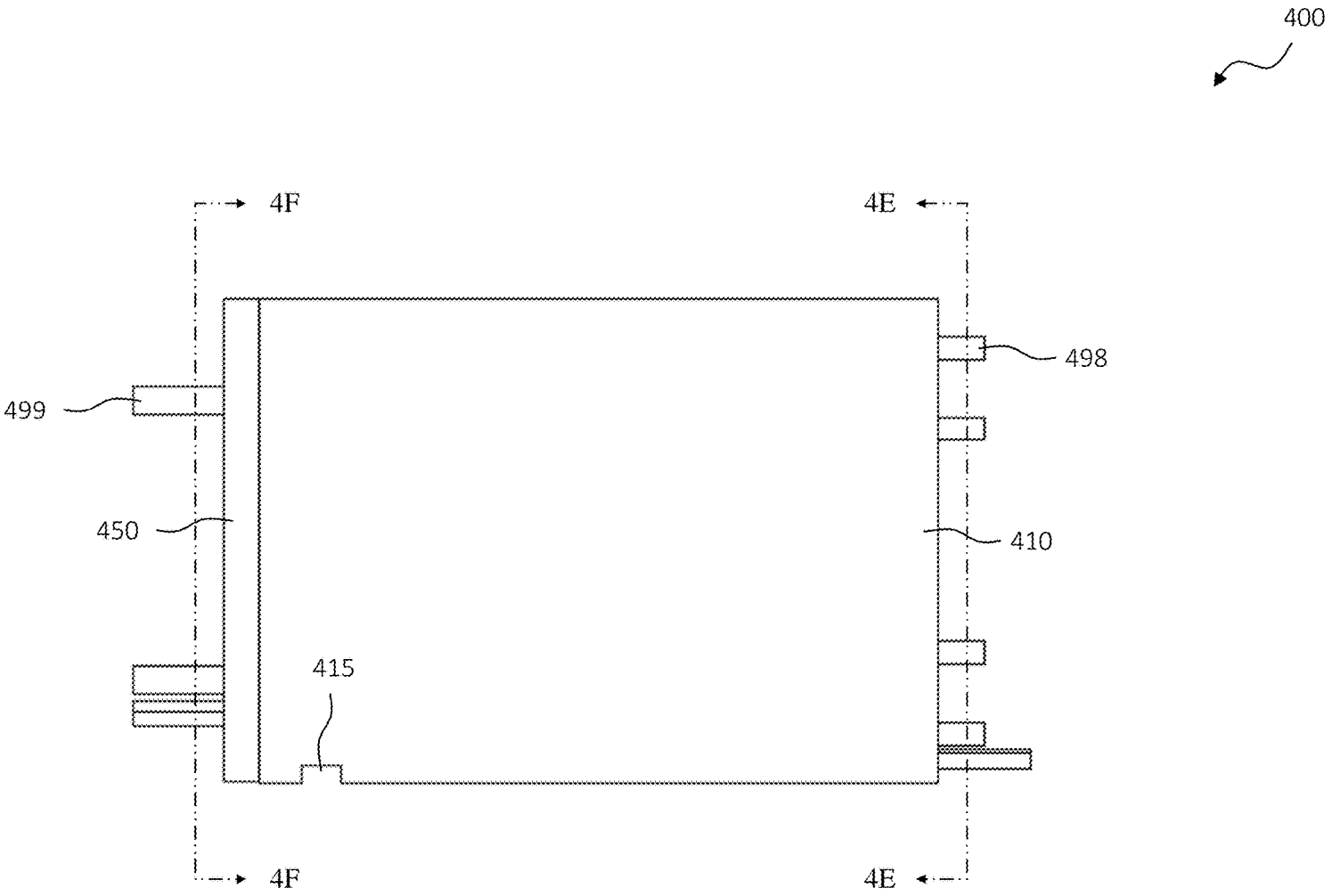
Figure 4D:
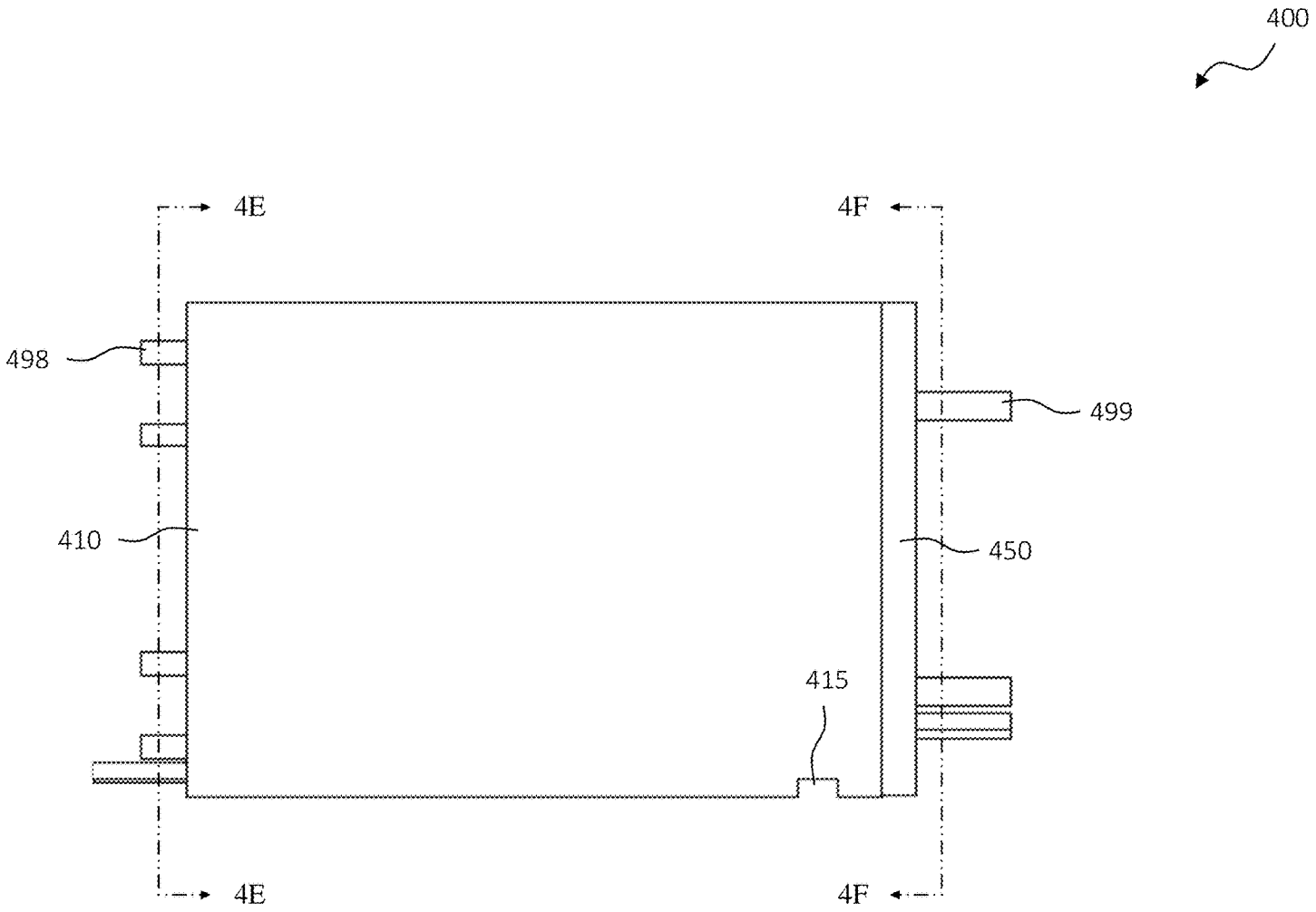

Turning to FIGS. 4C and 4D, illustrated are side views of the DRSRJ 400 illustrated in FIGS. 4A and 4B, respectively. As shown, in at least one embodiment, the outer mandrel 410 may have an access portion 415. The access port 415 may, in one embodiment, be used to access and/or join the outer mandrel 410 and the inner mandrel 450 together. For example, snap ring pliers, among others, might us the access portion 415 to join the outer mandrel 410 and inner mandrel 450 together.

Figure 4F:
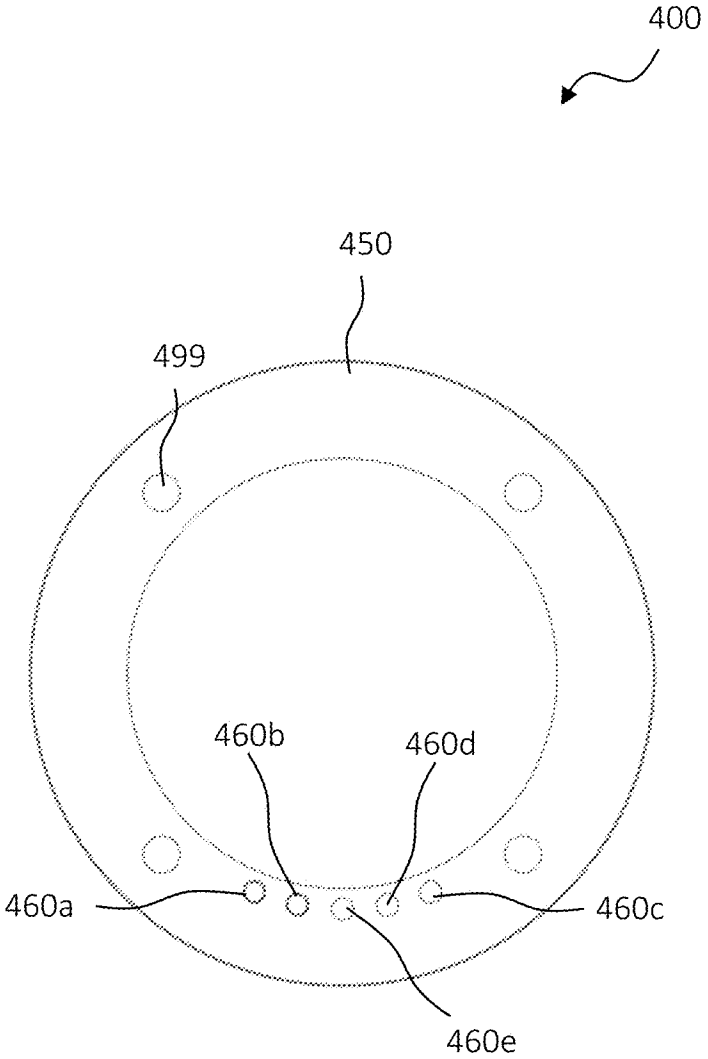
Figure 4E:
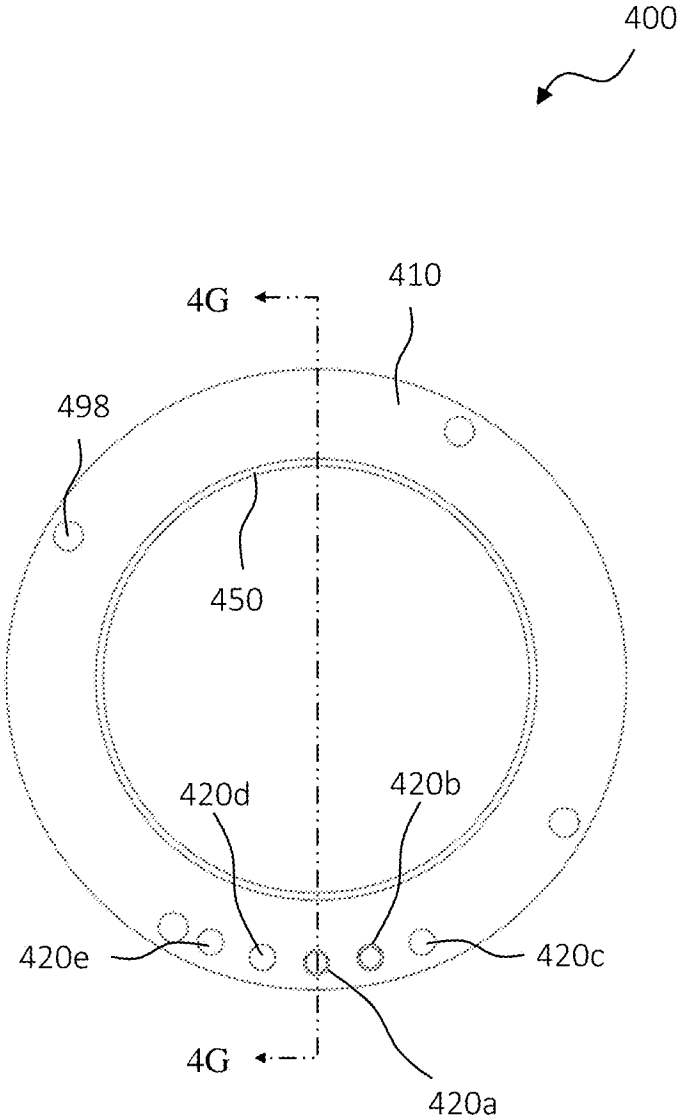

Turning to FIGS. 4E and 4F, illustrated are sectional views of the DRSRJ 400 illustrated in FIGS. 4C and 4D, taken through the lines E-E and F-F, respectively. In the illustrated embodiment of FIG. 4E, the second outer mandrel electrical communication connection 420*b* is angularly positioned between the first outer mandrel electrical communication connection 420*a* and the third outer mandrel hydraulic communication connection 420*c*, the first and second outer mandrel electrical communication connections 420*a*, 420*b* are angularly positioned between the third and fourth outer mandrel hydraulic communication connections 420*c*, 420*d*, the fourth outer mandrel hydraulic communication connection 420*d* is angularly positioned between the first outer mandrel electrical communication connection 420*a* and the fifth outer mandrel hydraulic communication connection 420*e*. In the illustrated embodiment of FIG. 4F, the second inner mandrel electrical communication connection 460*b* is angularly positioned between the first inner mandrel electrical communication connection 460*a* and the third inner mandrel hydraulic communication connection 460*c*, the fourth inner mandrel hydraulic communication connection 460*d* is angularly positioned between the second inner mandrel electrical communication connection 460*b* and the third inner mandrel hydraulic communication connection 460*c*, the fifth inner mandrel hydraulic communication connection 460*e* is angularly positioned between the second inner mandrel electric communication connection 460*b* and the fourth inner mandrel hydraulic communication connection 460*d*. In yet another embodiment, one or more of the outer mandrel communication connections may be radially offset from one or more others of the outer mandrel communication connections. Similarly, in at least one embodiment, one or more of the inner mandrel communication connections may be radially offset from one or more others of the inner mandrel communication connections. In yet another embodiment, one or more of the outer mandrel communication connections may be radially offset from one or more of the inner mandrel communication connections.

Figure 4G:
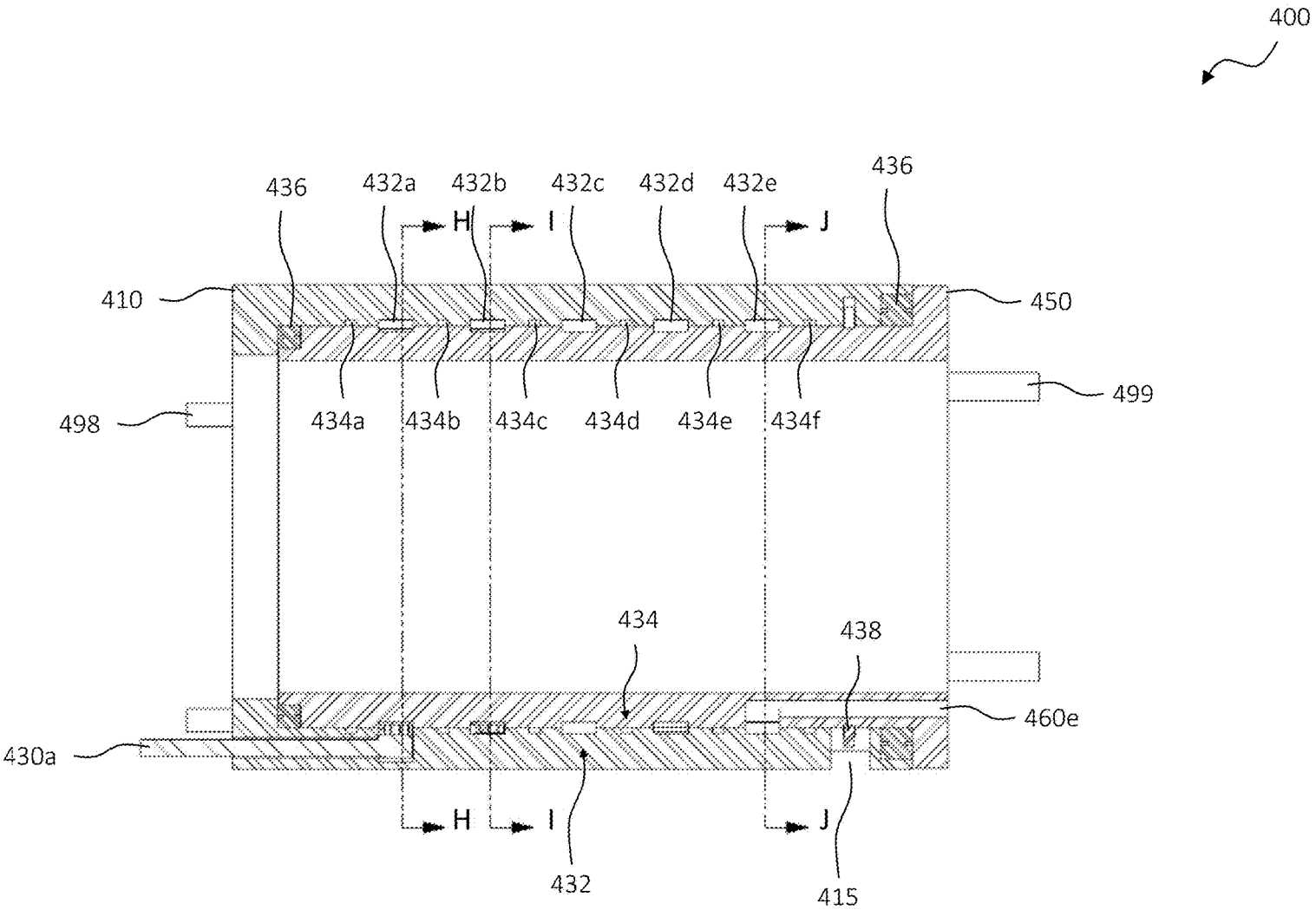

Turning to FIG. 4G, illustrated is a cross-sectional view of the DRSRJ 400 of FIG. 4E, taken through the line G-G. FIG. 4G illustrates the various different passageways 435 that may exist for coupling the five outer mandrel communication connections 420*a*, 420*b*, 420*c*, 420*d*, 420*e* and the five inner mandrel communication connections 460*a*, 460*b*, 460*c*, 460*d*, 460*e*. In the illustrated embodiment, the DRSRJ 400 includes five passageways 432*a*, 432*b*, 432*c*, 432*d*, 432*e* for coupling the five outer mandrel communication connections 420*a*, 420*b*, 420*c*, 420*d*, 420*e* and the five inner mandrel communication connections 460*a*, 460*b*, 460*c*, 460*d*, 460*e*. FIG. 4G, given the cross-section that it depicts, does not illustrate any one complete communication passageway. For example, the first outer mandrel communication connection 420*a* (e.g., first electrical outer mandrel communication connection) is illustrated on the left in the outer mandrel 410, but the fifth inner mandrel communication connection 460*e* (e.g., third hydraulic inner mandrel communication connection) is illustrated on the right in the inner mandrel 450, neither of which couple to one another.

In the illustrated embodiment, the DRSRJ 400 additionally includes one or more sealing elements 434 separating the passageways 432. In the illustrated embodiment, the DRSRJ 400 includes six different sealing elements 434*a*, 434*b*, 434*c*, 434*d*, 434*e*, 434*f* (e.g., a single sealing element on either side of each passageway 432). Nevertheless, in one or more embodiments, the DRSRJ 400 might include a pair of sealing elements one either side of each passageway 432. The multiple sealing elements on either side of each passageway 432 would provide a redundant sealing, as well as could allow for a pressure balance situation.

The DRSRJ 400 of FIG. 4G may additionally include one or more bearings 436. The one or more bearings 436 may be used to accommodate any axial and/or radial loads on the DRSRJ 400. The one or more bearings 436 may also help ensure that the outer mandrel 410 and the inner mandrel 450 can rotate smoothly relative to one another, and furthermore that the electrical, optical, hydraulic, etc. connections within the passageways 432 are properly aligned and stay in contact. The DRSRJ 400 may additionally include a coupling feature 438, such as a snap ring, to hold the outer mandrel 410 and the inner mandrel 450 relative to one another.

Figure 4J:
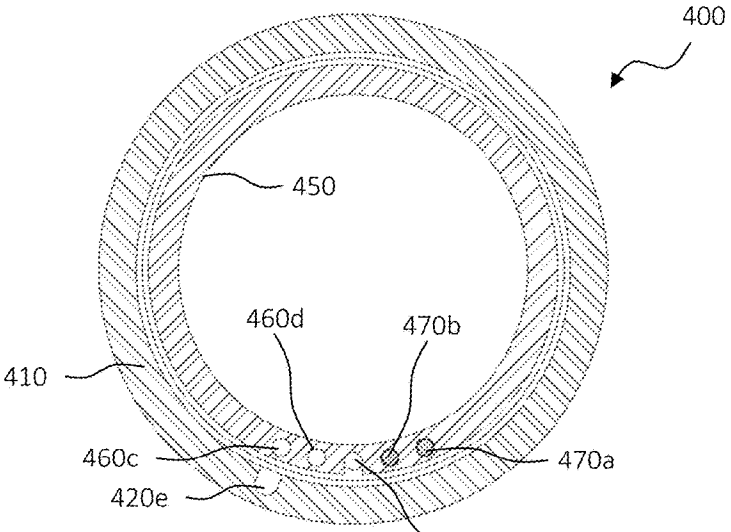
Figure 4H:
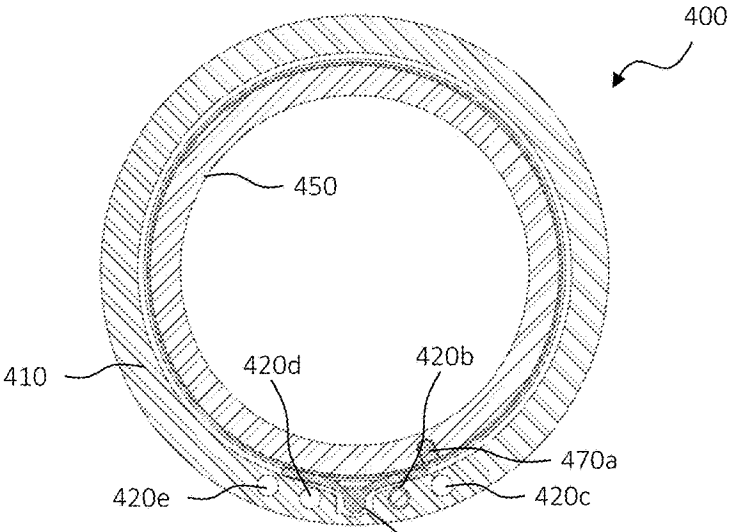
Figure 4I:
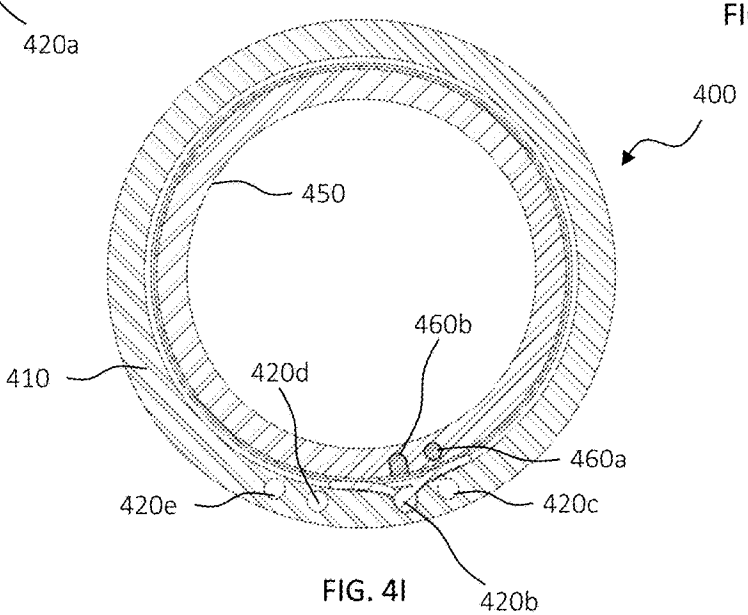

Turning to FIGS. 4H through 4J, illustrated are different cross-sectional views of the DRSRJ 400 of FIG. 4G, taken through the lines H-H, I-I, and J-J, respectively. FIG. 4H illustrates the connection of the first outer mandrel electric line 430*a* to the first inner mandrel electric line 470*a* via the first outer mandrel communication connection 420*a* and the first inner mandrel communication connection 460*a*. FIG. 4I illustrates the connection of the second outer mandrel electric line 430*b* to the second inner mandrel electric line 470*b* via the second outer mandrel communication connection 420*b* and the second inner mandrel communication connection 460*b*. FIG. 4J illustrates the connection of a third outer mandrel hydraulic line to a third inner mandrel hydraulic line via the fifth outer mandrel communication connection 420*e* and the fifth inner mandrel communication connection 460*e*.

Figure 4K:
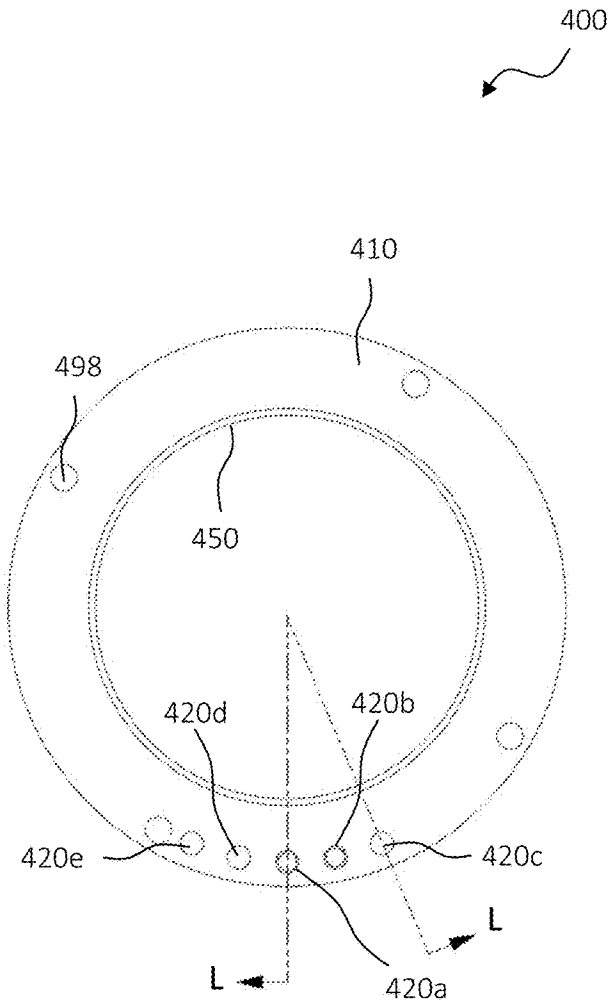

Turning to FIG. 4K, illustrated is another cross-sectional view of the DRSRJ 400 illustrated in FIG. 4E. The cross-sectional view of the embodiment of FIG. 4K is being used to help illustrate the complete first electrical path.

Figure 4L:
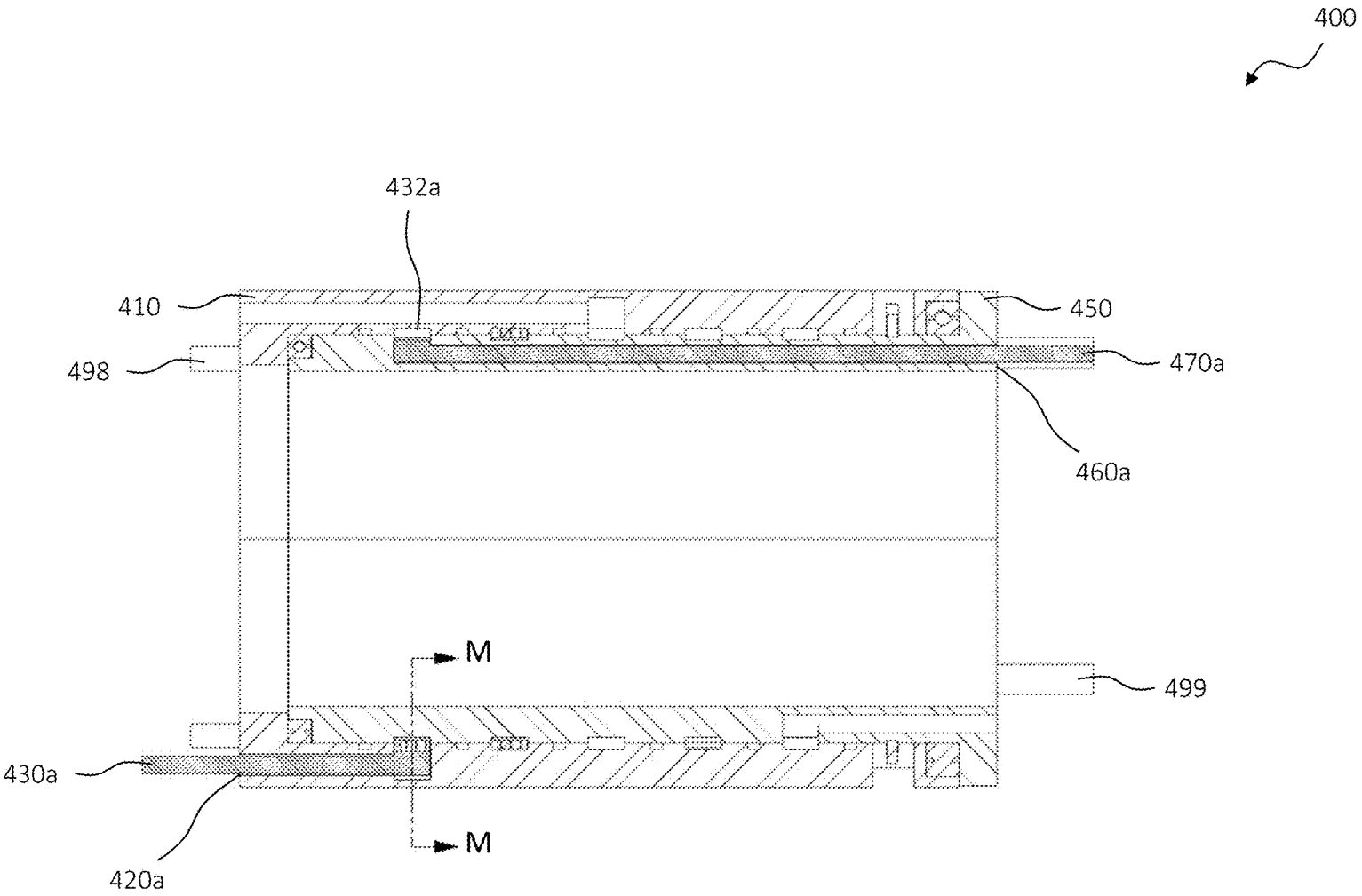

Turning to FIG. 4L, illustrated is a cross-sectional view of the DRSRJ 400 of FIG. 4K, taken through the line L-L. As shown in FIG. 4L, the first outer mandrel electrical line 430*a* enters the outer mandrel 410 at the first outer mandrel communication connection 420*a*, and at the passageway 432*a*, couples to the first inner mandrel electrical line 470*a* via the first inner mandrel communications connection 460*a*. In at least one embodiment, the coupling between the first outer mandrel electrical line 430*a* and the first inner mandrel electrical line 470*a* is via a metal-to-metal sealed connector and control line (e.g., 0.635 cm stainless steel tubing with insulated electrical wire inside of it).

Figure 4P:
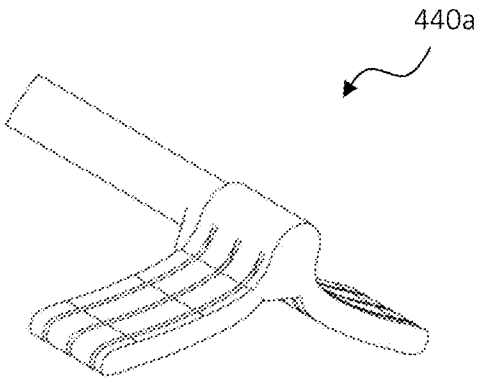
Figure 4O:
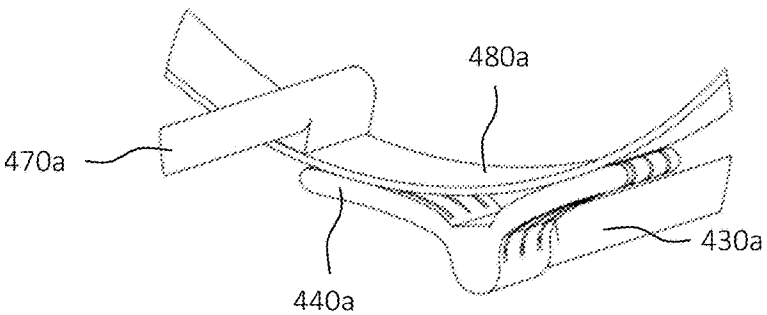
Figure 4M:
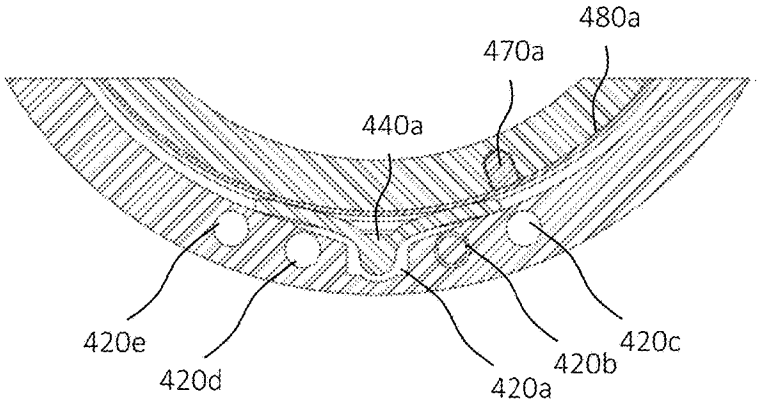

Turning to FIG. 4M, illustrated is a zoomed in cross-sectional view of a connection point between the first outer mandrel electrical line 430*a* and the first inner mandrel electrical line 470*a*, as taken through the line M-M in FIG. 4L. In the illustrated embodiment of FIG. 4M, the connection point includes a first contactor 440*a* rotationally coupled to the first outer mandrel electrical line 430*a*, and a first slip ring 480*a* rotationally coupled to the first inner mandrel electrical line 470*a*, the first contactor 440*a* and first slip ring 480*a* configured to rotate relative to one another at the same time they pass power and/or data signal between one another.

Figure 4N:
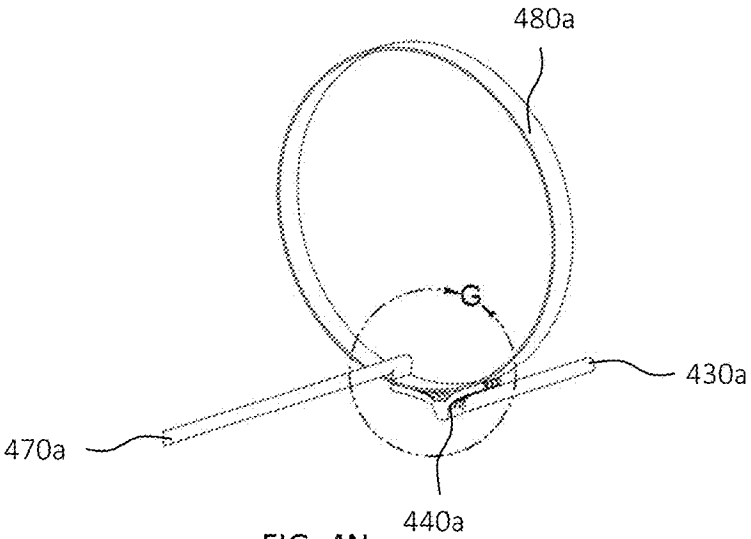

Turning to FIG. 4N, illustrated is a perspective view of one embodiment of how the first outer mandrel electrical line 430*a*, the first contactor 440*a*, the first slip ring 480*a* and the first inner mandrel electrical line 470*a* couple to one another. Slip rings, when used, may comprise one or more electrically-conductive material including but not limited to: gold, silver, copper, an alloy comprising one or more electrically-conductive materials/metals, graphite, a composite of graphite and one or more other materials. The slip rings, when used, may additionally have improved results when combined with one or more of a: RC filter, resistor, capacitor, inductor, switch, semi-conductor, chokes, diode, computer, logic-device, controller, battery, regulator, transformer, etc. Slip rings, when used, may also include methods and or devices to control the flow of electricity. For example, insulators—electrical insulators may be utilized: glass, porcelain or composite polymer materials, rubber, plastics, etc.

It should also be noted that the slip rings, when used, may form a full 360 degree structure. Accordingly, the slip rings, again when used, may allow the outer mandrel 410 to continuously rotate about the inner mandrel 450, in certain embodiments much more than just 360 degrees. Moreover, regardless of the total degrees of rotation, the slip rings provide the necessary electrical contact between the first outer mandrel electrical line 430*a*, the first contactor 440*a*, and the first inner mandrel electrical line 470*a*.

Turning briefly to FIG. 4O, illustrated is a zoomed in perspective view of the coupling of FIG. 4N.

Turning briefly to FIG. 4P, illustrated is a perspective view of one embodiment of the first contactor 440*a* of FIG. 4O. A variety of different contactors are within the scope of the disclosure. In at least one embodiment, the contactors include one or more (e.g., typically many) conductive brushes for completing the electrical connection. The brushes, when used, may comprise a variety of different materials and still remain within the scope of the disclosure. For example, graphite and/or copper-graphite brushes may be better-suited in some scenarios where bi-directional electrical transmission is needed. In these environments, these graphite-comprised brushes can withstand the corresponding high current spikes produced. Precious metal brushes may alternatively be used, and are typically utilized in designs with continuous operation with lesser current loads since they may be more sensitive to induction arcing. Techniques and devices such as using an RC filter between commutator segments to suppress brush spark can be advantageous. Other techniques and devices may be comprised to reduce electromagnetic emissions and increases the terminal capacitance, which acts as a short circuit for quick voltage changes are brush type contactors. The contactor, when used, may additionally include a biasing device (not shown) to keep the contactor in electrical contact with the mating part (e.g., slip ring the in illustrated embodiment), to ensure continuous, un-interrupted, flow of electricity. As mentioned above, redundant slip ring contacts may be used to ensure fail-safe operation, continuous slip ring contact so communications can be monitored continuously while running-in-hole, manipulating tools, etc. As further mentioned above, the DRSRJ 400 may include an actuated switch to latch long-term contacts, the actuated switch, in one embodiment, can be "switched on" to provide a more-reliable long-term contact or connection. The actuated switch may be surface-actuated, automatically-actuated, or manually-actuated (e.g., the DRSRJ, or other device(s), can monitor the contacts). If one set of contacts begins to fail due to long-term wear, for example, another set of contacts can be "tripped" (activated) from the surface, from/near the DRSRJ, etc.

Although not illustrated, the electrical components are encased and/or isolated from other conductive features, such as the outer mandrel 410, inner mandrel 450, etc. Those skilled in the art understand the appropriate steps that need to be taken to electrically isolated the various features of the DRSRJ 400.

Figure 4Q:
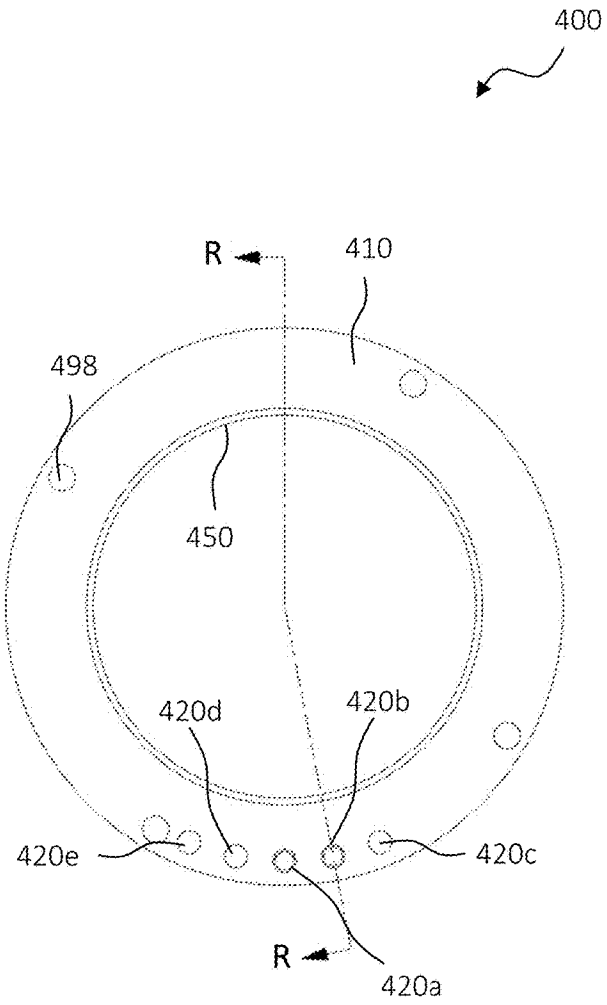

Turning to FIG. 4Q, illustrated is another cross-sectional view of the DRSRJ 400 illustrated in FIG. 4E. The cross-sectional view of the embodiment of FIG. 4Q is being used to help illustrate the complete second electrical path.

Figure 4R:
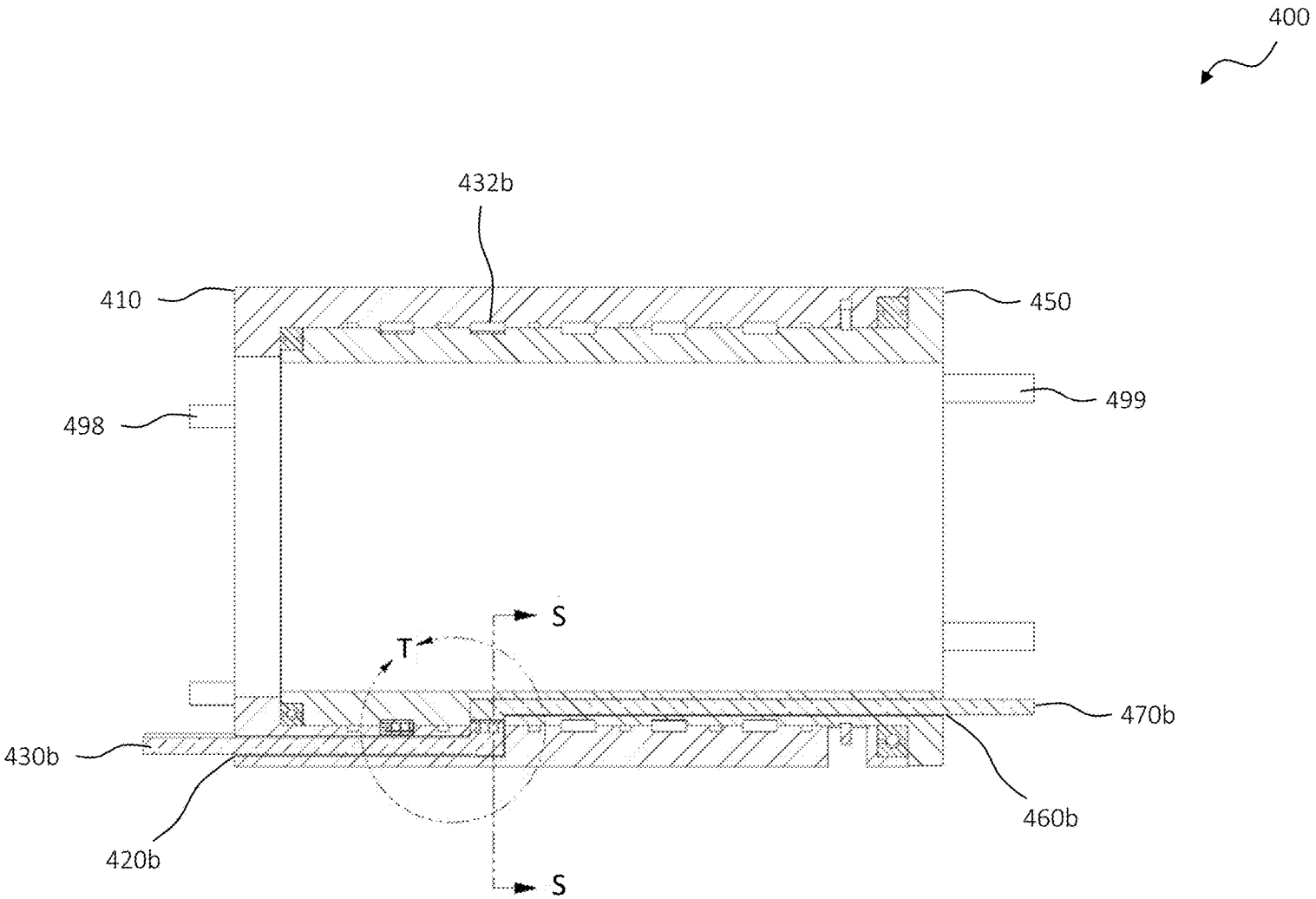

Turning to FIG. 4R, illustrated is a cross-sectional view of the DRSRJ 400 of FIG. 4Q, taken through the line R-R. As shown in FIG. 4R, the second outer mandrel electrical line 430*b* enters the outer mandrel 410 at the second outer mandrel communication connection 420*b*, and at the passageway 432*b*, couples to the second inner mandrel electrical line 470*b* via the second inner mandrel communications connection 460*b*. In at least one embodiment, the coupling between the second outer mandrel electrical line 430*b* and the second inner mandrel electrical line 470*b* is via a metal-to-metal sealed connector and control line (e.g., 0.635 cm stainless steel tubing with insulated electrical wire inside of it).

Figure 4T:
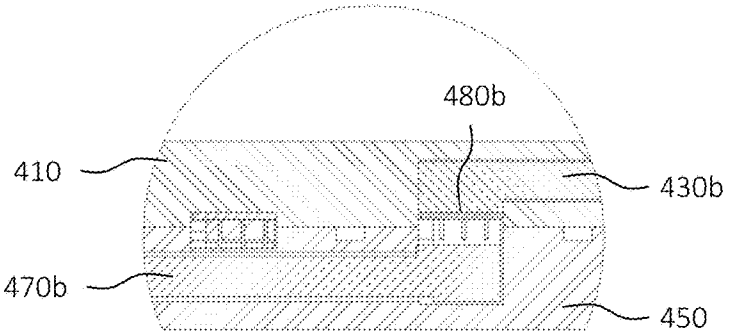
Figure 4V:
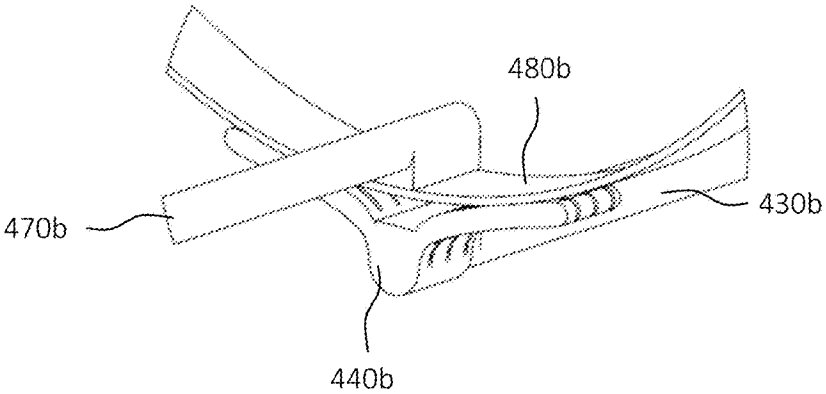
Figure 4S:
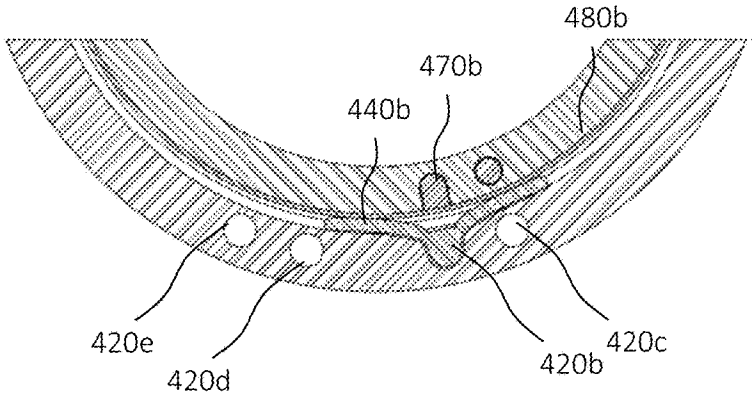

Turning to FIG. 4S, illustrated is a zoomed in cross-sectional view of a connection point between the second outer mandrel electrical line 430*b* and the second inner mandrel electrical line 470*b*, as taken through the line S-S in FIG. 4R. In the illustrated embodiment of FIG. 4S, the connection point includes a second contactor 440*b* rotationally coupled to the second outer mandrel electrical line 430*b*, and a second slip ring 480*b* rotationally coupled to the second inner mandrel electrical line 470*b*, the second contactor 440*b* and second slip ring 480*b* configured to rotate relative to one another at the same time they pass power and/or data signal between one another.

Turning to FIG. 4T, illustrated is an alternative zoomed in cross-sectional view of the connection point between the second outer mandrel electrical line 430*b* and the second inner mandrel electrical line 470*b*, as shown by the circle T in FIG. 4R.

Figure 4U:
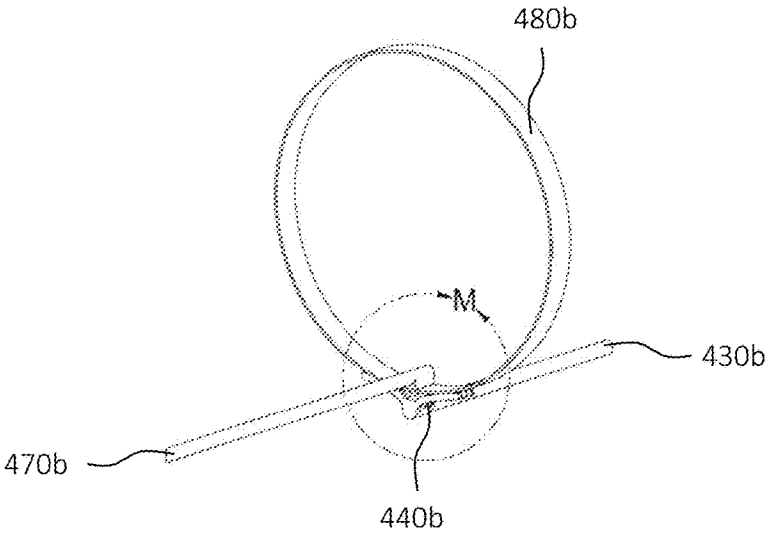

Turning to FIG. 4U, illustrated is a perspective view of one embodiment of how the second outer mandrel electrical line 430*b*, the second contactor 440*b*, the second slip ring 480*b* and the second inner mandrel electrical line 470*b* couple to one another. The coupling is very similar, but for axial location within the DRSRJ 400, to the coupling illustrated and discussed with regard to FIG. 4N.

Turning briefly to FIG. 4V, illustrated is a zoomed in perspective view of the coupling of FIG. 4U. The coupling is very similar, but for axial location within the DRSRJ 400, to the coupling illustrated and discussed with regard to FIG. 4O.

Figure 4W:
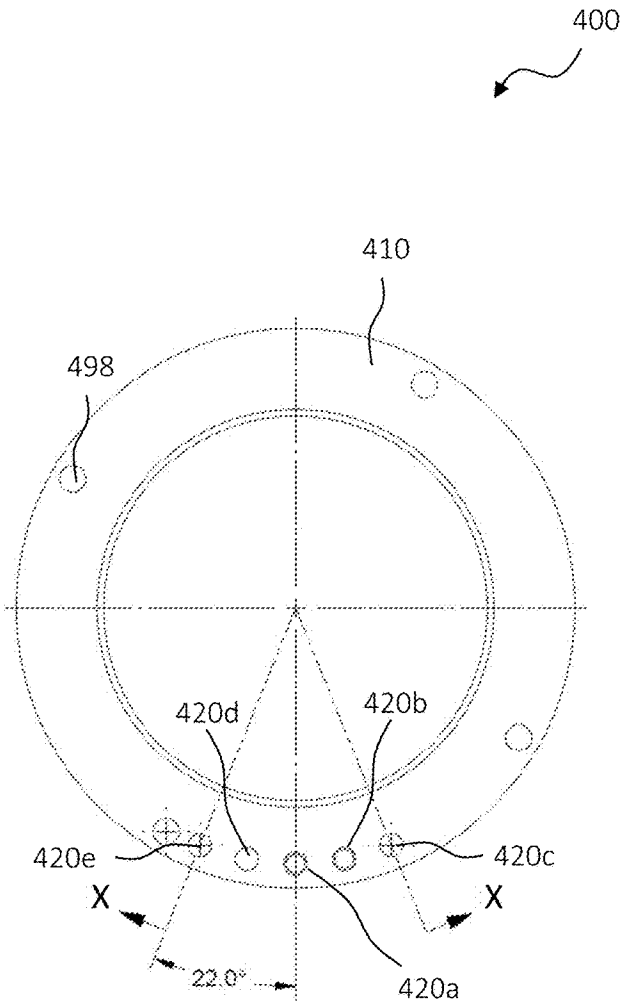

Turning to FIG. 4W, illustrated is another cross-sectional view of the DRSRJ 400 illustrated in FIG. 4E. The cross-sectional view of the embodiment of FIG. 4Q is being used to help illustrate the complete first hydraulic path.

Figure 4X:
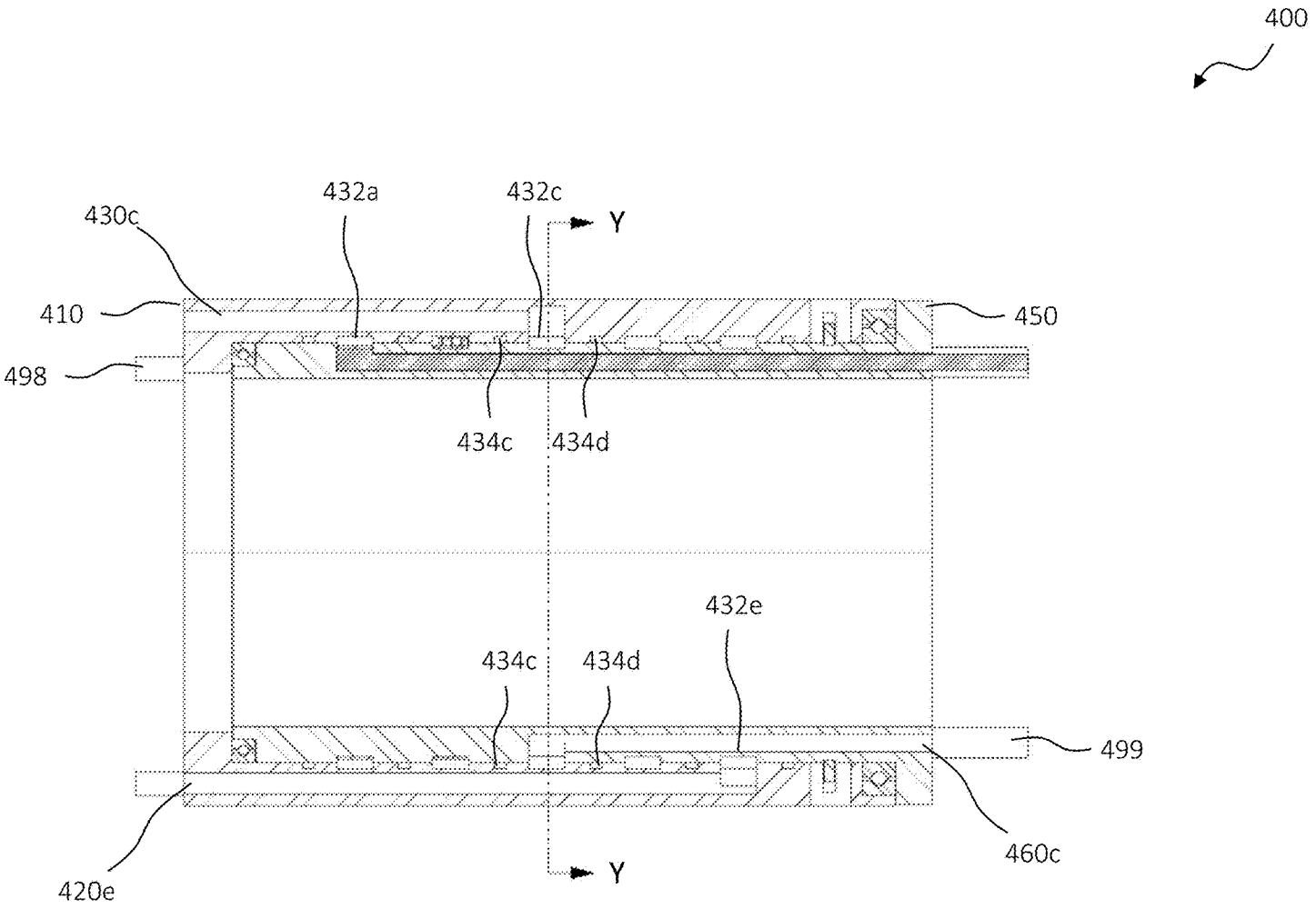

Turning to FIG. 4X, illustrated is a cross-sectional view of the DRSRJ 400 of FIG. 4W, taken through the line X-X. As shown in FIG. 4X, the third outer mandrel communication connection 420*c* couples with the third inner mandrel communications connection 460*c* at the third passageway 432*c*. In the illustrated embodiment, the third and fourth sealing elements 434*c*, 434*d* prevent hydraulic fluid from escaping the third passageway 432*c*. As shown, neither the fifth outer mandrel communication connections 420*e* and the associated fifth passageway 432*e*, nor the first inner mandrel communication connection 460*a* and the associated first passageway 432*a*, intersect and/or couple with the third outer/inner mandrel communications connections 420*c*, 460*c* or third passageway 432*c*. While not shown in the cross-section of FIG. 4X, the same applies for the first outer/inner mandrel communication connections 420*a*, 460*a*, the second outer/inner mandrel communication connections 420*b*, 460*b*, the fourth outer/inner mandrel communication connections 420*d*, 460*d* and the fourth passageway 432*d*. Accordingly, the third passageway 432*c*, and its associated outer/inner mandrel communication connections, are fluidically isolated from the fourth and fifth passageways 432*d*, 432*e*, and their associated outer/inner mandrel communication connections.

Figure 4Y:
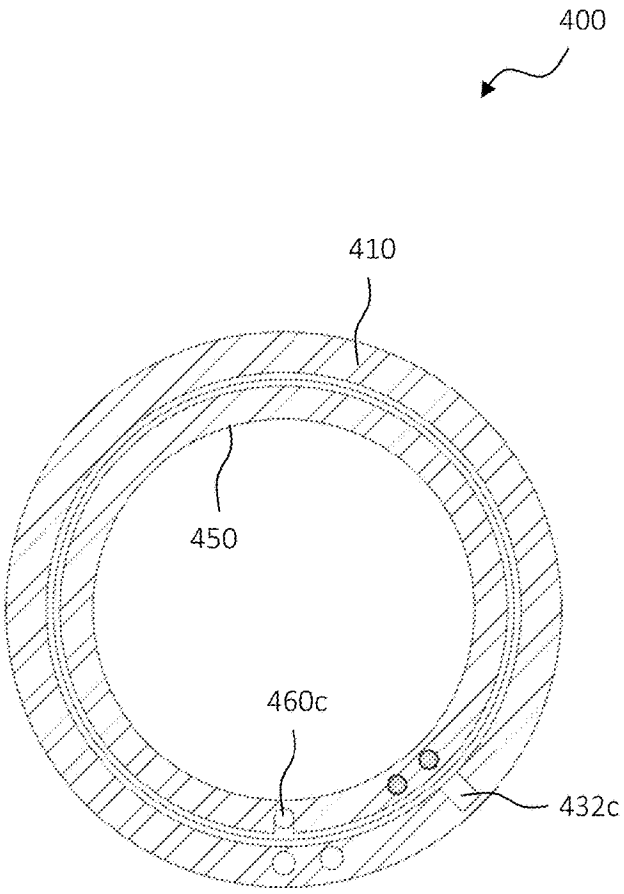

Turning to FIG. 4Y, illustrated is a cross-sectional view of the DRSRJ 400 of FIG. 4X, taken through the line Y-Y. FIG. 4Y better illustrates the fluidic coupling between the third outer mandrel communication connection 420*c* (not shown), the third passageway 432*c*, and the third inner mandrel communications connection 460*c*.

Figure 4Z:
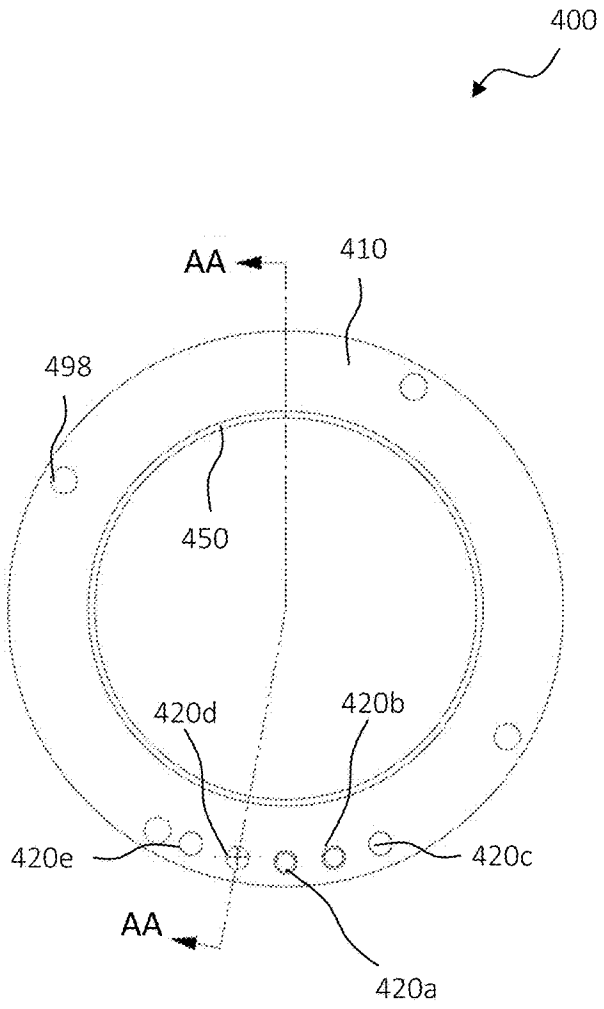
Figure 4A:
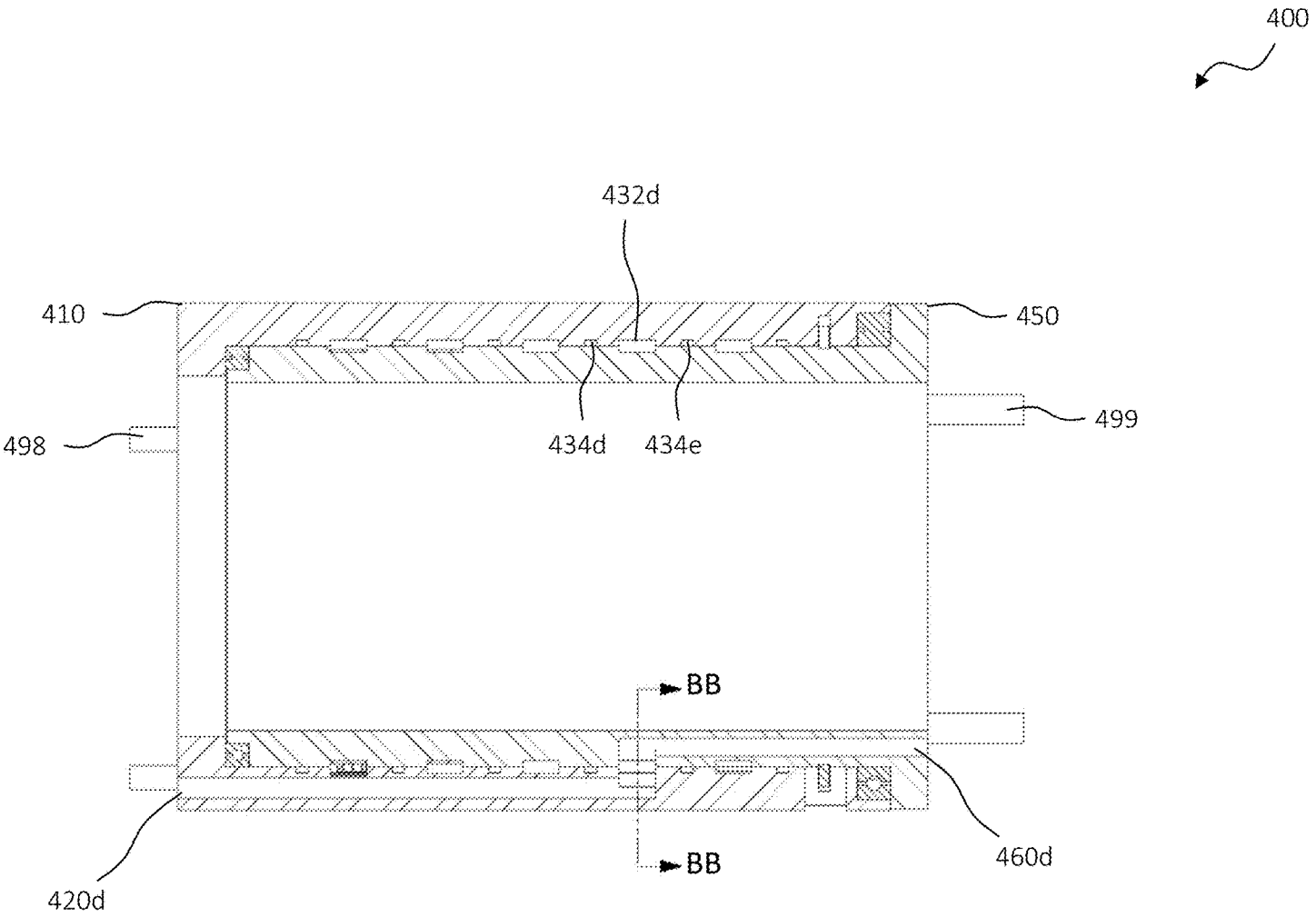
Figure 4B:
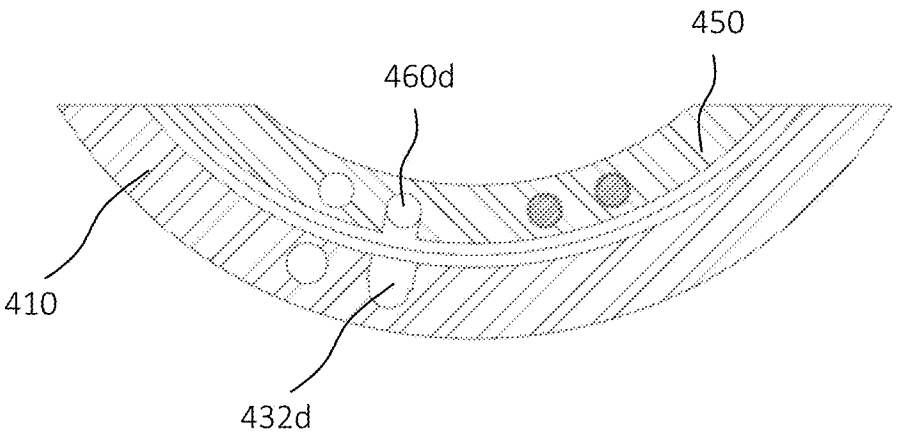
Figure 4C:
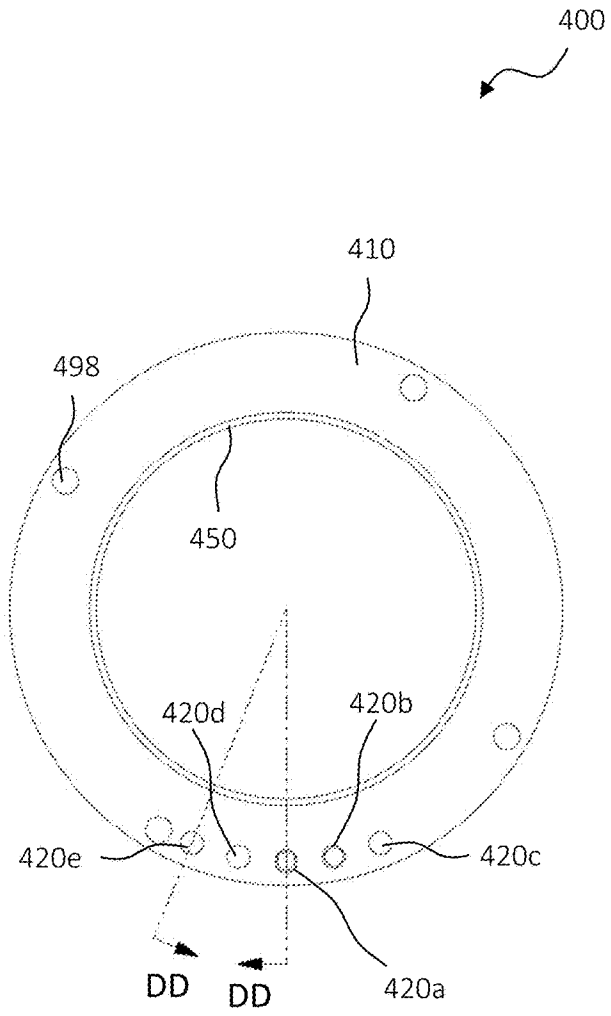
Figure 4D:
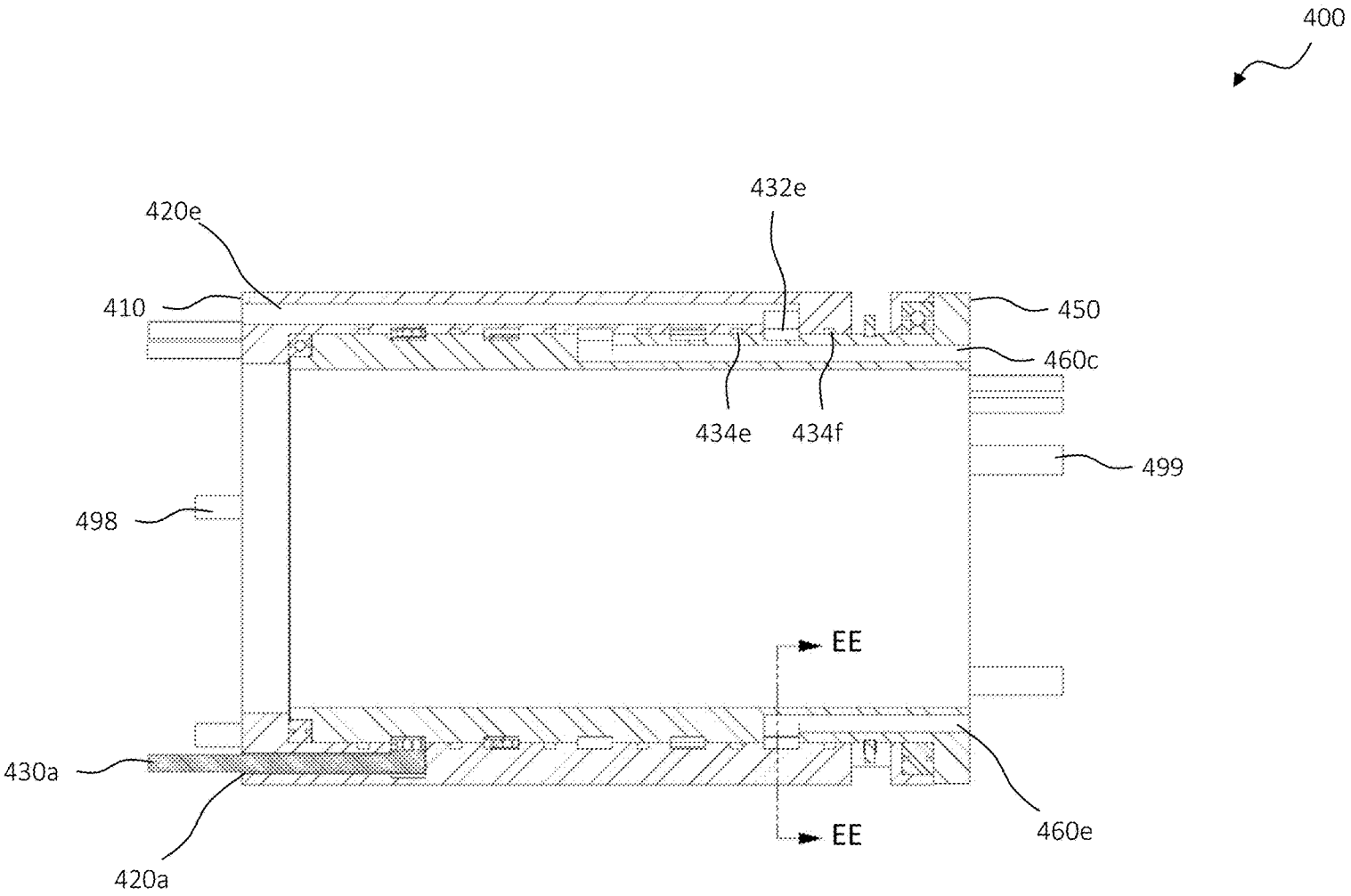
Figure 4E:
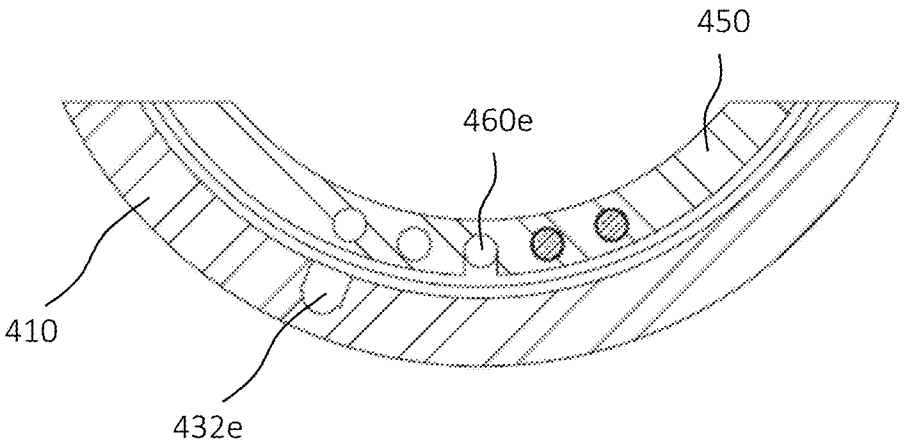

Turning to FIG. 4Z, illustrated is another cross-sectional view of the DRSRJ 400 illustrated in FIG. 4E. The cross-sectional view of the embodiment of FIG. 4Z is being used to help illustrate the complete second hydraulic path.

Turning to FIG. 4AA, illustrated is a cross-sectional view of the DRSRJ 400 of FIG. 4Z, taken through the line AA-AA. As shown in FIG. 4AA, the fourth outer mandrel communication connection 420*d* couples with the fourth inner mandrel communications connection 460*d* at the fourth passageway 432*d*. In the illustrated embodiment, the fourth and fifth sealing elements 434*d*, 434*e* prevent hydraulic fluid from escaping the fourth passageway 432*d*. While not shown in the cross-section of FIG. 4AA, the first outer/inner mandrel communication connections 420*a*, 460*a*, the second outer/inner mandrel communication connections 420*b*, 460*b*, the third outer/inner mandrel communication connections 420*c*, 460*c*, the associated third passageway 432*c*, the fifth outer/inner mandrel communication connections 420*e*, 460*e*, and the associated fifth passageway 432*e*, do not intersect and/or couple with the fourth outer/inner mandrel communications connections 420*d*, 460*d* or fourth passageway 432*d*. Accordingly, the fourth passageway 432*d*, and its associated outer/inner mandrel communication connections, are fluidically isolated from the fourth and fifth passageways 432*d*, 432*e*, and their associated outer/inner mandrel communication connections.

Turning to FIG. 4BB, illustrated is a zoomed in cross-sectional view of the DRSRJ 400 of FIG. 4AA, taken through the line AA-AA. FIG. 4BB better illustrates the fluidic coupling between the fourth outer mandrel communication connection 420*d* (not shown), the fourth passageway 432*d*, and the fourth inner mandrel communications connection 460*d*.

Turning to FIG. 4CC, illustrated is another cross-sectional view of the DRSRJ 400 illustrated in FIG. 4E. The cross-sectional view of the embodiment of FIG. 4CC is being used to help illustrate the complete third hydraulic path.

Turning to FIG. 4DD, illustrated is a cross-sectional view of the DRSRJ 400 of FIG. 4CC, taken through the line DD-DD. As shown in FIG. 4DD, the fifth outer mandrel communication connection 420*e* couples with the fifth inner mandrel communications connection 460*e* at the fifth passageway 432*e*. In the illustrated embodiment, the fifth and sixth sealing elements 434*e*, 434*f* prevent hydraulic fluid from escaping the fifth passageway 432*e*. While not entirely shown, the first outer/inner mandrel communication connections 420*a*, 460*a*, the second outer/inner mandrel communication connections 420*b*, 460*b*, the third outer/inner mandrel communication connections 420*c*, 460*c*, the associated third passageway 432*c*, the fourth outer/inner mandrel communication connections 420*d*, 460*d*, and the associated fourth passageway 432*d*, do not intersect and/or couple with the fifth outer/inner mandrel communications connections 420*e*, 460*e* or fifth passageway 432*e*. Accordingly, the fifth passageway 432*e*, and its associated outer/inner mandrel communication connections, are fluidically isolated from the third and fourth passageways 432*c*, 432*d*, and their associated outer/inner mandrel communication connections.

Turning to FIG. 4EE, illustrated is a zoomed in cross-sectional view of the DRSRJ 400 of FIG. 4DD, taken through the line EE-EE. FIG. 4EE better illustrates the fluidic coupling between the fifth outer mandrel communication connection 420*e* (not shown), the fifth passageway 432*e*, and the fifth inner mandrel communications connection 460*e*.

The DRSRJ 400 illustrated in FIGS. 4A through 4EE has certain specific features to the embodiment shown. A DRSRJ, such as the DRSRJ 400, may include many different features and remain within the scope of the disclosure. For example, in at least one embodiment, the DRSRJ may include redundant electrical lines, contactors, slips rings, etc. For example, if the DRSRJ has only one slip ring, two or more input (upper) lines may be placed in contact with the slip ring to provide redundancy. In the event that one contactor and/or electrical input line is damaged, the second (redundant) contactor/electrical input can provide power. Likewise, a two or more output (upper) lines and/or conductors may be utilized. In another embodiment, rather than a single power source and single signal source, the DRSRJ could include a first power source and a redundant power source, or alternatively a first signal source and a redundant signal source. Moreover, although only two electrical paths are shown, more additional paths may be added to provide more independent electrical paths, backup paths, or a combination thereof.

Moreover, while the DRSRJ 400 has been illustrated and described as having both electrical and hydraulic communication, an electric only or hydraulic only DRSRJ may be designed/utilized by the teachings of this disclosure. Likewise, in some scenarios, it may be preferable to have an electric only DRSRJ and a hydraulic only DRSRJ run in series. In other scenarios, one DRSRJ may comprise an electric only DRSRJ, that is run in series with a hydraulic only DRSRJ and fiberoptic only DRSRJ. One advantage of these scenarios is that each DRSRJ may be filled with a different material (fluid, lubricant, etc.). For example, the electric only DRSRJ could be filled with a dielectric fluid (e.g., an electrically non-conductive liquid that has a very high resistance to electrical breakdown, even at high voltages. Electrical components are often submerged or sprayed with the fluid to remove excess heat) whereas the fiberoptic only DRSRJ may be filled with glycerol or other liquid with a suitable refractive index.

Turning to FIG. 5, illustrated is an illustration of an IsoRite® sleeve 500, as might employ a DRSRJ according to the present disclosure.

Figure 7A:
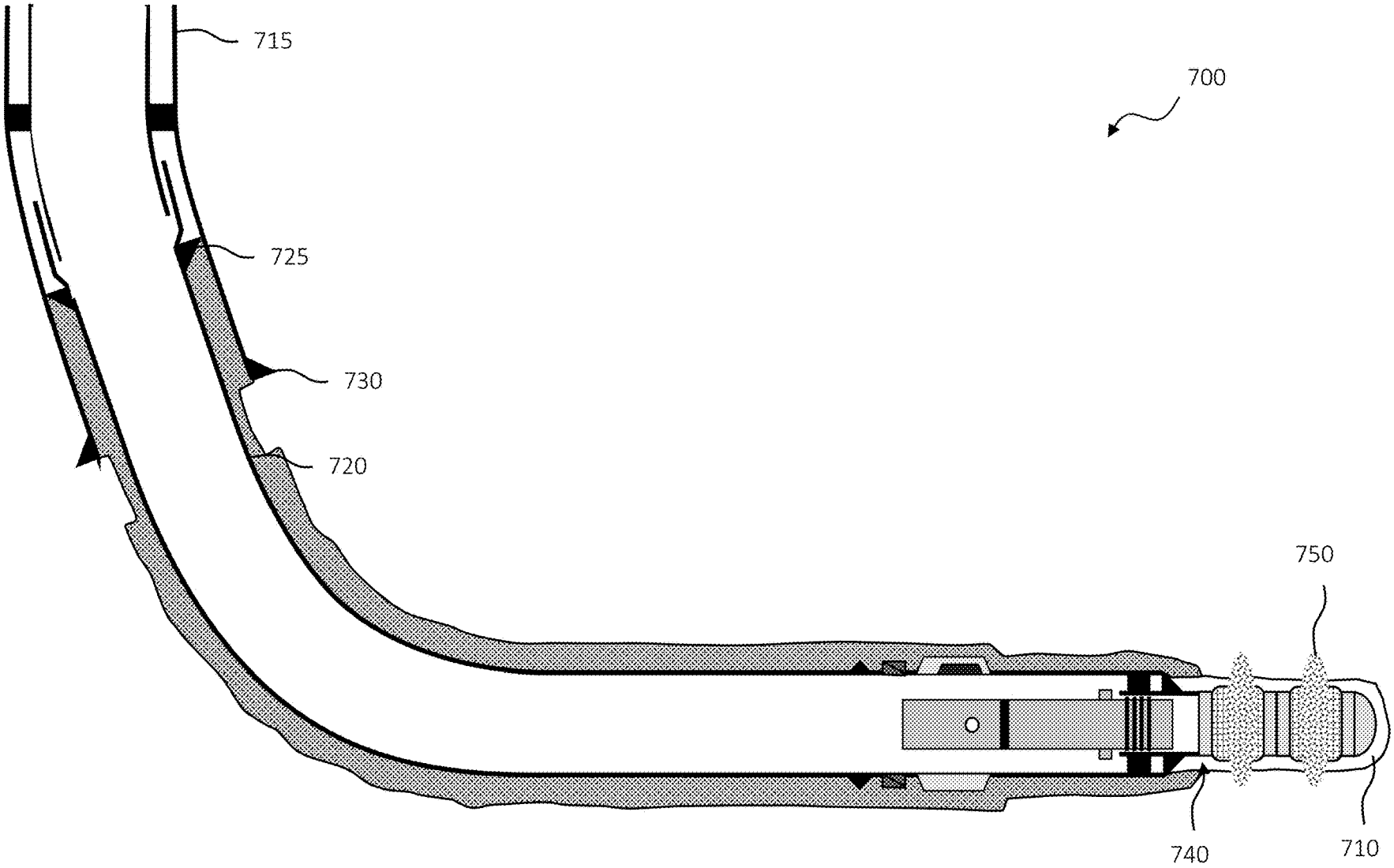

Turning to FIG. 6, illustrated is a depiction of a FloRite® system 600, as might employ a DRSRJ according to the present disclosure, and be located within a main wellbore 680 having main wellbore production tubing 685 (e.g., main bore tubing with short seal assembly) and a lateral wellbore 690 having lateral wellbore production tubing 695 (e.g., lateral bore tubing with long seal assembly). The FloRite® system 600, in at least one embodiment, includes a vector block 610 (e.g., a y-block), a lateral bore tubing swivel 620 (e.g., DRSRJ in one embodiment), a dual bore deflector 630, a latch coupling 640, a permanent single bore packer 650 and a landing nipple 655 located within the main wellbore 680. The FloRite® system 600, in at least one embodiment, further includes a retrievable single bore packer 660, a lateral lower seal bore extension 665, a lateral bore landing nipple 670, and a wireline re-entry guide 675 located in the lateral wellbore 690. In at least one embodiment, a retrievable single-bore packer (not shown) is located uphole of the vector block 610. production tubing 610, having Turning now to FIGS. 7A through 20B, illustrated is a method for forming, accessing, potentially fracturing, and producing from a well system 700. FIG. 7A is a schematic of the well system 700 at the initial stages of formation. A main wellbore 710 has been drilled, for example by a rotary steerable system at the end of a drill string and may extend from a well origin (not shown), such as the earth's surface or a sea bottom. The main wellbore 710 may be lined by one or more casings 715, 720, each of which may be terminated by a shoe 725, 730, respectively. The main wellbore 710, having been formed, may be stimulated (fractured, acidized, etc.) at this point or at later time.

The well system 700 of FIG. 7A additionally includes a main wellbore completion 740 positioned in the main wellbore 710. The main wellbore completion 740 may, in certain embodiments, include a main wellbore liner (e.g., with frac sleeves in one embodiment), as well as one or more packers (e.g., swell packers in one embodiment). The main wellbore liner and the one or more packer may, in certain embodiments, be run on an anchor system. The anchor system, in one embodiment, may include a collet profile for engaging with the running tool, as well as a muleshoe (e.g., slotted alignment muleshoe). Further to the embodiment of FIG.

7A, fractures 750 may be formed in the main wellbore 710. Those skilled in the art understand the process of forming the fractures 750.

Figure 7B:
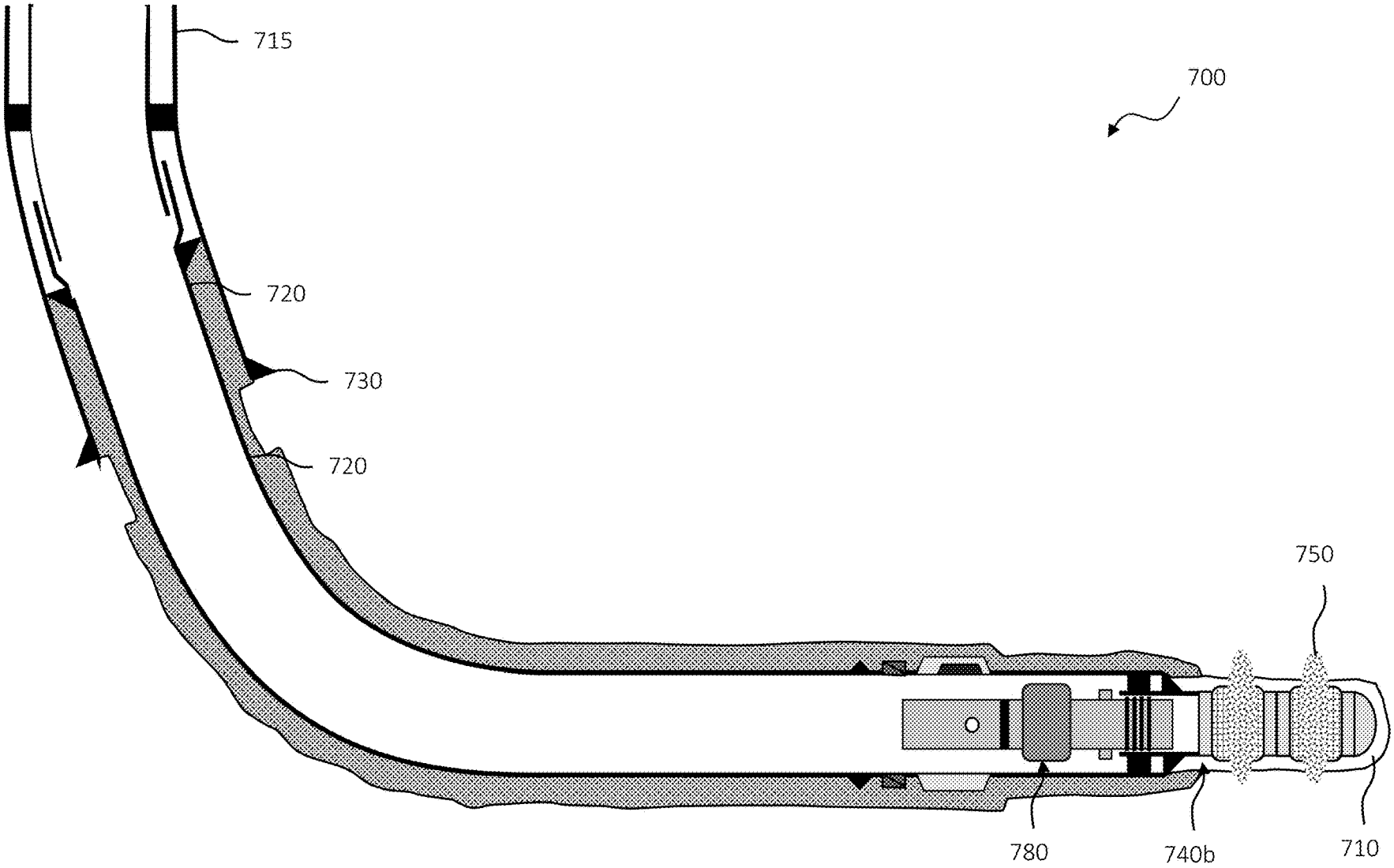

Turning briefly to the well system 700 of FIG. 7B, illustrated is an alternative embodiment of the main wellbore completion 740*b*. In at least one embodiment, a DRSRJ 780 may be employed in the main wellbore completion 740*b*. In at least one embodiment, the control lines from DRSRJ 780, in particular uphole connection (e.g., uphole connection 315 in FIG. 3B), may connect to Halliburton's Fuzion™-EH Electro-Hydraulic Downhole Wet-Mate Connector, Fuzion™-E Electric Downhole Wet-Mate Connector, Fuzion™-H Hydraulic Downhole Wet-Mate Connector, and/or Fuzion™-L Electro-Hydraulic/Electric Downhole Wet-Mate Connector. In at least one embodiment, the control lines from DRSRJ 780, in particular uphole connection (e.g., uphole connection 315 in FIG. 3B), may connect to a Fiber Optic Wet-Mate, an Inductive Coupler Wet-Mate, an Energy Transfer Mechanism (ETM), a Wireless Energy Transfer Mechanism (WETM, a Schlumberger Inductive Coupler, and/or control line, etc.).

In at least one embodiment, the control lines from DRSRJ 780, in particular downhole connection (e.g., downhole connection 345 in FIG. 3B), may connect to a control line, a Fiber Optic Wet-Mate, an Inductive Coupler Wet-Mate, an Energy Transfer Mechanism (ETM), a Wireless Energy Transfer Mechanism (WETM, and/or a Schlumberger Inductive Coupler, etc.).

In at least one embodiment, the control lines from DRSRJ 780, in particular downhole connection (e.g., downhole connection 345 in FIG. 3B), may ultimately be connected to one or more sensors, recorders, actuators, choking mechanism, flow restrictor, pressure-drop device, venturi tube containing device, etc. In at least one embodiment, the control lines from DRSRJ 780, in particular downhole connection (e.g., downhole connection 345 in FIG. 3B), may connect to a control line, a production and/or reservoir management system with in-situ measurements of pressure, temperature, flow rate, and water cut across the formation face in each zone of each lateral. Sensors may be packaged in one station with an electric flow control valve (FCV) that has variable settings controlled from surface through one or more electrical, fiber optic, hydraulic control lines. Multiple stations may be used to maximize hydrocarbon sweep and recovery with fewer wells, reducing capex, opex, and surface footprint.

Figure 8:
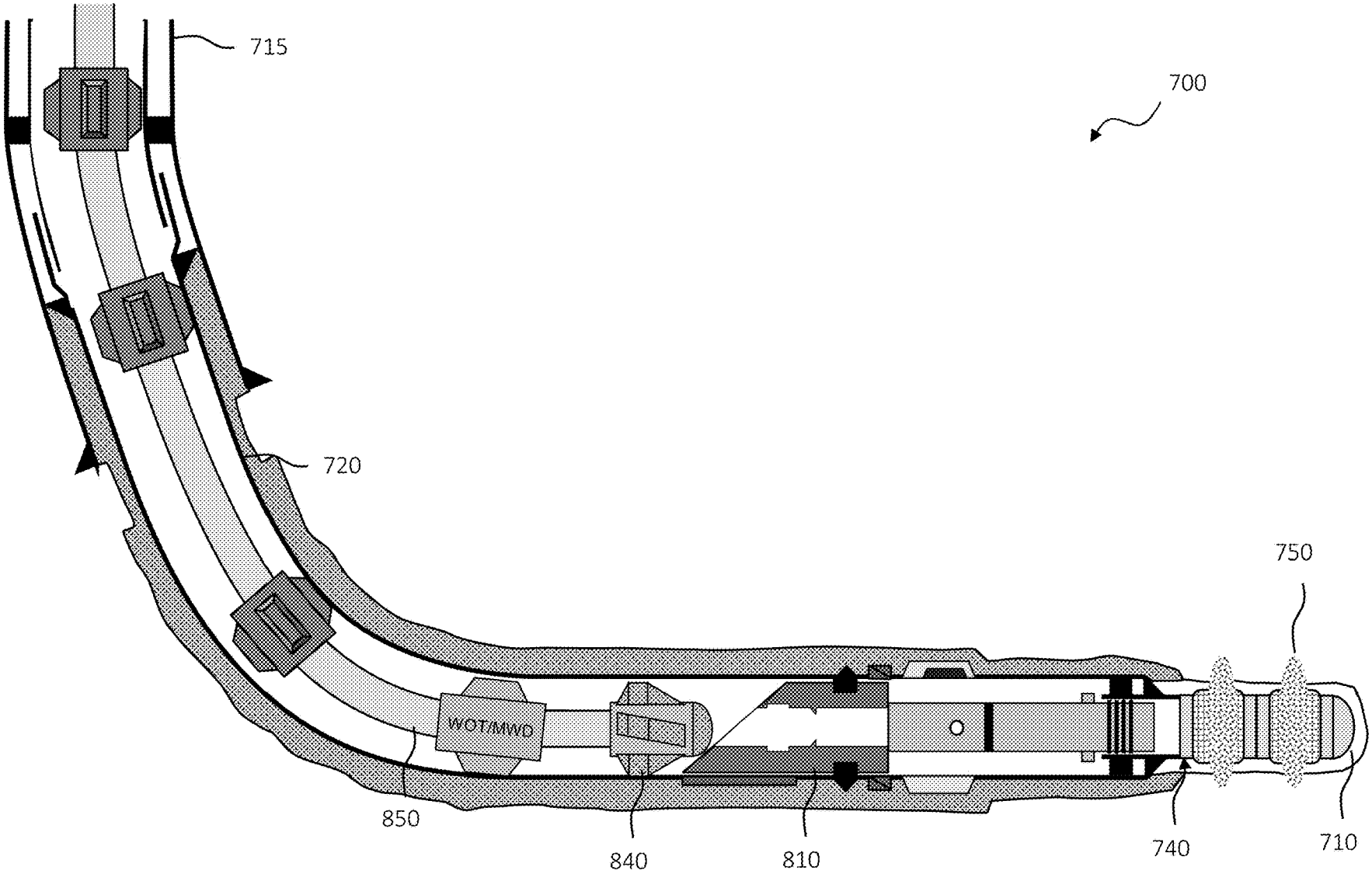

Turning to FIG. 8, illustrated is the well system 700 of FIG. 7A after positioning a whipstock assembly 810 downhole at a location where a lateral wellbore is to be formed. The whipstock assembly 810 may include a collet for engaging a collet profile in an anchor system of the main wellbore completion 740. The whipstock assembly 810 may additionally include one or more seals (e.g., a wiper set in one embodiment) to seal the whipstock assembly 810 with the main wellbore completion 740. In certain embodiments, such as that shown in FIG. 8, the whipstock assembly 810 is made up with a lead mill 840, for example using a shear bolt, and then run in hole on a drill string 850. A Workstring Orientation Tool (WOT) or Measurement While Drilling (MWD) tool may be employed to orient the whipstock assembly 810.

Figure 9:
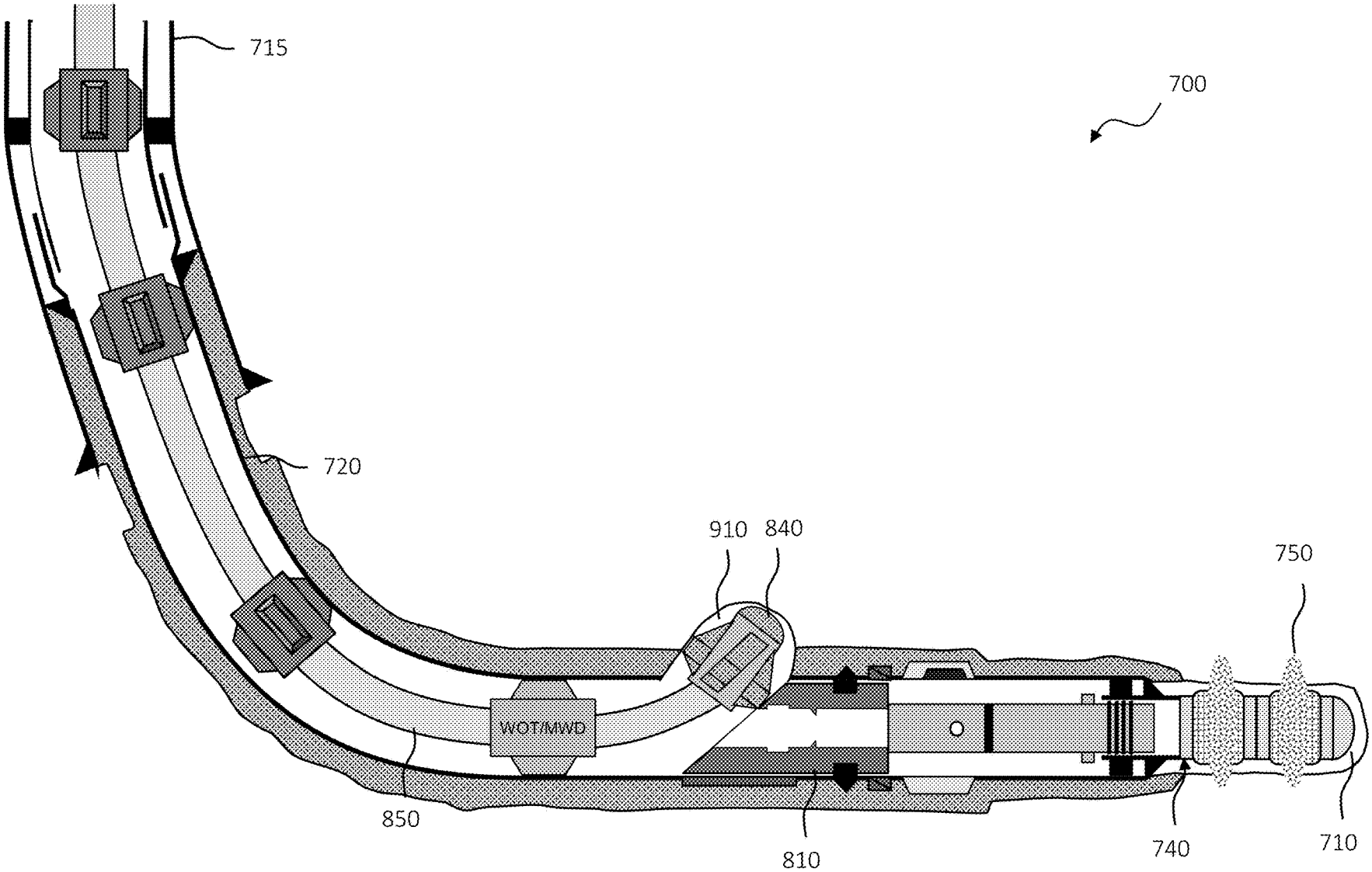

Turning to FIG. 9, illustrated is the well system 700 of FIG. 8 after setting down weight to shear the shear bolt between the lead mill 840 and the whipstock assembly 810, and then milling an initial window pocket 910. In certain embodiments, the initial window pocket 910 is between 1.5 m and 7.0 m long, and in certain other embodiments about 2.5 m long, and extends through the casing 720. Thereafter, a circulate and clean process could occur, and then the drill string 850 and lead mill 840 may be pulled out of hole.

Figure 10:
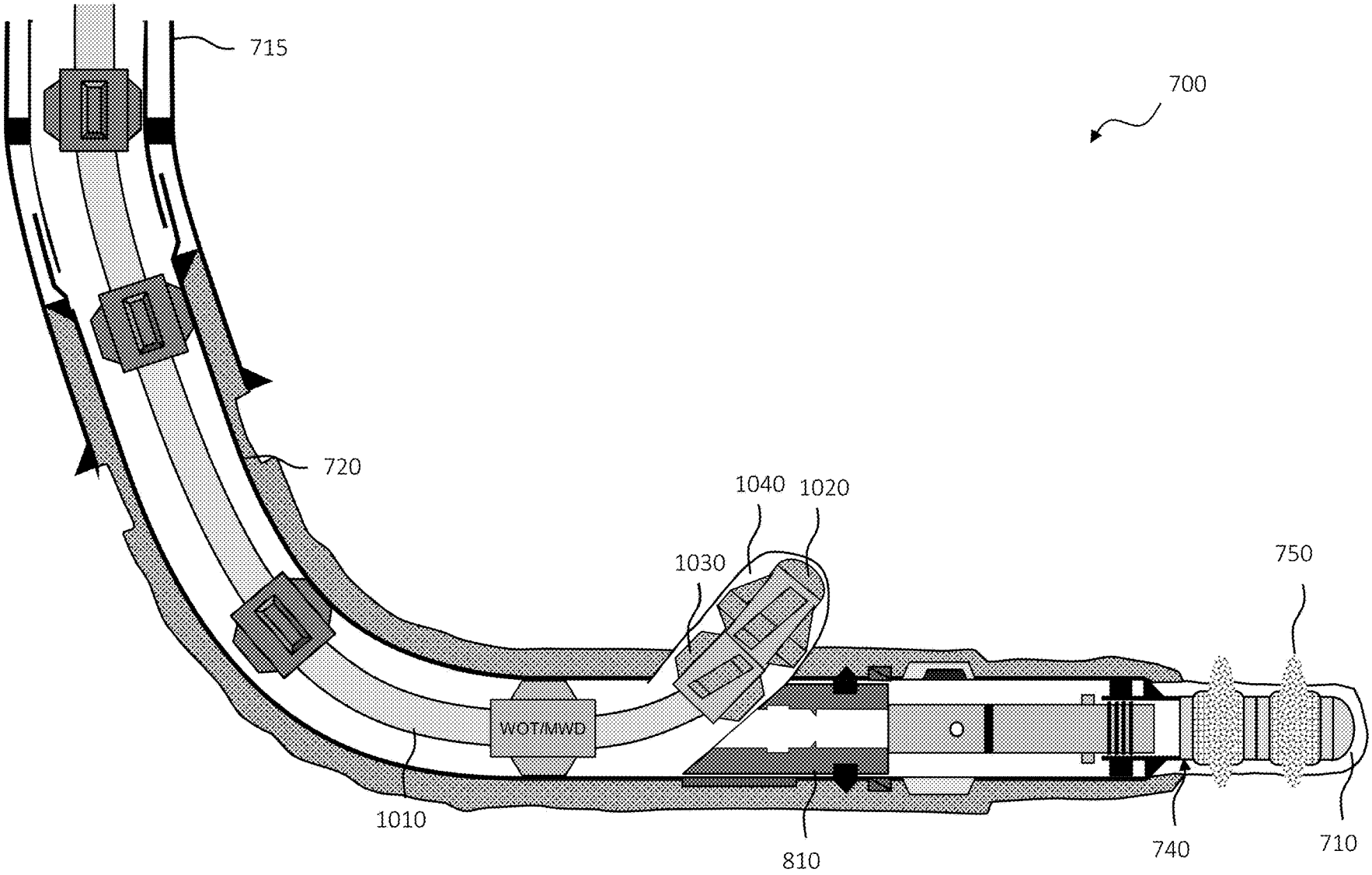

Turning to FIG. 10, illustrated is the well system 700 of FIG. 9 after running a lead mill 1020 and watermelon mill 1030 downhole on a drill string 1010. In the embodiments shown in FIG. 10, the drill string 1010, lead mill 1020 and watermelon mill 1030 drill a full window pocket 1040 in the formation. In certain embodiments, the full window pocket 1040 is between 5 m and 10 m long, and in certain other embodiments about 8.5 m long. Thereafter, a circulate and clean process could occur, and then the drill string 1010, lead mill 1020 and watermelon mill 1030 may be pulled out of hole.

Figure 11:
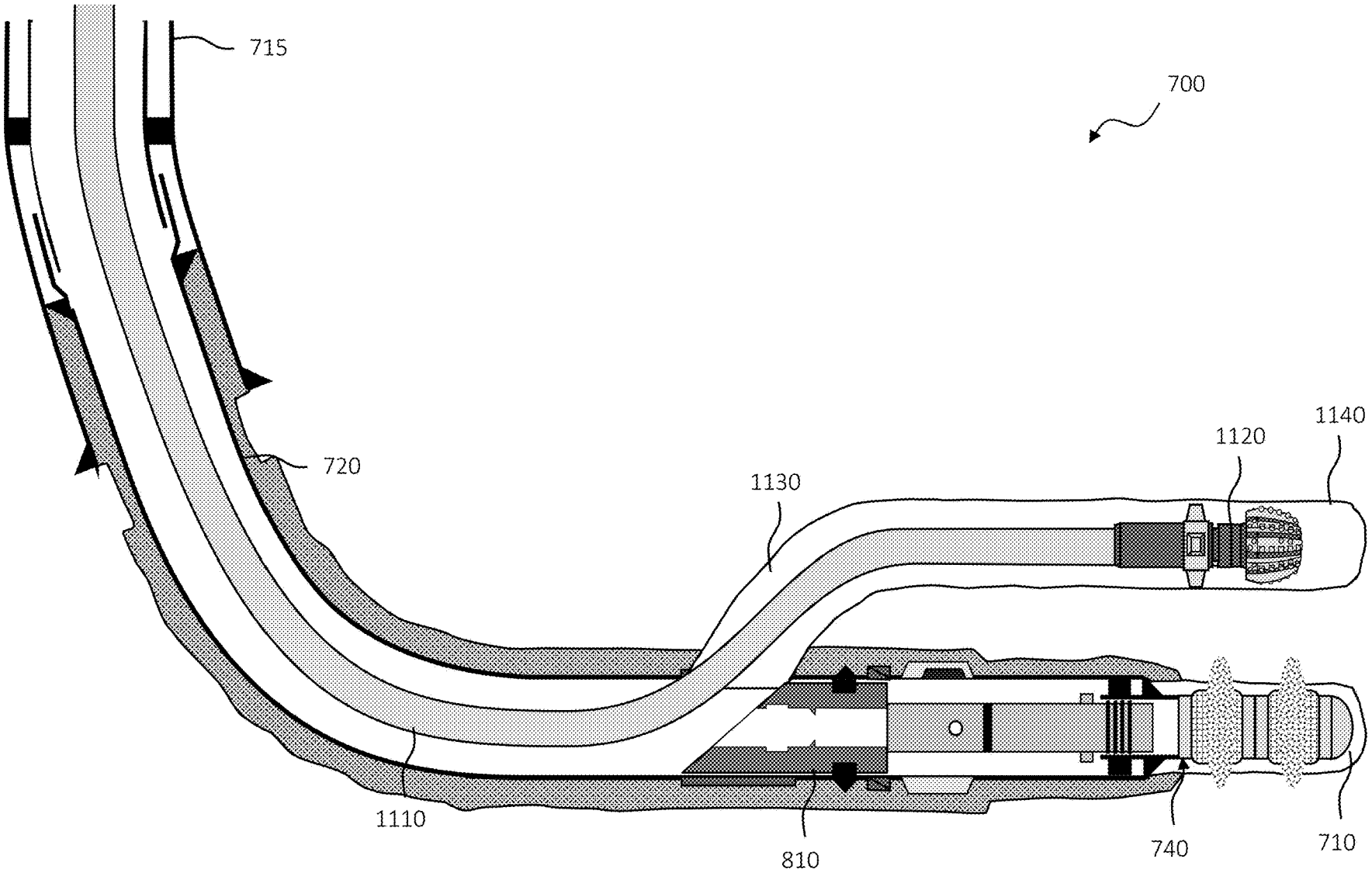

Turning to FIG. 11, illustrated is the well system 700 of FIG. 10 after running in hole a drill string 1110 with a rotary steerable assembly 1120, drilling a tangent 1130 following an inclination of the whipstock assembly 810, and then continuing to drill the lateral wellbore 1140 to depth. Thereafter, the drill string 1110 and rotary steerable assembly 1120 may be pulled out of hole. The lateral wellbore 1140 may be stimulated (fractured, acidized, etc.) at this point or at later time.

Figure 12A:
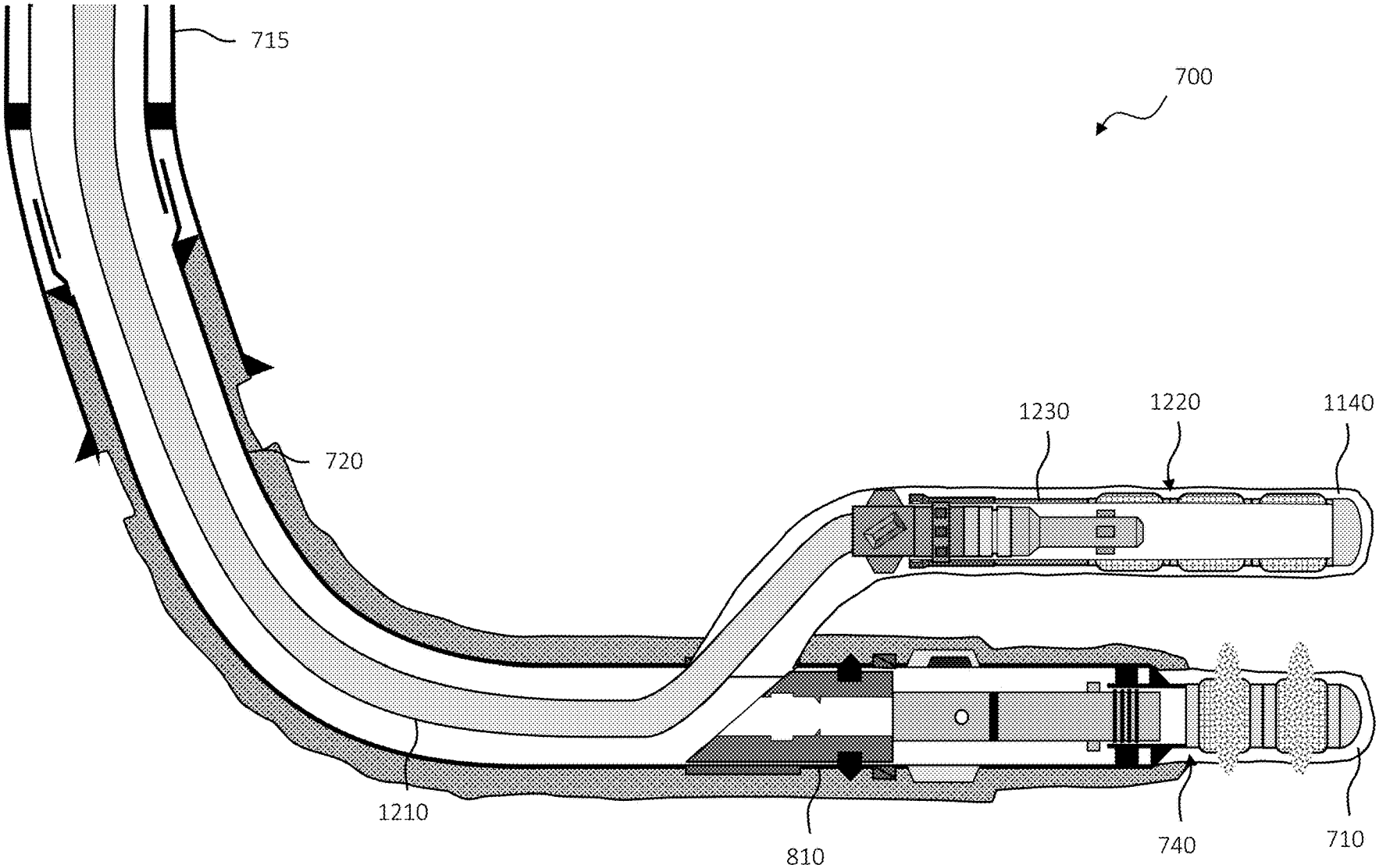

Turning to FIG. 12A, illustrated is the well system 700 of FIG. 11 after employing an inner string 1210 to position a lateral wellbore completion 1220 in the lateral wellbore 1140. The lateral wellbore completion 1220 may, in certain embodiments, include a lateral wellbore liner 1230 (e.g., with frac sleeves in one embodiment), as well as one or more packers (e.g., swell packers in one embodiment). In at least one embodiment, a DRSRJ may be employed in the lateral wellbore completion 1220. The DRSRJ in the lateral wellbore completion 1220 could also send data/commands from the lateral wellbore completion 1220 to the inner string 1210 and then to a Workstring Orientation Tool (WOT), wired drillpipe, acoustic telemetry system, fiber-optic and/or electric conduits run in conjunction with the inner string 1210. In at least one embodiment, a DRSRJ may be employed in the inner string 1210. In at least one embodiment, a DRSRJ may be employed in the running tool for 1220 which is connected to inner string 1210. When the DRSRJ is employed in the running tool, it may allow data to be relayed from the lateral wellbore completion 1220 to a Mud Pulser (the pulser commonly used with MWD tools to transmit pressure pulsed from downhole to the surface and vice-versa). Additionally, when the DRSRJ is employed in the running tool, it could also send data/commands from the lateral wellbore completion 1220 to the inner string 1210 and then to a Workstring Orientation Tool (WOT), wired drillpipe, acoustic telemetry system, fiber-optic and/or electric conduits run in conjunction with the inner string 1210. Thereafter, the inner string 1210 may be pulled into the main wellbore 710 for retrieval of the whipstock assembly 810.

Figure 12B:
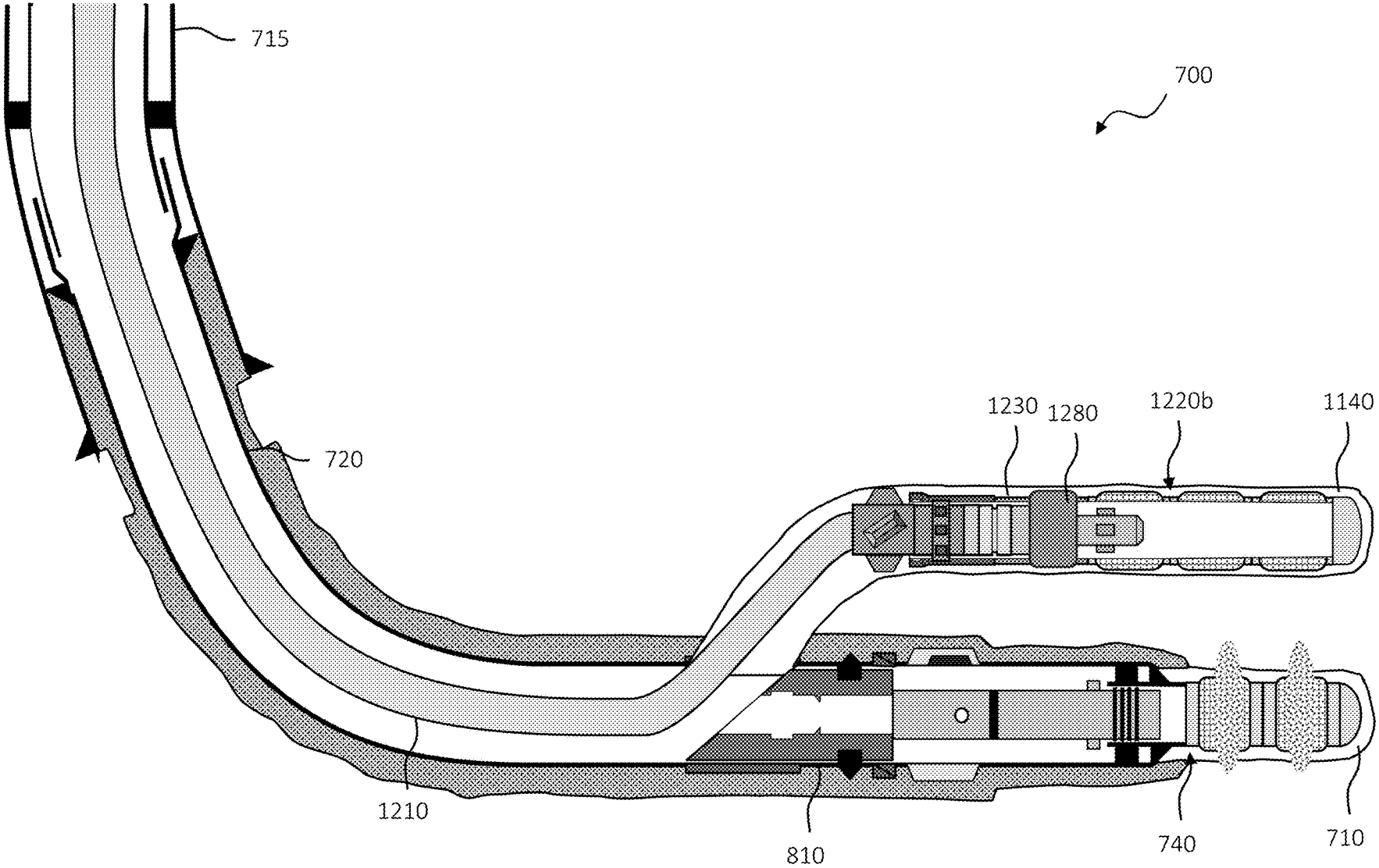

Turning briefly to the well system 700 of FIG. 12B, illustrated is an alternative embodiment of the lateral wellbore completion 1220*b*. In at least one embodiment, a DRSRJ 1280 may be employed in the lateral wellbore completion 1220*b*. In at least one embodiment, the control lines from DRSRJ 1280, in particular uphole connection (e.g., uphole connection 315 in FIG. 3B), may connect to Halliburton's Fuzion™-EH Electro-Hydraulic Downhole Wet-Mate Connector, Fuzion™-E Electric Downhole Wet-Mate Connector, Fuzion™-H Hydraulic Downhole Wet-Mate Connector, and/or Fuzion™-L Electro-Hydraulic/Electric Downhole Wet-Mate Connector. In at least one embodiment, the control lines from DRSRJ 1280, in particular uphole connection (e.g., uphole connection 315 in FIG. 3B), may connect to a Fiber Optic Wet-Mate, an Inductive Coupler Wet-Mate, an Energy Transfer Mechanism (ETM), a Wireless Energy Transfer Mechanism (WETM, a Schlumberger Inductive Coupler, and/or control line, etc.).

In at least one embodiment, the control lines from DRSRJ 1280, in particular downhole connection (e.g., downhole connection 345 in FIG. 3B), may connect to a control line, a Fiber Optic Wet-Mate, an Inductive Coupler Wet-Mate, an Energy Transfer Mechanism (ETM), a Wireless Energy Transfer Mechanism (WETM, and/or a Schlumberger Inductive Coupler, etc.). In at least one embodiment, the control lines from DRSRJ 1280, in particular downhole connection (e.g., downhole connection 345 in FIG. 3B), may ultimately be connected to one or more sensors, recorders, actuators, choking mechanism, flow restrictor, pressure-drop device, venturi tube containing device, etc. In at least one embodiment, the control lines from DRSRJ 1280, in particular downhole connection (e.g., downhole connection 345 in FIG. 3B), may connect to a control line, a production and/or reservoir management system with in-situ measurements of pressure, temperature, flow rate, and water cut across the formation face in each zone of each lateral. Sensors may be packaged in one station with an electric flow control valve (FCV) that has infinitely variable settings controlled from surface through one or more electrical, fiber optic, hydraulic control lines. Multiple stations may be used to maximize hydrocarbon sweep and recovery with fewer wells, reducing capex, opex, and surface footprint.

Figure 13A:
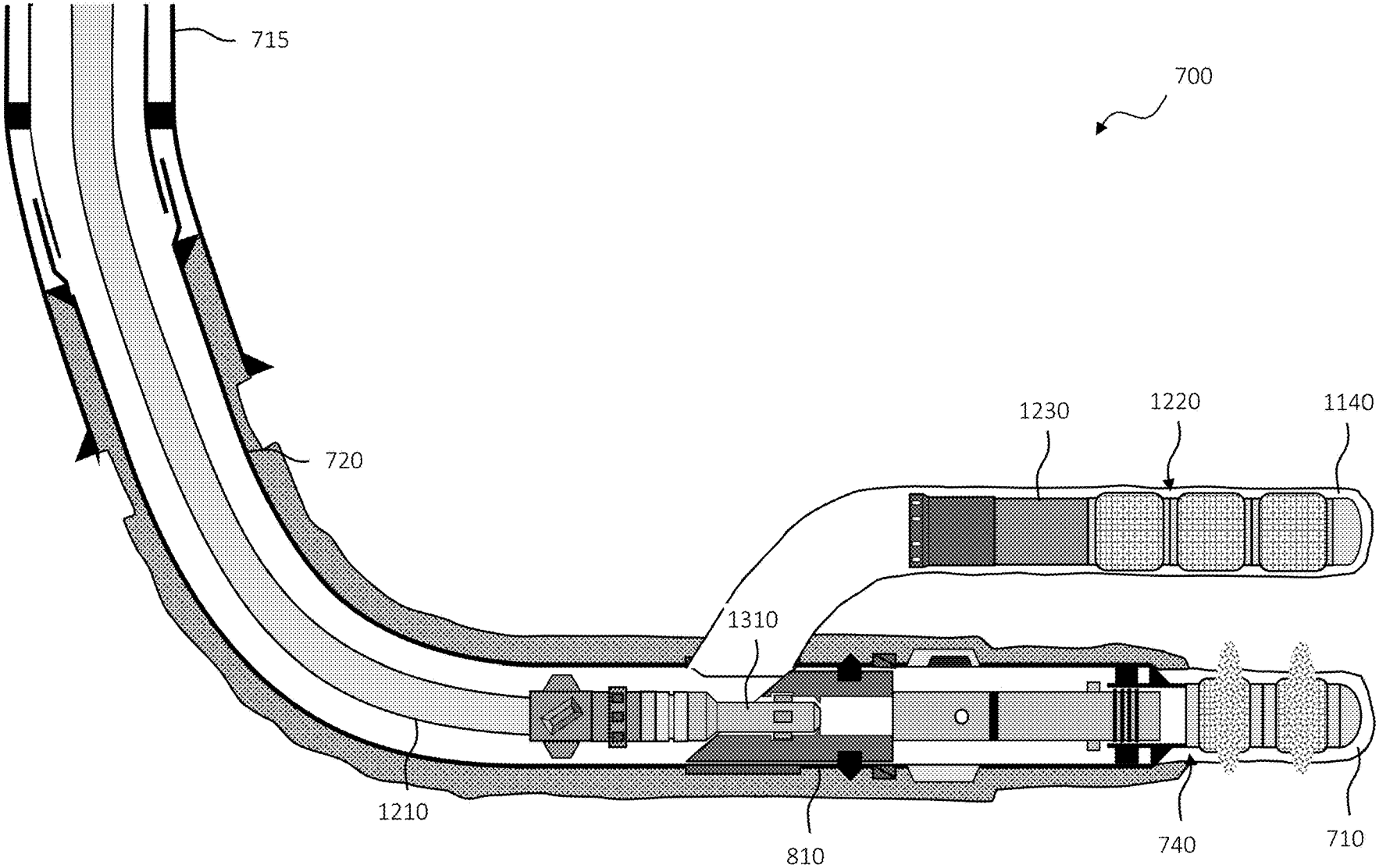
Figure 13B:
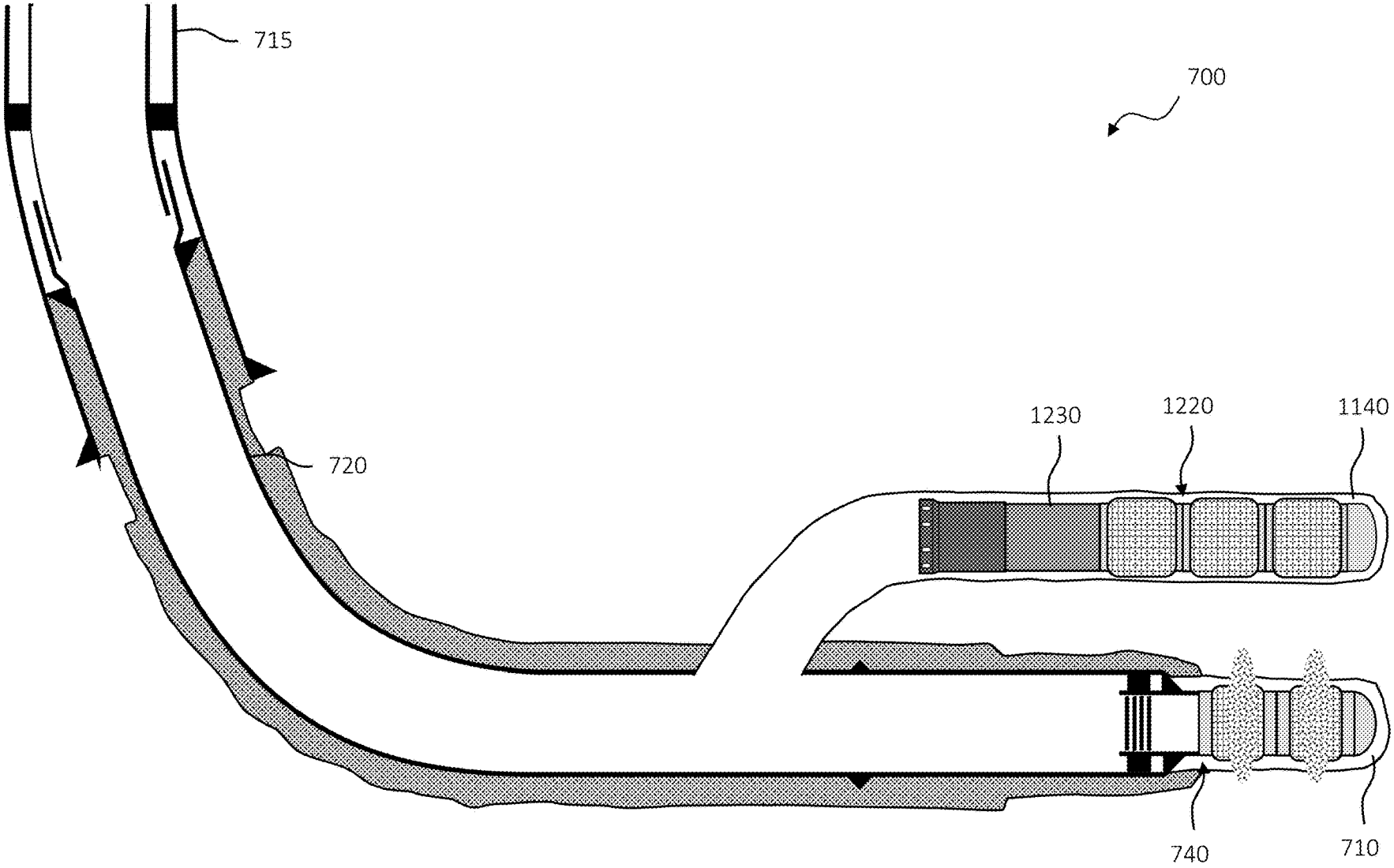

Turning to FIG. 13A, illustrated is the well system 700 of FIG. 12A after latching a whipstock retrieval tool 1310 of the inner string 1210 with a profile in the whipstock assembly 810. The whipstock assembly 810 may then be pulled free from the anchor system, and then pulled out of hole. What results are the main wellbore completion 740 in the main wellbore 710, and the lateral wellbore completion 1220 in the lateral wellbore 1140, as shown in FIG. 13B. Although not shown, the main wellbore completion 740 in the main wellbore 710 may comprise one or more DRSRJ's 780. Likewise, the lateral wellbore completion 1220 in the lateral wellbore 1140 may comprise one or more DRSRJ's 1280. It is understood that there may be multiple wellbores 1140 comprising one or more lateral wellbore completion 1220 and the lateral wellbore completions 1220 may comprise one or more DRSRJ's 1280. In addition, in some embodiments, it may be advantageous to have more than one main wellbore completion (e.g., lower completion, middle completion, upper completion) with some features the may or may not be similar to the main wellbore completion 740. However, these other main wellbore completions 740 may benefit from one or more DRSRJ's 780, 1280. For example, the upper completion may/will require control lines (electrical, fiber, hydraulic) to transmit data and power to/from the one or more lower completions (main bore and/or lateral).

Figure 14A:
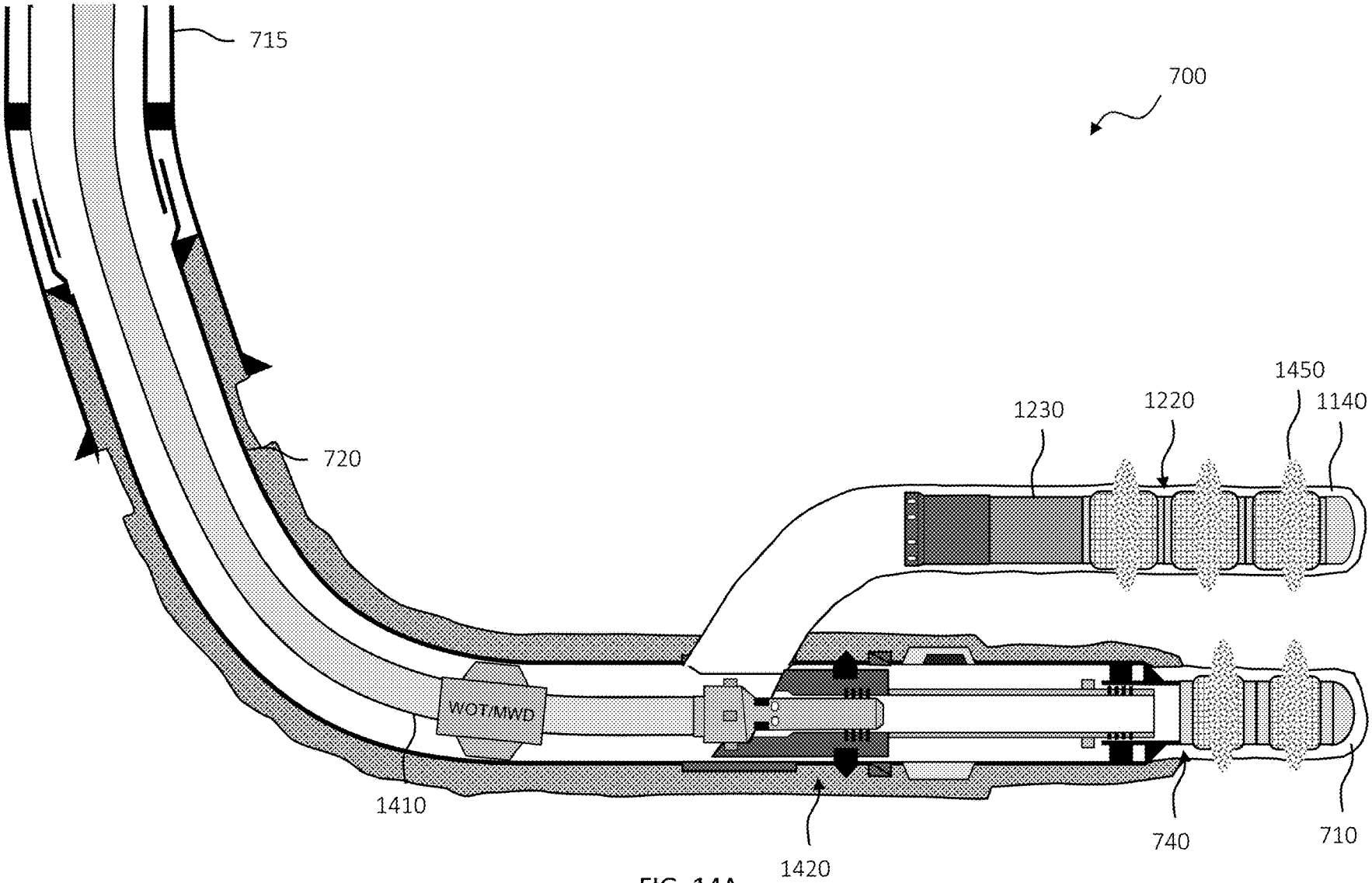

Turning to FIG. 14A, illustrated is the well system 700 of FIG. 13A after employing a running tool 1410 to install a deflector assembly 1420 proximate a junction between the main wellbore 710 and the lateral wellbore 1140. In at least one embodiment, the deflector assembly 1420 is a FlexRite® deflector assembly. The deflector assembly 1420 may be appropriately oriented using the WOT/MWD tool. The running tool 1410 may then be pulled out of hole. Further to the embodiment of FIG. 14A, fractures 1450 may be formed in the lateral wellbore 1140. Those skilled in the art understand the process of forming the fractures 1450. While not illustrated, it should be noted that a DRSRJ according to the disclosure could be included as part of the frac string. Likewise, other stimulation techniques, seismic techniques, tertiary techniques (i.e., water injection, gas injection, polymer injection, etc.), wellbore evaluation, formation evaluation, field evaluation, reservoir evaluation (including 4D seismic), plug and abandoning, wellbore monitoring, B-Annulus Pressure/Temperature Monitoring (like Halliburton's B-Annulus Pressure/Temperature Monitoring System) may benefit from the use of one or more DRSRJs.

Figure 14B:
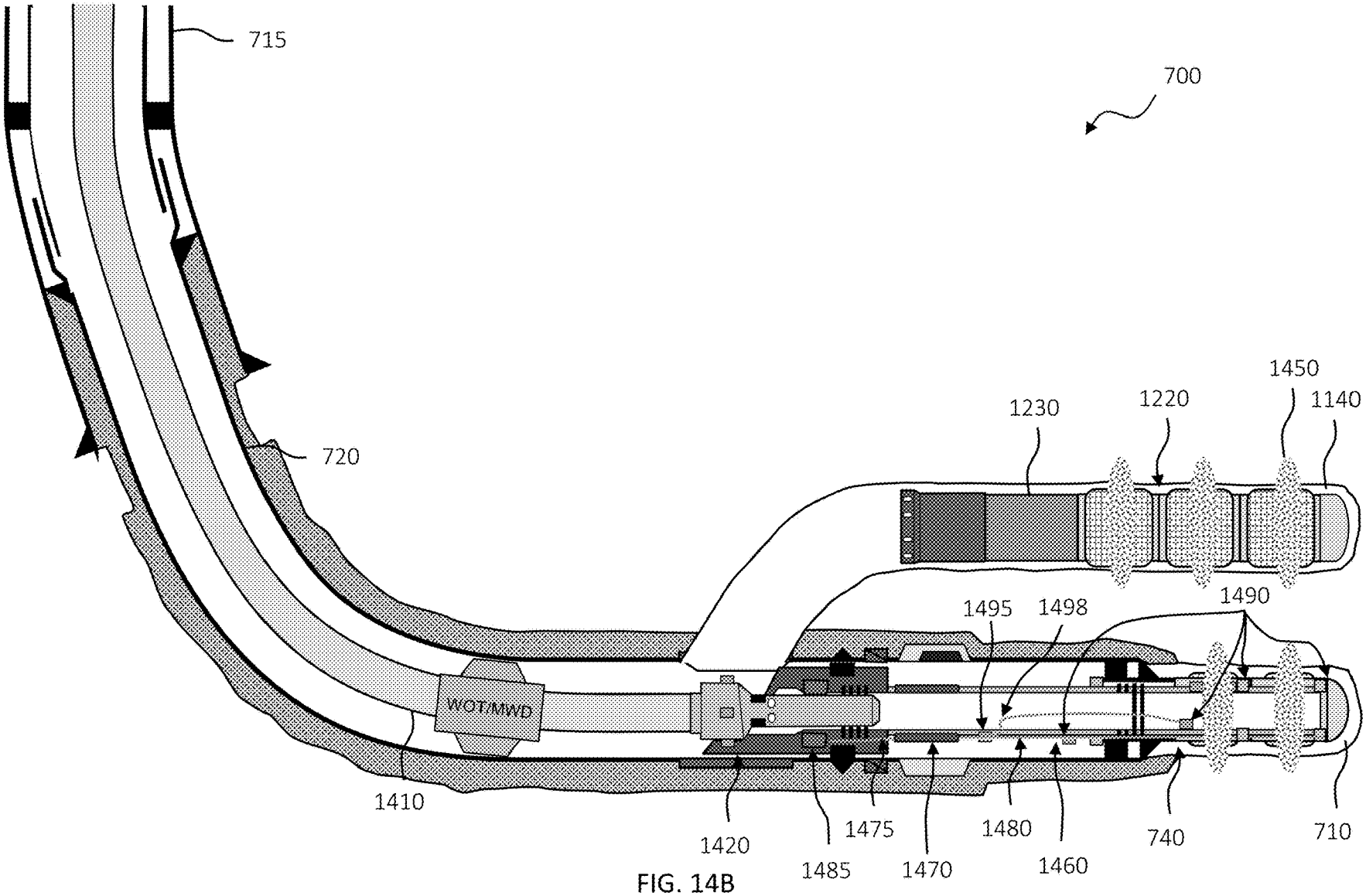

Turning briefly to the well system 700 of FIG. 14B, illustrated is an alternative embodiment of the well system 700 of FIG. 13A. The deflector assembly 1420, in some embodiments, may include a main wellbore production system 1460 positioned in, and/or above, the main wellbore completion 740. The main wellbore production system 1460 may, in certain embodiments, include a main wellbore production tubing or liner (not numbered), as well as one or more control lines (e.g., electrical control lines in one embodiment). The main wellbore production system 1460, in at least one embodiment, may employ a DRSRJ 1470 that may be employed with an uphole control line 1475 and one or more downhole control lines 1480. In at least one embodiment, the control lines from DRSRJ 1470, in particular the uphole control line 1475, may be connected to a connector 1485 such as Wet-Mate Connector. Examples of a Wet-Mate Connector may include: Halliburton's Fuzion™-EH Electro-Hydraulic Downhole Wet-Mate Connector, Fuzion™-E Electric Downhole Wet-Mate Connector, Fuzion™-H Hydraulic Downhole Wet-Mate Connector, and/or Fuzion™-L Electro-Hydraulic/Electric Downhole Wet-Mate Connector. In at least one embodiment, the connector 1485 is a Fiber Optic Wet-Mate, an Inductive Coupler Wet-Mate, an Energy Transfer Mechanism (ETM), a Wireless Energy Transfer Mechanism (WETM), a Schlumberger Inductive Coupler, a hydraulic, fiber optic or other Energy Transfer connector, etc.

In at least one embodiment, the DRSRJ 1470 may be connected to the one or more downhole control lines 1480, such as a Fiber Optic Wet-Mate, an Inductive Coupler Wet-Mate, an Energy Transfer Mechanism (ETM), a Wireless Energy Transfer Mechanism (WETM, and/or a Schlumberger Inductive Coupler, etc. In at least one embodiment, the control lines from DRSRJ 1470, in particular the one or more downhole control lines 1480, may ultimately be connected to one or more downhole devices 1490. A downhole device 1490 may be one or more of the following: sensor, recorder, actuator, choking mechanism, flow restrictor, pressure-drop device, venturi-tube-containing device, super-capacitor, energy storage device, computer, controller, analyzer, machine-learning device, artificial intelligence device, etc. The downhole device 1490 may also include a combination of one or more of the above, or other device or combination of devices typically used in oilfield and other harsh environments (steel-making, nuclear power plant, steam power plant, petroleum refinery, etc.). Harsh environments may include environments that are exposed to fluids (caustic, alkalines, acids, bases, corrosives, waxes, asphaltenes, etc.), temperatures greater than −17.78-degrees C. (e.g., 0-degrees F.), 26.67-degrees C. (e.g., 80-degrees F.), 48.89-degrees C. (e.g., 120-degrees F.), 100-degrees C. (e.g., 212-degrees F.), 121.11-degrees C. (e.g., 250-degrees F.), 148.89-degrees C. (e.g., 300-degree F.), 176.67-degrees C. (e.g., 350-degrees F.), or more than 176.67-degrees C. (e.g., 350-degrees F.), and/or pressures greater than −1 atmosphere (e.g., −14.70 psi (vacuum)), 1 atmosphere (e.g., 14.70 psi), 34 atmospheres (e.g., 500 psi), 68 atmospheres (e.g., 1,000 psi), 340 atmospheres (e.g., 5,000 psi), 680 atmospheres E.g., 10,000 psi), and 2041 atmospheres (e.g., 30,000 psi).

In at least one embodiment, the control lines from DRSRJ 1470, in particular downhole control lines 1480, may connect to a control line, a production zone, reservoir, and/or lateral wellbore management system with in-situ measurements of pressure, temperature, flow rate, and water cut across the formation face in each zone of each production zone and/or reservoir and/or lateral. In one or more embodiment, sensors may be packaged in one station with an electric (or hydraulic, electro-hydraulic, or other power/energy source or combination thereof) flow control valve (FCV) that has variable settings controlled from surface through one or more electrical, fiber optic, hydraulic control lines (or combinations thereof). Multiple stations may be used to maximize hydrocarbon sweep and recovery with fewer wells, reducing capex, opex, and surface footprint.

In at least one embodiment, the control lines from DRSRJ 1470, in particular downhole control line 1480, may include a Y-connector 1495 so that one or more devices, including one or more downhole device 1490, may be run in a parallel arrangement, a parallel-series arrangement, multi-Y (wye) configuration, or other configuration/arrangement of circuitry known and yet-to-be-devised. The Y-connector 1495 may be electrical, hydraulic, fiber optic, inductive, capacitance or another energy-type, and/or energy-transformer, and/or energy-transducer or a combination thereof.

In at least one embodiment, the control lines from DRSRJ 1470, in particular the downhole control line 1480, may include a sealed penetration 1498 so that one or more devices, including one or more downhole devices 1490, may be powered via an electrical, fiber-optic, hydraulic, or other type of energy through a pressure-containing barrier such as a tubing wall or a wall of a piece of equipment. It should be noted that the items, features, systems, etc. mentioned above (and shown in FIG. 14B), may be employed in one or more lateral wellbores, including, but not limited to lateral wellbore 1140. Likewise, the items above may be integrated into lateral wellbore completion 1220 or similar such completion system.

Figure 15:
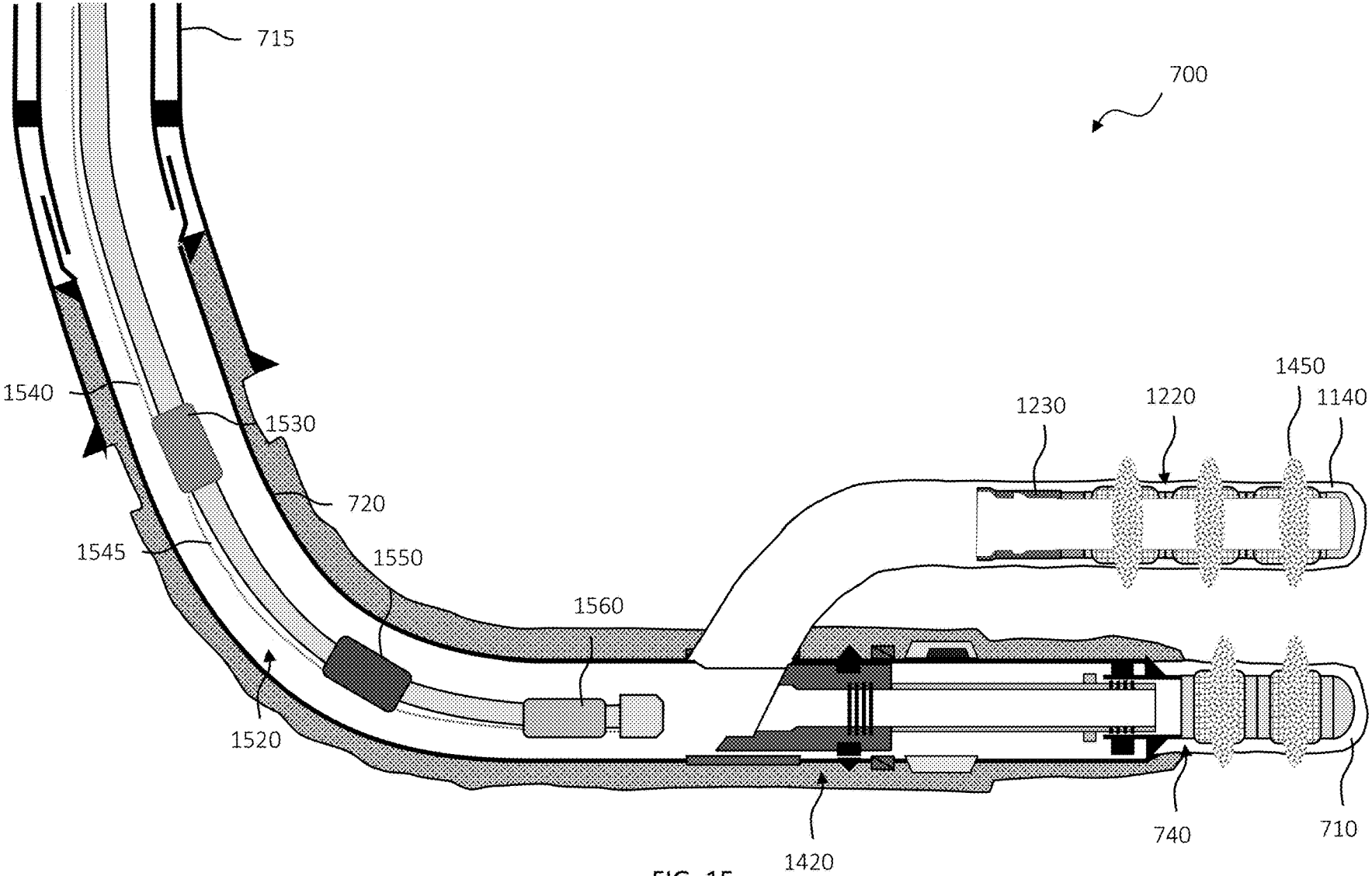

Turning to FIG. 15, illustrated is the well system 700 of FIG. 14A after beginning to run a wellbore access tool 1520 within the casing string 715, 720. The wellbore access tool 1520, in the illustrated embodiment, includes a DRSRJ 1530. The DRSRJ 1530, in at least one embodiment, may be similar to one or more of the DRSRJs discussed above with regard to FIGS. 2 through 3J. The wellbore access tool 1520, in one or more embodiments, further includes an uphole control line 1540 entering an uphole end of the DRSRJ 1530, as well as a downhole control line 1545 leaving a downhole end of the DRSRJ 1530. The uphole control line 1540 and the downhole control line 1545, in one or more embodiments, are external control lines, and thus exposed to the wellbore. Furthermore, the uphole control line 1540, and the downhole control line 1545, in accordance with the disclosure, are configured to rotate relative to one another, for example using the DRSRJ 1530. The wellbore access tool 1520, in one or more embodiments, further includes an interval control valve (ICV) 1550, as well as sensors/control device/computer/valve/etc. 1560. Thus, in the illustrated embodiment, the wellbore access tool 1520 comprises an intelligent completion, which may also be called an intelligent production string or lateral intelligent completion string. It should be noted that the lateral intelligent completion string may include any of the items discussed above with regard to FIGS. 12B and/or 14B.

Figure 16:
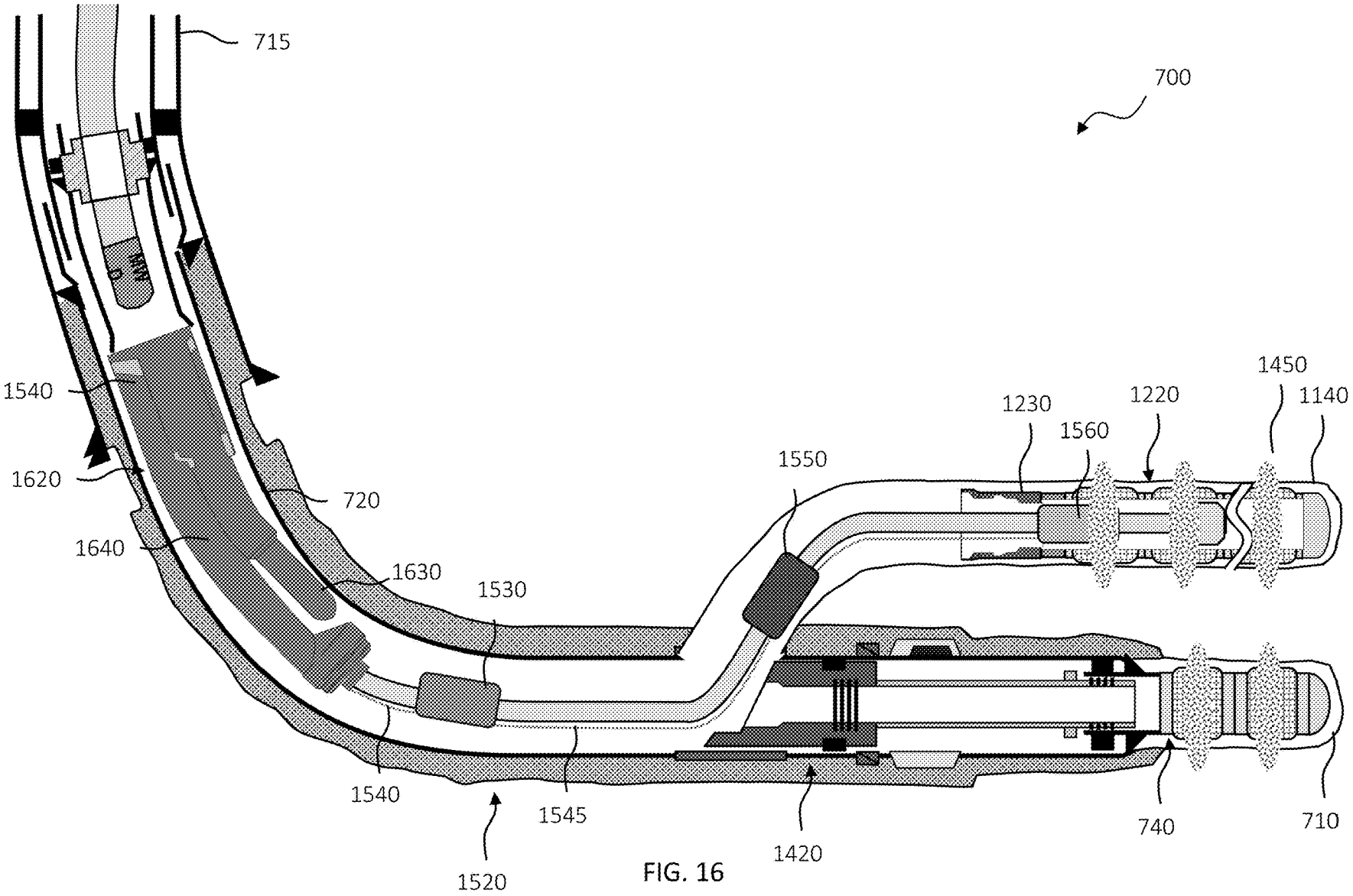

Turning to FIG. 16, illustrated is the well system 700 of FIG. 15 after continuing to run the wellbore access tool 1520 within the casing string 715, 720 and out into the lateral wellbore 1140. The wellbore access tool 1520, in the illustrated embodiment, further includes a multilateral junction 1620 coupled to the uphole side of the DRSRJ 1530. The multilateral junction 1620, in the illustrated embodiment, includes a main bore leg 1630 and a lateral bore leg 1640. In the illustrated embodiment, the main bore leg 1630 is rotated to the high side of the wellbore, whereas the lateral bore leg 1640 is rotated to the low side of the wellbore. Such a configuration may be helpful, if not necessary, to protect the tip of the main bore leg 1630 from the effects of gravity and friction while running in hole, and moreover may be easily accommodated with the DRSRJ 1530.

Figure 17:
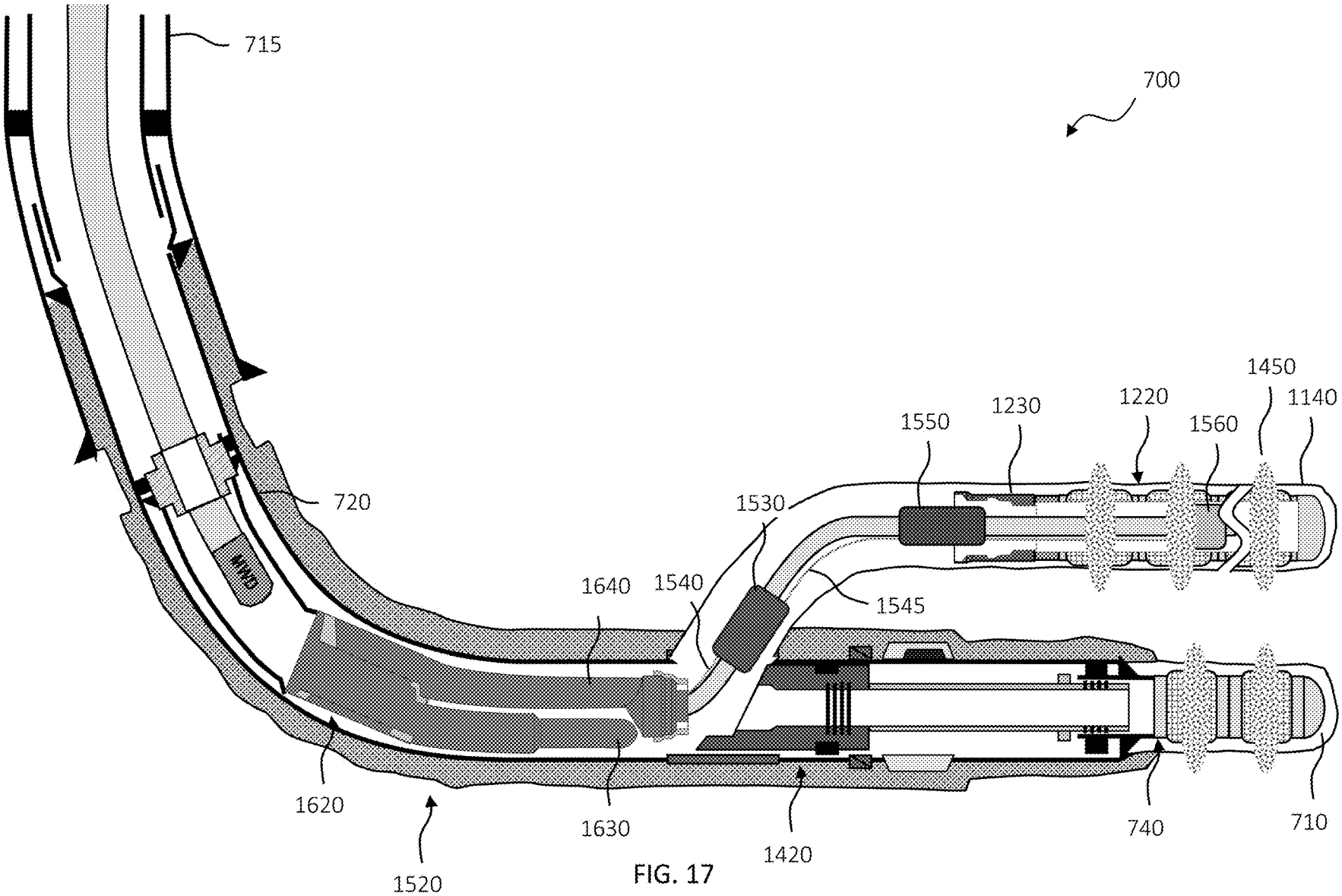

Turning to FIG. 17, illustrated is the well system 700 of FIG. 16 after continuing to run the wellbore access tool 1520 including the multilateral junction 1620 within the casing string 715, 720 and out into the lateral wellbore 1140. As has been illustrated in FIG. 17, the multilateral junction 1620 has been rotated such that the main bore leg 1630 is now aligned with the main wellbore completion 740, and thus in the illustrated embodiment on the low side of the main wellbore 710. As discussed above, the DRSRJ 1530 allows one or more features (e.g., the multilateral junction 1620) above the DRSRJ 1530 to rotate relative to one or more features below the DRSRJ 1530 without harm to the control lines 1540, 1545. FIG. 17 illustrates how the uphole control line 1540 and the downhole control line 1545 have rotated relative to one another, for example using the DRSRJ 1530.

Figure 18:
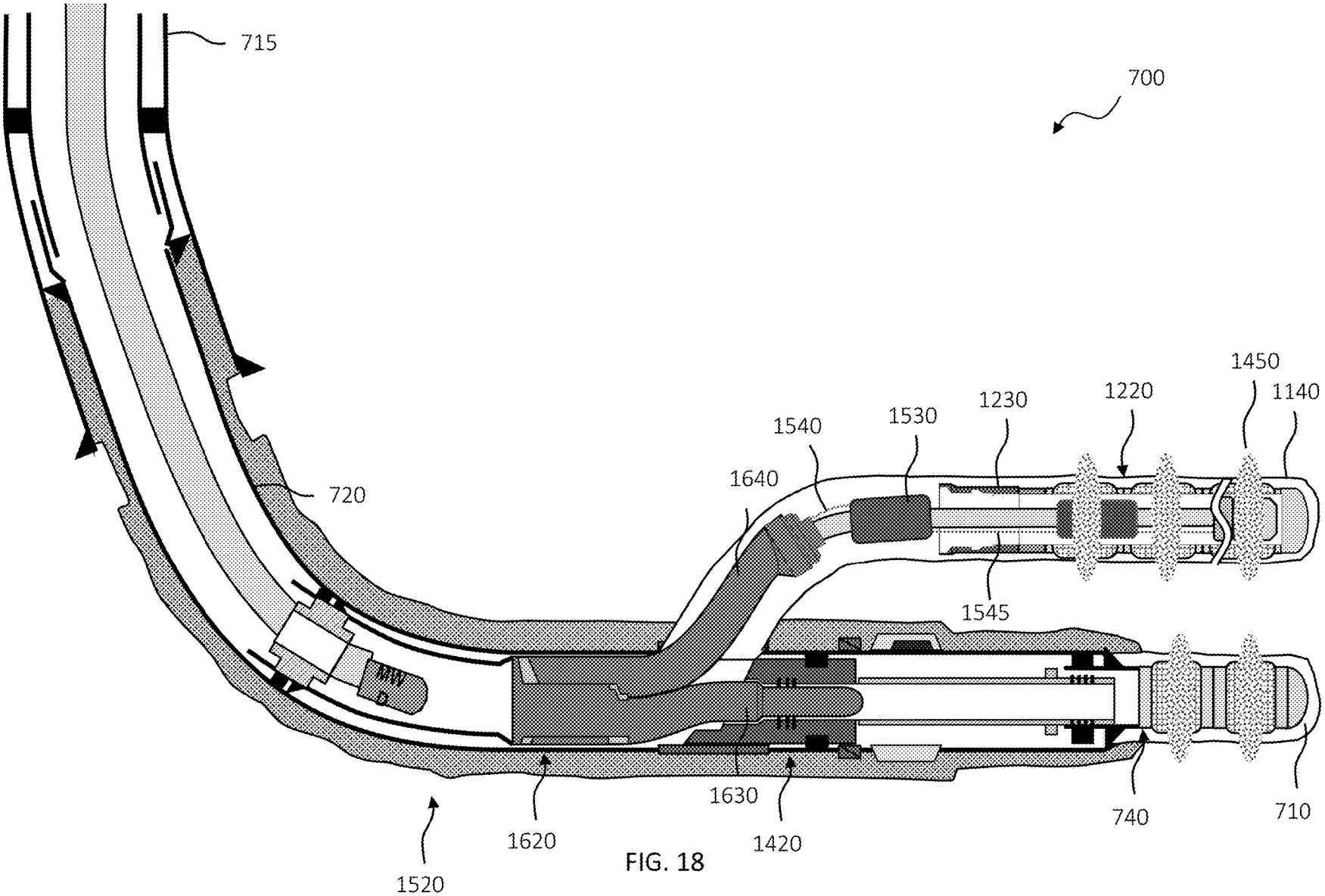

Turning to FIG. 18, illustrated is the well system 700 of FIG. 17 after positioning the multilateral junction 1620 proximate an intersection between the main wellbore 710 and the lateral wellbore 1140, and seating the multilateral junction 1620 within the main wellbore completion 740 and the lateral wellbore completion 1220.

Figure 19:
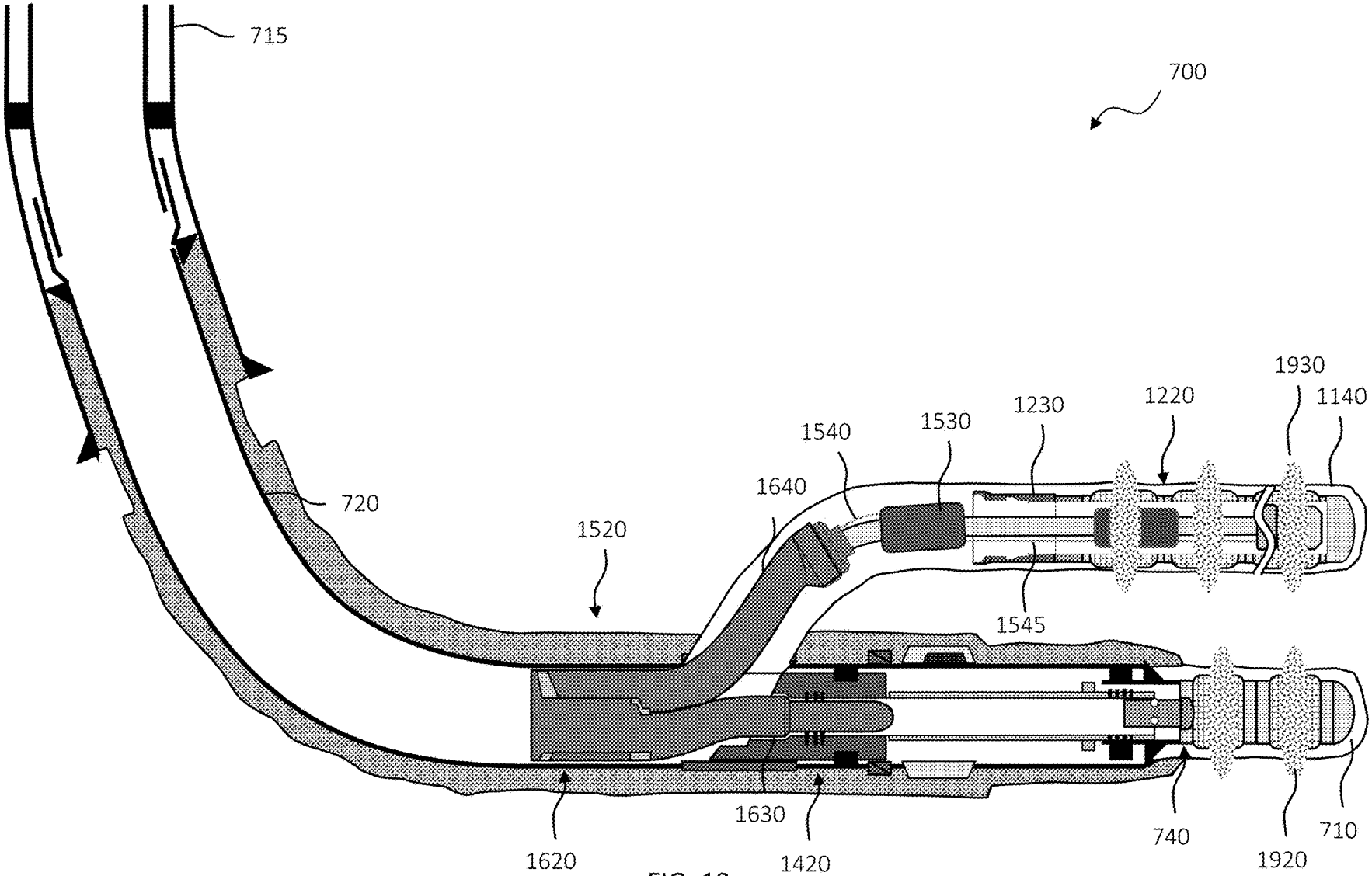

Turning to FIG. 19, illustrated is the well system 700 of FIG. 18 after selectively accessing the main wellbore 710 with a first intervention tool through the multilateral junction 1520 to form fractures 1920 in the subterranean formation surrounding the main wellbore completion 740, and selectively accessing the lateral wellbore 1140 with a second intervention tool through the multilateral junction 1520 to form fractures 1930 in the subterranean formation surrounding the lateral wellbore completion 1140. The embodiment of FIG. 19 is different from the embodiments of FIGS. 7A and 13, in that the fractures 1920 and 1930 are being formed at a much later stage than discussed above.

The embodiments discussed above reference that the main wellbore 710 and lateral wellbore 1140 are selectively accessed and fractured at a specific point in the completion/manufacturing process. Nevertheless, other embodiments may exist wherein the lateral wellbore 1140 is selectively accessed and fractured prior to the main wellbore 710. The embodiments discussed above additionally reference that both the main wellbore 710 and the lateral wellbore 1140 are selectively accessed and fractured through the multilateral junction 1520. Other embodiments may exist wherein only one of the main wellbore 710 or the lateral wellbore 1140 is selectively accessed and fractured through the multilateral junction 1520.

Figure 20A:
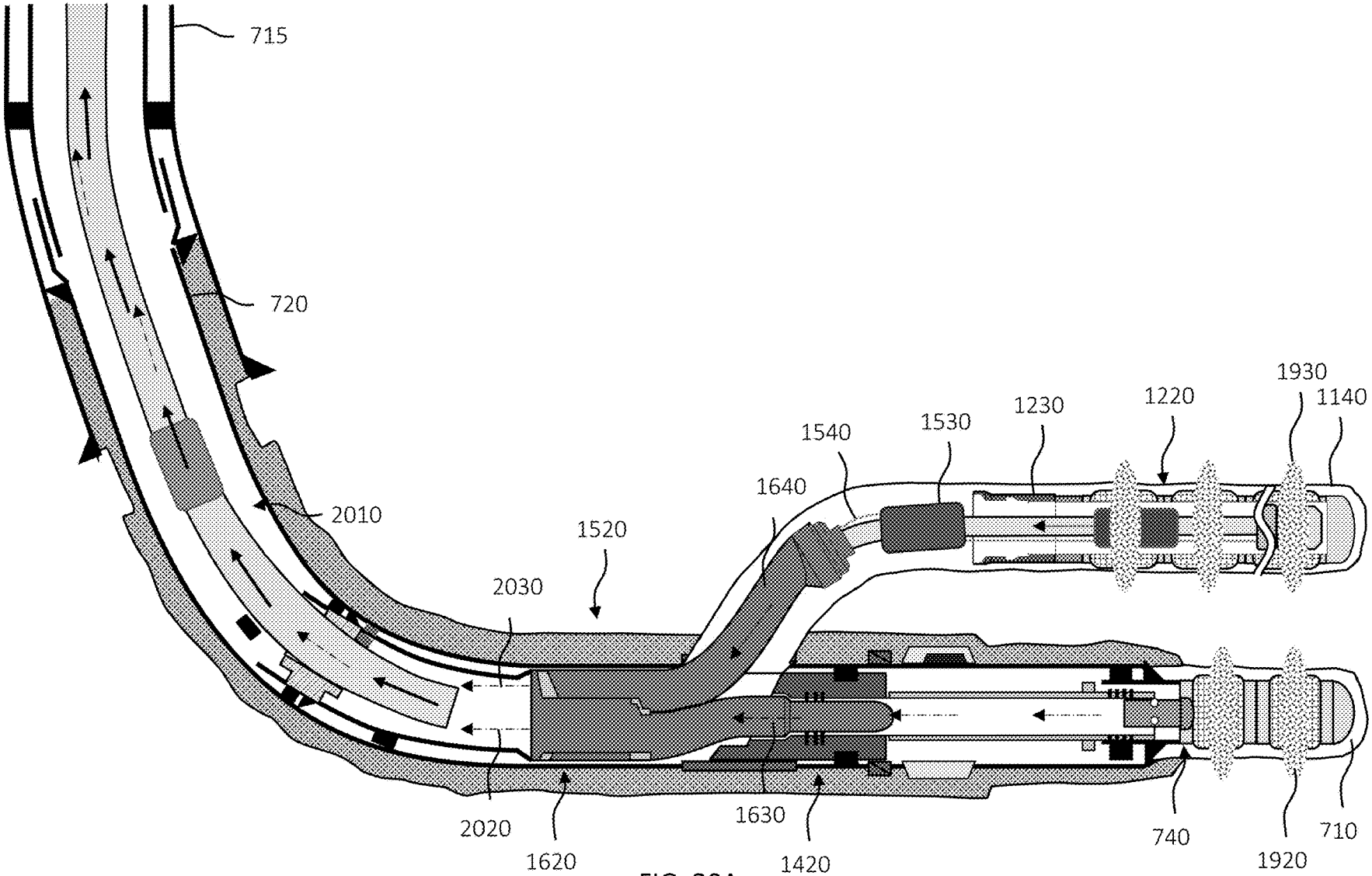

Turning to FIG. 20A, illustrated is the well system 700 of FIG. 19 after the upper completion 2010 has been installed, and after producing fluids 2020 from the fractures 1920 in the main wellbore 710, and producing fluids 2030 from the fractures 1930 in the lateral wellbore 1140. The producing of the fluids 2020, 2030 occur through the multilateral junction 1520 in one or more embodiments. It should be noted that main wellbore 710 and/or lateral wellbore 1140 may be fracked, stimulated, accessed, evaluated, etc. after upper completion 2010 has been installed.

Figure 20B:
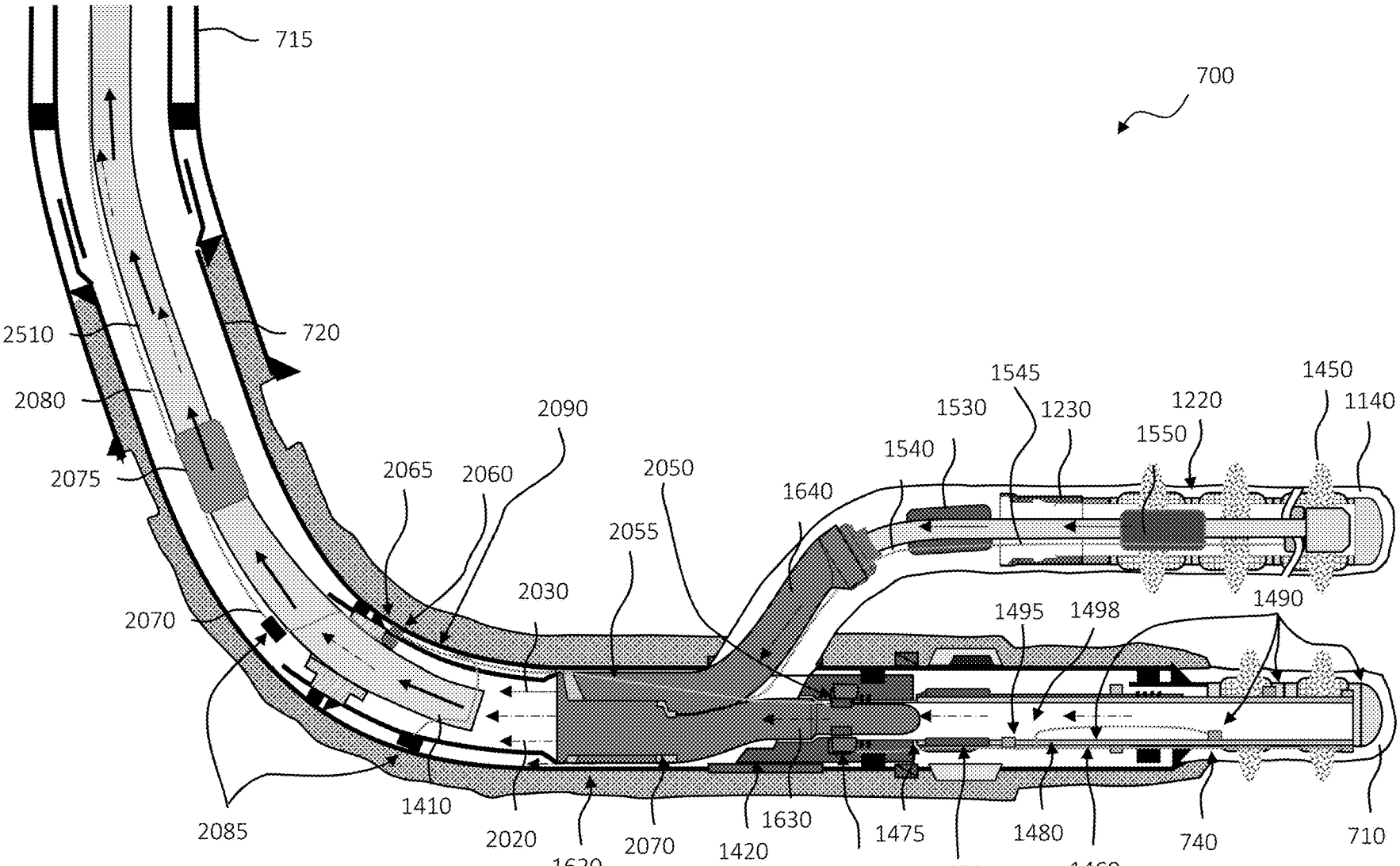

Turning to FIG. 20B, illustrated is a well system embodiment similar to 14B (e.g., it encompasses many of the same features). Multilateral junction 1620 has been landed into completion deflector 1420. Main bore leg 1630 has a complimenting connector 2050 (e.g., male connector) to connector 1485 of main wellbore production system 1460. In some embodiments, connector 2050 may be consider a component of multilateral junction 1620. Connector 2050 has a control line 2055 that runs above the Y-Block to a (Female) connector 2060. Connector 2060 may be different or similar to the options mentioned above for connector 1485 (e.g., Wet-mate, ETM, WETM, Inductive Coupler, etc.) Connector 2060, or parts thereof, may be adjacent the Y-Block, immediately above the Y-Block, less than 2-feet from the Y-Block, 3.05 m (e.g., 10 ft), 6.1 m (e.g., 20 ft), 12.2 m (e.g., 40 ft), 30.48 m (e.g., 100 ft), 152.4 m (e.g., 500 ft) or more from the Y-B lock.

In some embodiments, complimenting connector 2065 (e.g., male connector) is part of the upper completion, for example a part of upper completion 2010 illustrated in FIG. 20B. Connector 2065 may be different or similar to the options mentioned above for connectors 1495 and 2050 (e.g., Wet-mate, ETM, WETM, Inductive Coupler, etc.). In some embodiments, connector 2065 is connected to control line 2070, or it may be connected directly to a DRSRJ 2075. Connector 2065 may be integrated into the DRSRJ 2075 in some embodiments. In some embodiments, upper control line 1540 runs above Y-Block to the same (Female) connector 2060. Or it may run up to a separate connector (not shown). Connector 2065 may have similar, or different, characteristics of connector 2060.

Control line 2080 may be a multiple control line assembly such as a Flat Pack. All of the control lines mentioned herein may be a single control line, flat pack, etc. In some embodiments, connector (not shown) is connected to control line 2080, or it may be connected directly to DRSRJ 2075. Connector 2065 may be integrated into a DRSRJ 2075 in some embodiments. In at least one embodiment, DRSRJ 2075 and/or the control lines to/from DRSRJ 2075, in particular downhole control line 2070, may ultimately be connected to one or more downhole device 2085, and/or 1480, and/or 1550 and/or other devices. A downhole device 2085 may be one or more of the following: sensor, recorder, actuator, choking mechanism, flow restrictor, pressure-drop device, venturi-tube-containing device, super-capacitor, energy storage device, computer, controller, analyzer, machine-learning device, artificial intelligence device, etc.

Downhole devices 2085 may also include a combination of one or more of the above, or other device or combination of devices typically used in oilfield and other harsh environments (steel-making, nuclear power plant, steam power plant, petroleum refinery, etc.). Harsh environments may include environments that are exposed to fluids (caustic, alkalines, acids, bases, corrosives, waxes, asphaltenes, etc.), temperatures greater than −17.78-degrees C. (e.g., 0-degrees F.), 26.67-degrees C. (e.g., 80-degrees F.), 48.89-degrees C. (e.g., 120-degrees F.), 100-degrees C. (e.g., 212-degrees F.), 121.11-degrees C. (e.g., 250-degrees F.), 148.89-degrees C. (e.g., 300-degree F.), 176.67-degrees C. (e.g., 350-degrees F.), or more than 176.67-degrees C. (e.g., 350-degrees F.), and/or pressures greater than −1 atmosphere (e.g., −14.70 psi (vacuum)), 1 atmosphere (e.g., 14.70 psi), 34 atmospheres (e.g., 500 psi), 68 atmospheres (e.g., 1,000 psi), 340 atmospheres (e.g., 5,000 psi), 680 atmospheres E.g., 10,000 psi), and 2041 atmospheres (e.g., 30,000 psi).

DRSRJ 2075, control line 2070, and/or control line 2080 may include a Y-connector 2090 so that one or more devices, including one or more downhole device 1480 and/or 2085, may be run in a parallel arrangement, a parallel-series arrangement, multi-Y (wye) configuration, or other configuration/arrangement known and yet-to-be-devised circuitry. The Y-connector 2090 may be electrical, hydraulic, fiber optic, inductive, capacitance or another energy-type, and/or energy-transformer, and/or energy-transducer or any combination thereof.

In at least one embodiment, DRSRJ 2070, control line 2080, and/or control line 2080, in particular uphole control line 2080, may connect to a production zone, reservoir, and/or lateral wellbore management system with in-situ measurements of pressure, temperature, flow rate, and water cut across the formation face in each zone of each production zone and/or reservoir and/or lateral. In one or more embodiment, parts of the management system may be on the surface while other parts (sensors, control valves, etc.) maybe below the DRSRJ 2070. Sensors may be packaged in one station with an electric (or hydraulic, electro-hydraulic, or other power/energy source or combination thereof) flow control valve (FCV) that has variable settings controlled from surface through one or more electrical, fiber optic, hydraulic control lines (or combinations thereof) and one or more DRSRJ. Multiple stations may be used to maximize hydrocarbon sweep and recovery with fewer wells, reducing capex, opex, and surface footprint.

The systems, components, methods, concepts, etc. divulged in this application may also be used in single-bore wells, extended-reach wells, horizontal wells, unconventional wells, conventional wells, directionally-drilled wells, SAGD wells, geothermal wells, etc.

Figure 21:
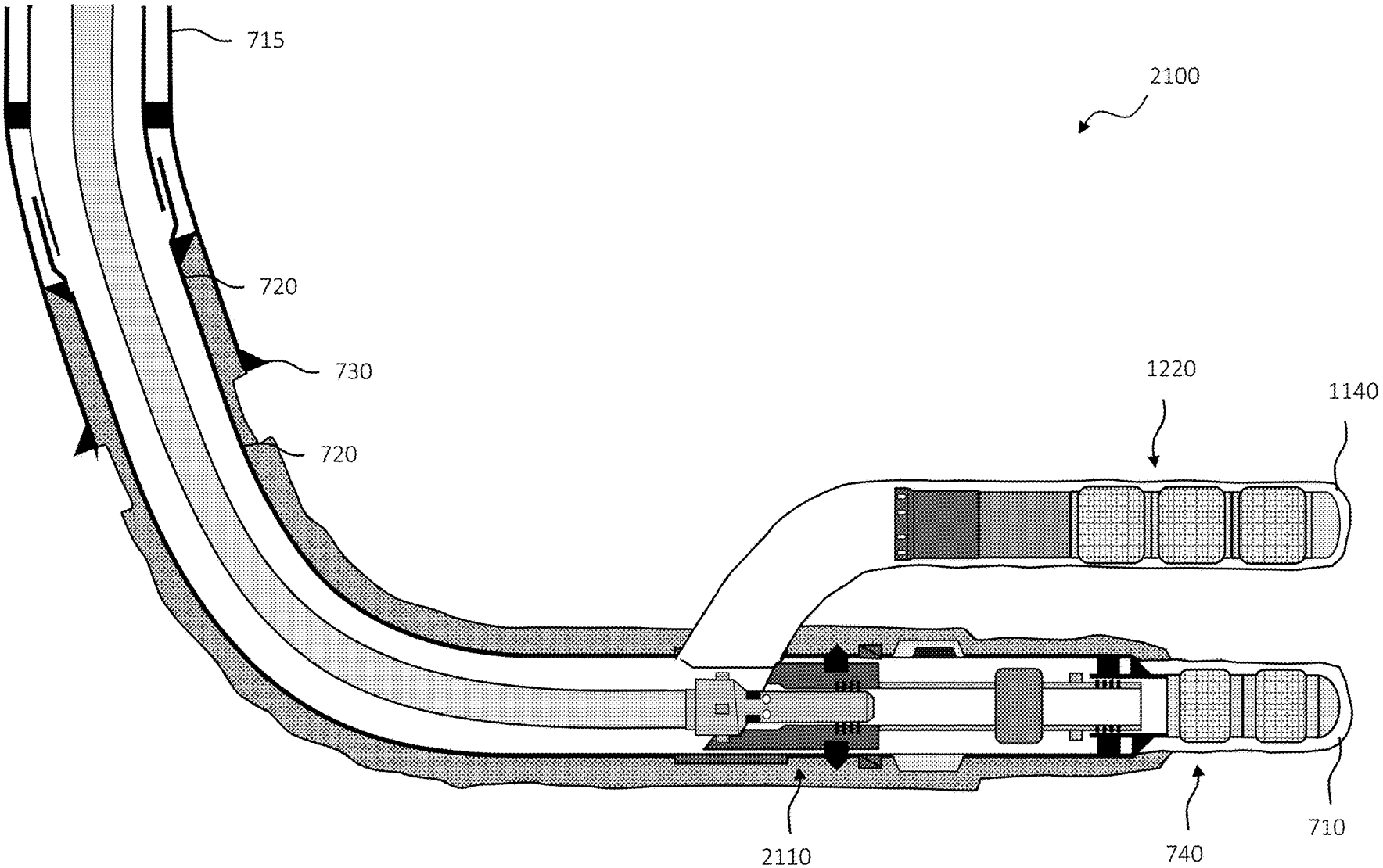

Turning to FIG. 21, illustrated is an alternative embodiment of a well system 2100 designed, manufactured and operated according to one or more embodiments of the disclosure. The well system 2100 is similar in many respects to the well system 700. Accordingly, like reference numbers have been used to reference like features. The well system 2100 differs for the most part from the well system 700 in that the well system 2100 employs a deflector assembly 2110 that includes a DRSRJ 2130. In this embodiment, the deflector assembly 2110 is not threadingly engaged with the main bore completion 740.

Figure 22:
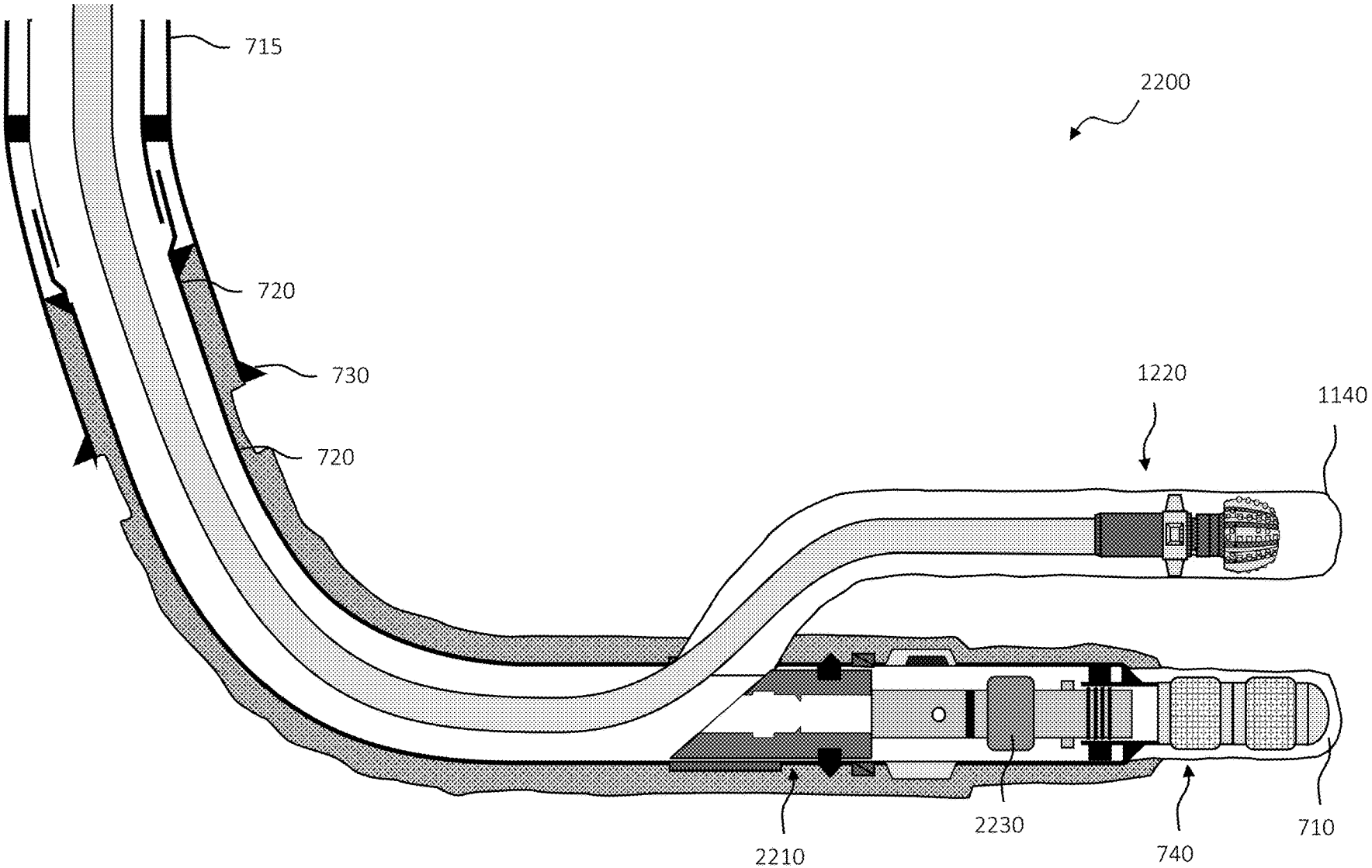

Turning to FIG. 22, illustrated is an alternative embodiment of a well system 2200 designed, manufactured and operated according to one or more embodiments of the disclosure. The well system 2200 is similar in many respects to the well system 700. Accordingly, like reference numbers have been used to reference like features. The well system 2200 differs for the most part from the well system 700 in that the well system 2200 employs a whipstock assembly 2210 that includes a DRSRJ 2230 according to one or more embodiments of the disclosure. Accordingly, the whipstock assembly 2210 may be rotated to align it with the desired location of the lateral wellbore 1140 while the features downhole of the whipstock assembly 2210 can rotate about the DRSRJ 2230.

In this embodiment, DRSRJ 2230 allows, for example, a seal assembly to rotate as it engages into a Polish Bore Receptacle (PBR). The seal assembly may have a "thing" associated with it which requires alignment when engaging or engaged to the PBR. The "thing" maybe a control line and/or Energy Transfer Mechanism (ETM) to transmit power or energy from above the Seal Assembly to near or below the Seal Assembly in order to actuate a fluid loss device within or located near the PBR. The "thing" may be a control line/device/connector for a fiber optic line. A fiber optic line may be used as a Distributed Sensor Line.

Figure 23:
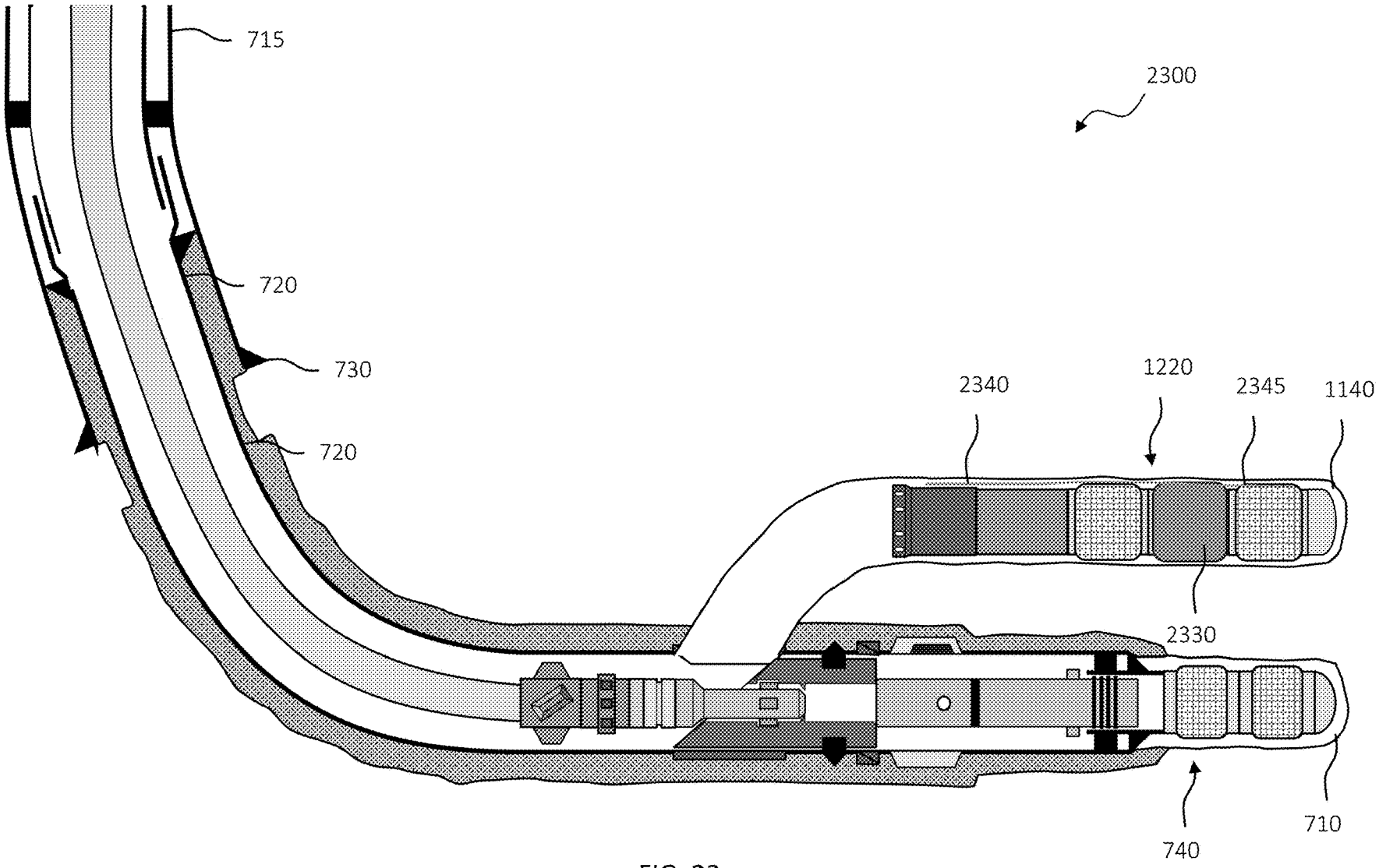

Turning to FIG. 23, illustrated is an alternative embodiment of a well system 2300 designed, manufactured and operated according to one or more embodiments of the disclosure. The well system 2300 is similar in many respects to the well system 700. Accordingly, like reference numbers have been used to reference like features. The well system 2300 differs for the most part from the well system 700 in that the well system 2300 employs a main wellbore completion 740 or lateral wellbore completion 1120 that includes a DRSRJ 2330. In at least one embodiment, the DRSRJ 2330 is installed on the sand screens, casing, liner, or other non-production tubular.

The DRSRJ 2330 may be run with screens to sense pressure, pressure drop, flow, oil-cut, water-cut, gas content, chemical content, and other things. The control lines to and from the DRSRJ 2330 (e.g., lines 2340, 2345, respectively) may connect one or more devices together for passing of information, energy, power, etc. for information gathering, decision-making, autonomous control, etc. The control lines 2340, 2345 and/or the DRSRJ 2330 may connect to, or be a part of, an ETM to transfer data and/or power to/from the equipment attached to the slip ring (e.g., items mentioned above and other such devices/components/controllers, AI systems, Machine Learning components/devices, etc.). The ETM may be a contact-type energy transfer mechanism such as a Wet Mate/Wet Connect item or assembly, an electrical switch with/or without insulation to protect from the wellbore fluids, or a switch protected with insulation such as a dielectric fluid. Other physical connectors such as hydraulic components with protection from wellbore fluids, etc. An ETM may also include wireless energy transfer mechanisms such as Inductive Couplers, Capacitive Couplers, RF, Microwave, or other electro-magnetic couplers.

Figure 24:
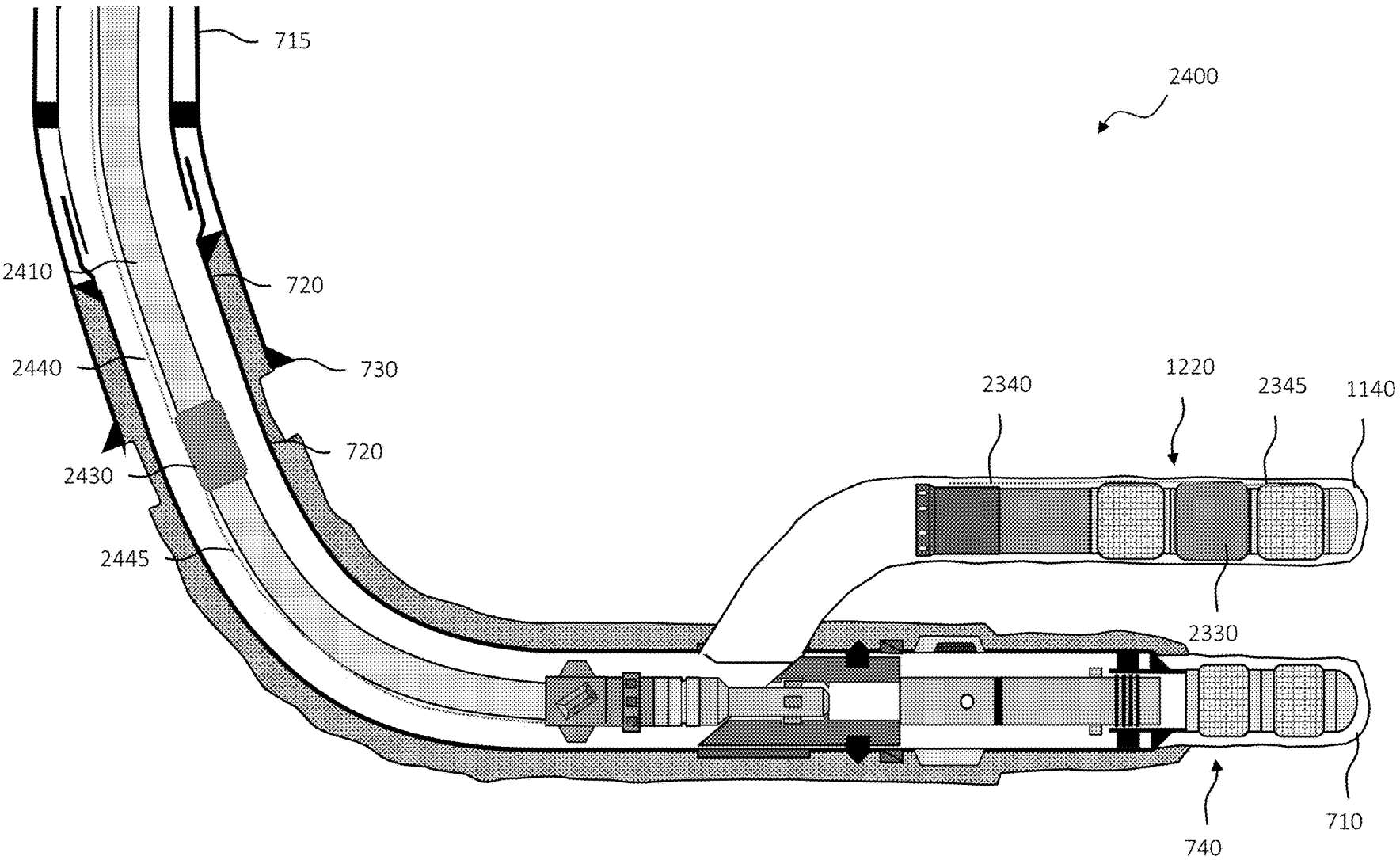

Turning to FIG. 24, illustrated is an alternative embodiment of a well system 2400 designed, manufactured and operated according to one or more embodiments of the disclosure. The well system 2400 is similar in many respects to the well system 2300. Accordingly, like reference numbers have been used to reference like features. The well system 2400 differs for the most part from the well system 2300 in that the well system 2400 employs a work string 2410 that includes a DRSRJ 2430, as well as control lines to and from the DRSRJ 2430 (e.g., control lines 2440, 2445, respectively).

In one or more embodiments, the DRSRJ 2430 is installed on the work string 2410. The work string 2410 is a tubular string used to deploy equipment to a downhole location. The control lines 2440, 2445 may be attached to the exterior of the work string 2410 so information and/or power can be transmitted downhole (and uphole) from the tools (and/or running tools) while 1) running to tools in the wellbore, 2) during the "setting/positioning/testing" phase of the operation, 3) after the disconnection and/or retrieval operation of the work string or tools.

A work string, such as the work string 2410, is commonly used when extremely heavy loads are being deployed and the tools are not required to extend all of the way from the surface to a downhole location. An example of this is a drilling liner that is "hung off" from the lower end of another casing string. The drilling liner is RIH attached to a Liner Running Tool. At the bottom of a previously run casing string (for example), the work string is stopped, and a Liner Hanger is actuated to set (anchor) the Liner Hanger and Liner to the previous casing string. The DRSRJ 2430 will allow the control lines 2440, 2445 to rotate while the drilling liner and work string are RIH. This is especially an advantage when the wellbore is highly deviated (long horizontal sections, extended reach wellbores, S-curve wellbores, etc.

The control lines 2440, 2445 may have sensors, actuators, etc. attached to them. These items may be attached to the liner, the work string, the running/anchoring/setting tool or a combination of these. The control lines may be attached to computers, logic analyzers, controllers, etc. on the surface so that the status/"health" of one or more items can be monitored with RIH, Setting/Actuating/Testing/Releasing/Attaching/Rotating/stroking/pressure testing/etc.

Figure 25:
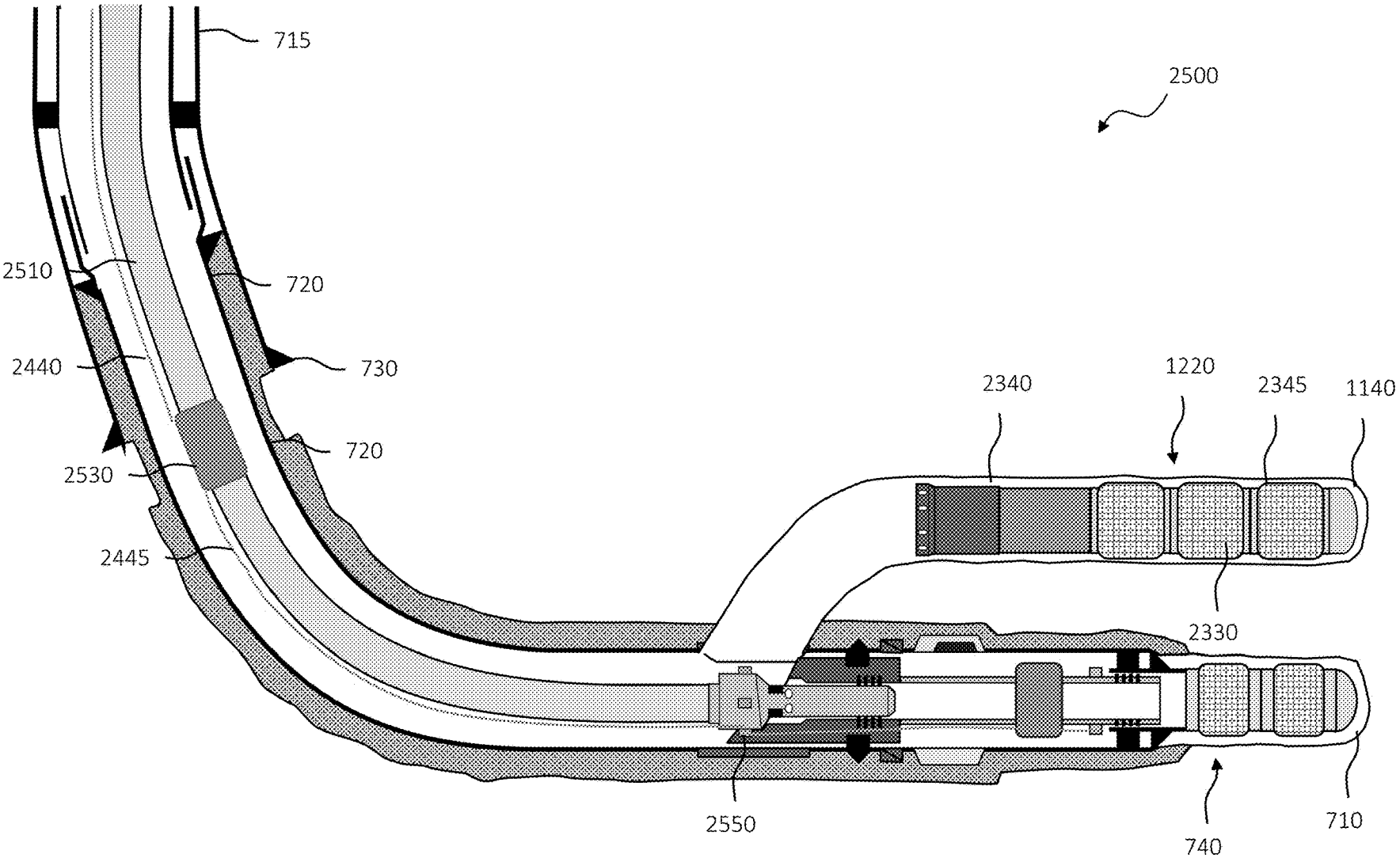

Turning to FIG. 25, illustrated is an alternative embodiment of a well system 2500 designed, manufactured and operated according to one or more embodiments of the disclosure. The well system 2500 is similar in many respects to the well systems 2100, 2400. Accordingly, like reference numbers have been used to reference like features. The well system 2500 differs for the most part from the well systems 2100, 2400 in that the well system 2500 employs a work string 2510 that includes a DRSRJ 2530 that senses/controls things below via ETM and/or WETM 2550. The DRSRJ 2530 may be run with the work string 2510 to sense orientation, pressure, pressure drop, depth, position, profiles, gas content, and other things. The control lines to/from the DRSRJ 2530 may connect one or more devices together for passing of information, energy, power, etc. for information gathering, decision-making, autonomous control, etc. The control lines and/or DRSRJ 2530 may connect to, or be a part of, the ETM and/or WETM 2550 to transfer data and/or power to/from the equipment attached to the DRSRJ 2530 (e.g., items mentioned above and other such devices/components/controllers, AI systems, Machine Learning components/devices, etc.

The ETM and/or WETM 2550 may be a contact-type energy transfer mechanism such as a Wet Mate/Wet Connect item or assembly, an electrical switch with/or without insulation to protect from the wellbore fluids, or a switch protected with insulation such as a dielectric fluid. Other physical connectors such as hydraulic components with protection from wellbore fluids, etc. The ETM and/or WETM 2550 may also include wireless energy transfer mechanisms such as Inductive Couplers, Capacitive Couplers, RF, Microwave, or other electro-magnetic couplers. The use of more than one DRSRJ 2530 may be used in the same string, or used in separate strings (as shown in FIG. 25) where they are working in concert (together).

Aspects disclosed herein include:

A. A downhole rotary slip ring joint, the downhole rotary slip ring joint including: 1) an outer mandrel; 2) an inner mandrel operable to rotate relative to the outer mandrel; 3) an outer mandrel communication connection coupled to the outer mandrel; 4) an inner mandrel communication connection coupled to the inner mandrel; and 5) a passageway extending through the outer mandrel and the inner mandrel, the passageway configured to provide continuous coupling between the outer mandrel communication connection and the inner mandrel communication connection regardless of a rotation of the inner mandrel relative to the outer mandrel, wherein the downhole rotary slip ring joint is operable to be coupled to a wellbore access tool.

B. A well system, the well system including: 1) a wellbore; 2) a wellbore access tool positioned near the wellbore with a conveyance; 3) a downhole rotary slip ring joint positioned between the conveyance and the wellbore access tool, the downhole rotary slip ring joint including: a) an outer mandrel; b) an inner mandrel operable to rotate relative to the outer mandrel; c) an outer mandrel communication connection coupled to the outer mandrel; d) an inner mandrel communication connection coupled to the inner mandrel; and e) a passageway extending through the outer mandrel and the inner mandrel, the passageway configured to provide continuous coupling between the outer mandrel communication connection and the inner mandrel communication connection regardless of a rotation of the inner mandrel relative to the outer mandrel, wherein the downhole rotary slip ring joint is operable to be coupled to a wellbore access tool; and 4) a first communication line coupled to the outer mandrel communication connection and a second communication line coupled to the inner mandrel communication connection.

C. A method for accessing a wellbore, the method including: 1) coupling a wellbore access tool to a conveyance, the wellbore access tool and the conveyance having a downhole rotary slip ring joint positioned therebetween, the downhole rotary slip ring joint including: 1) an outer mandrel; b) an inner mandrel operable to rotate relative to the outer mandrel; c) an outer mandrel communication connection coupled to the outer mandrel; d) an inner mandrel communication connection coupled to the inner mandrel; e) a passageway extending through the outer mandrel and the inner mandrel, the passageway configured to provide continuous coupling between the outer mandrel communication connection and the inner mandrel communication connection regardless of a rotation of the inner mandrel relative to the outer mandrel, wherein the downhole rotary slip ring joint is operable to be coupled to a wellbore access tool, wherein a first communication line is coupled to the outer mandrel communication connection and a second communication line is coupled to the inner mandrel communication connection; and f) a first communication line coupled to the outer mandrel communication connection and a second communication line coupled to the inner mandrel communication connection; and 2) positioning the wellbore access tool within the wellbore as the inner mandrel rotates relative to the outer mandrel.

D. A downhole rotary slip ring joint, the downhole rotary slip ring joint including: 1) an outer mandrel; 2) an inner mandrel operable to rotate relative to the outer mandrel; 3) first and second outer mandrel communication connections coupled to the outer mandrel, the first and second outer mandrel communication connections angularly offset and isolated from one another; 4) first and second inner mandrel communication connections coupled to the inner mandrel, the first and second inner mandrel communication connections angularly offset and isolated from one another; 5) a first passageway extending through the outer mandrel and the inner mandrel, the first passageway configured to provide continuous coupling between the first outer mandrel communication connection and the first inner mandrel communication connection regardless of a rotation of the inner mandrel relative to the outer mandrel; and 6) a second passageway extending through the outer mandrel and the inner mandrel, the second passageway configured to provide continuous coupling between the second outer mandrel communication connection and the second inner mandrel communication connection regardless of a rotation of the inner mandrel relative to the outer mandrel, wherein the downhole rotary slip ring joint is operable to be coupled to a wellbore access tool.

E. A well system, the well system including: 1) a wellbore; 2) a wellbore access tool positioned near the wellbore with a conveyance; 3) a downhole rotary slip ring joint positioned between the conveyance and the wellbore access tool, the downhole rotary slip ring joint including: a) an outer mandrel; b) an inner mandrel operable to rotate relative to the outer mandrel; c) first and second outer mandrel communication connections coupled to the outer mandrel, the first and second outer mandrel communication connections angularly offset and isolated from one another; d) first and second inner mandrel communication connections coupled to the inner mandrel, the first and second inner mandrel communication connections angularly offset and isolated from one another; e) a first passageway extending through the outer mandrel and the inner mandrel, the first passageway configured to provide continuous coupling between the first outer mandrel communication connection and the first inner mandrel communication connection regardless of a rotation of the inner mandrel relative to the outer mandrel; and f) a second passageway extending through the outer mandrel and the inner mandrel, the second passageway configured to provide continuous coupling between the second outer mandrel communication connection and the second inner mandrel communication connection regardless of a rotation of the inner mandrel relative to the outer mandrel, wherein the downhole rotary slip ring joint is operable to be coupled to a wellbore access tool; and 2) a first communication line coupled to the first outer mandrel communication connection, a second communication line coupled to the first inner mandrel communication connection, a third communication line coupled to the second outer mandrel communication connection, and a fourth communication line coupled to the second inner mandrel communication connection.

F. A method for accessing a wellbore, the method including: 1) coupling a wellbore access tool to a conveyance, the wellbore access tool and the conveyance having a downhole rotary slip ring joint positioned therebetween, the downhole rotary slip ring joint including: a) an outer mandrel; b) an inner mandrel operable to rotate relative to the outer mandrel; c) first and second outer mandrel communication connections coupled to the outer mandrel, the first and second outer mandrel communication connections angularly offset and isolated from one another; d) first and second inner mandrel communication connections coupled to the inner mandrel, the first and second inner mandrel communication connections angularly offset and isolated from one another; e) a first passageway extending through the outer mandrel and the inner mandrel, the first passageway configured to provide continuous coupling between the first outer mandrel communication connection and the first inner mandrel communication connection regardless of a rotation of the inner mandrel relative to the outer mandrel; f) a second passageway extending through the outer mandrel and the inner mandrel, the second passageway configured to provide continuous coupling between the second outer mandrel communication connection and the second inner mandrel communication connection regardless of a rotation of the inner mandrel relative to the outer mandrel, wherein the downhole rotary slip ring joint is operable to be coupled to a wellbore access tool; and g) a first communication line coupled to the first outer mandrel communication connection, a second communication line coupled to the first inner mandrel communication connection, a third communication line coupled to the second outer mandrel communication connection, and a fourth communication line coupled to the second inner mandrel communication connection; and 2) positioning the wellbore access tool near a wellbore as the inner mandrel rotates relative to the outer mandrel.

G. A downhole rotary slip ring joint, the downhole rotary slip ring joint including: 1) an outer mandrel; 2) an inner mandrel operable to rotate relative to the outer mandrel; 3) a first outer mandrel communication connection coupled to the outer mandrel; 4) a second outer mandrel electrical communication connection coupled to the outer mandrel; 5) a third outer mandrel hydraulic communication connection coupled to the outer mandrel, the first outer mandrel communication connection, second outer mandrel electrical communication connection, and third outer mandrel hydraulic communication connection angularly offset and isolated from one another; 6) a first inner mandrel communication connection coupled to the inner mandrel; 7) a second inner mandrel electrical communication connection coupled to the inner mandrel; 8) a third inner mandrel hydraulic communication connection coupled to the inner mandrel, the first inner mandrel communication connection, second inner mandrel electrical communication connection, and third inner mandrel hydraulic communication connection angularly offset and isolated from one another; 9) a first passageway extending through the outer mandrel and the inner mandrel, the first passageway configured to provide continuous coupling between the first outer mandrel communication connection and the first inner mandrel communication connection regardless of a rotation of the inner mandrel relative to the outer mandrel; 10) a second passageway extending through the outer mandrel and the inner mandrel, the second passageway configured to provide continuous coupling between the second outer mandrel electrical communication connection and the second inner mandrel electrical communication connection regardless of a rotation of the inner mandrel relative to the outer mandrel; and 11) a third passageway extending through the outer mandrel and the inner mandrel, the third passageway configured to provide continuous coupling between the third outer mandrel hydraulic communication connection and the third inner mandrel hydraulic communication connection regardless of a rotation of the inner mandrel relative to the outer mandrel, wherein the downhole rotary slip ring joint is operable to be coupled to a wellbore access tool.

H. A well system, the well system including: 1) a wellbore; 2) a wellbore access tool positioned near the wellbore with a conveyance; 3) a downhole rotary slip ring joint positioned between the conveyance and the wellbore access tool, the downhole rotary slip ring joint including: a) an outer mandrel; b) an inner mandrel operable to rotate relative to the outer mandrel; c) a first outer mandrel communication connection coupled to the outer mandrel; d) a second outer mandrel electrical communication connection coupled to the outer mandrel; e) a third outer mandrel hydraulic communication connection coupled to the outer mandrel, the first outer mandrel communication connection, second outer mandrel electrical communication connection, and third outer mandrel hydraulic communication connection angularly offset and isolated from one another; f) a first inner mandrel communication connection coupled to the inner mandrel; g) a second inner mandrel electrical communication connection coupled to the inner mandrel; h) a third inner mandrel hydraulic communication connection coupled to the inner mandrel, the first inner mandrel communication connection, second inner mandrel electrical communication connection, and third inner mandrel hydraulic communication connection angularly offset and isolated from one another; i) a first passageway extending through the outer mandrel and the inner mandrel, the first passageway configured to provide continuous coupling between the first outer mandrel communication connection and the first inner mandrel communication connection regardless of a rotation of the inner mandrel relative to the outer mandrel; j) a second passageway extending through the outer mandrel and the inner mandrel, the second passageway configured to provide continuous coupling between the second outer mandrel electrical communication connection and the second inner mandrel electrical communication connection regardless of a rotation of the inner mandrel relative to the outer mandrel; and k) a third passageway extending through the outer mandrel and the inner mandrel, the third passageway configured to provide continuous coupling between the third outer mandrel hydraulic communication connection and the third inner mandrel hydraulic communication connection regardless of a rotation of the inner mandrel relative to the outer mandrel, wherein the downhole rotary slip ring joint is operable to be coupled to a wellbore access tool; and 4) a first communication line coupled to the first outer mandrel communication connection, a second communication line coupled to the first inner mandrel communication connection, a third communication line coupled to the second outer mandrel electrical communication connection, a fourth communication line coupled to the second inner mandrel electrical communication connection, a fifth communication line coupled to the third outer mandrel hydraulic communication connection, a sixth communication line coupled to the third inner mandrel hydraulic communication connection.

I. A method for accessing a wellbore, the method including: 1) coupling a wellbore access tool to a conveyance, the wellbore access tool and the conveyance having a downhole rotary slip ring joint positioned therebetween, the downhole rotary slip ring joint including: a) an outer mandrel; b) an inner mandrel operable to rotate relative to the outer mandrel; c) a first outer mandrel communication connection coupled to the outer mandrel; d) a second outer mandrel electrical communication connection coupled to the outer mandrel; e) a third outer mandrel hydraulic communication connection coupled to the outer mandrel, the first outer mandrel communication connection, second outer mandrel electrical communication connection, and third outer mandrel hydraulic communication connection angularly offset and isolated from one another; f) a first inner mandrel communication connection coupled to the inner mandrel; g) a second inner mandrel electrical communication connection coupled to the inner mandrel; h) a third inner mandrel hydraulic communication connection coupled to the inner mandrel, the first inner mandrel communication connection, second inner mandrel electrical communication connection, and third inner mandrel hydraulic communication connection angularly offset and isolated from one another; i) a first passageway extending through the outer mandrel and the inner mandrel, the first passageway configured to provide continuous coupling between the first outer mandrel communication connection and the first inner mandrel communication connection regardless of a rotation of the inner mandrel relative to the outer mandrel; j) a second passageway extending through the outer mandrel and the inner mandrel, the second passageway configured to provide continuous coupling between the second outer mandrel electrical communication connection and the second inner mandrel electrical communication connection regardless of a rotation of the inner mandrel relative to the outer mandrel; k) a third passageway extending through the outer mandrel and the inner mandrel, the third passageway configured to provide continuous coupling between the third outer mandrel hydraulic communication connection and the third inner mandrel hydraulic communication connection regardless of a rotation of the inner mandrel relative to the outer mandrel, wherein the downhole rotary slip ring joint is operable to be coupled to a wellbore access tool; and 1) a first communication line coupled to the first outer mandrel communication connection, a second communication line coupled to the first inner mandrel communication connection, a third communication line coupled to the second outer mandrel electrical communication connection, a fourth communication line coupled to the second inner mandrel electrical communication connection, a fifth communication line coupled to the third outer mandrel hydraulic communication connection, a sixth communication line coupled to the third inner mandrel hydraulic communication connection; and 2) positioning the wellbore access tool near a wellbore as the inner mandrel rotates relative to the outer mandrel.

Aspects A, B, C, D, E, F, G, H, and I may have one or more of the following additional elements in combination: Element 1: wherein the outer mandrel communication connection is an outer mandrel electrical communication connection and the inner mandrel communication connection is an inner mandrel electrical communication connection. Element 2: further including a slip ring located in the passageway to electrically couple the outer mandrel electrical communication connection and the inner mandrel electrical communication connection regardless of a rotation of the inner mandrel relative to the outer mandrel. Element 3: further including a secondary actuated switch located in the passageway to electrically couple the outer mandrel communication and the inner mandrel communication when the rotation of the inner mandrel relative to the outer mandrel is fixed. Element 4: wherein the slip ring is a first slip ring, and further including a second redundant slip ring located in the passageway to electrically couple the outer mandrel communication and the inner mandrel communication connection regardless of a rotation of the inner mandrel relative to the outer mandrel. Element 5: further including fluid surrounding the slip ring. Element 6: wherein the fluid is a non-conductive fluid. Element 7: wherein the outer mandrel communication connection is an outer mandrel hydraulic communication connection and the inner mandrel communication connection is an inner mandrel hydraulic communication connection. Element 8: wherein the outer mandrel communication connection is an outer mandrel optical communication connection and the inner mandrel communication connection is an inner mandrel optical communication connection. Element 9: wherein the outer mandrel communication connection is a first outer mandrel electrical communication connection, the inner mandrel communication connection is a first inner mandrel electrical communication connection, and the passageway is a first passageway, and further including: a second outer mandrel hydraulic communication connection coupled to the outer mandrel; a second inner mandrel hydraulic communication connection coupled to the inner mandrel; and a second passageway extending through the outer mandrel and the inner mandrel, the second passageway configured to provide continuous coupling between the second outer mandrel hydraulic communication connection and the second inner mandrel hydraulic communication connection regardless of a rotation of the inner mandrel relative to the outer mandrel. Element 10: further including: a third outer mandrel optical communication connection coupled to the outer mandrel; a third inner mandrel optical communication connection coupled to the inner mandrel; and a third passageway extending through the outer mandrel and the inner mandrel, the third passageway configured to provide continuous coupling between the third outer mandrel optical communication connection and the third inner mandrel optical communication connection regardless of a rotation of the inner mandrel relative to the outer mandrel. Element 11: wherein the outer mandrel communication connection is a first outer mandrel electrical communication connection, the inner mandrel communication connection is a first inner mandrel electrical communication connection, and the passageway is a first passageway, and further including: a second outer mandrel optical communication connection coupled to the outer mandrel; a second inner mandrel optical communication connection coupled to the inner mandrel; and a second passageway extending through the outer mandrel and the inner mandrel, the second passageway configured to provide continuous coupling between the second outer mandrel optical communication connection and the second inner mandrel optical communication connection regardless of a rotation of the inner mandrel relative to the outer mandrel. Element 12: wherein the outer mandrel communication connection is a first outer mandrel optical communication connection, the inner mandrel communication connection is a first inner mandrel optical communication connection, and the passageway is a first passageway, and further including: a second outer mandrel hydraulic communication connection coupled to the outer mandrel; a second inner mandrel hydraulic communication connection coupled to the inner mandrel; and a second passageway extending through the outer mandrel and the inner mandrel, the second passageway configured to provide continuous coupling between the second outer mandrel hydraulic communication connection and the second inner mandrel hydraulic communication connection regardless of a rotation of the inner mandrel relative to the outer mandrel. Element 13: wherein the inner mandrel is operable to rotate in a left-hand-only rotation or right-hand-only rotation relative to the outer mandrel. Element 14: wherein the inner mandrel is operable to rotate 345-degrees or less relative to the outer mandrel. Element 15: wherein the inner mandrel is operable to rotate 180-degrees or less relative to the outer mandrel. Element 16: further including a torsion limiter between the outer mandrel and the inner mandrel, the torsion limiter configured to only allow rotation after a set rotational torque is applied thereto. Element 17: wherein the torsion limiter is a clutch mechanism or a slip mechanism. Element 18: wherein the inner mandrel is configured to axial slide relative to the outer mandrel, the passageway configured to provide continuous coupling between the outer mandrel communication connection and the inner mandrel communication connection regardless of a rotation or axial translation of the inner mandrel relative to the outer mandrel. Element 19: further including a pressure compensation device located in one or more of the outer mandrel and inner mandrel, the pressure compensation device configured to reduce stresses on the downhole rotary slip ring joint. Element 20: wherein the first outer mandrel communication connection is a first outer mandrel electrical communication connection and the first inner mandrel communication connection is a first inner mandrel electrical communication connection, and the second outer mandrel communication connection is a second outer mandrel electrical communication connection and the second inner mandrel communication connection is a second inner mandrel electrical communication connection. Element 21: wherein the first outer and inner mandrel electrical communication connections are configured as a power source and the second outer and inner mandrel electrical communication connections are configured as a signal source. Element 22: further including a first slip ring located in the first passageway to electrically couple the first outer mandrel electrical communication connection and the first inner mandrel communication connection regardless of a rotation of the inner mandrel relative to the outer mandrel. Element 23: wherein the first slip ring is rotationally fixed relative to the inner mandrel. Element 24: further including a first contactor rotationally fixed relative to the outer mandrel, the first slip ring and first contactor configured to rotate relative to one another at the same time they pass power and/or data signal between one another. Element 25: further including a second slip ring located in the second passageway to electrically couple the second outer mandrel electrical communication connection and the second inner mandrel communication connection regardless of a rotation of the inner mandrel relative to the outer mandrel. Element 26: wherein the second slip ring is rotationally fixed relative to the inner mandrel. Element 27: further including a second contactor rotationally fixed relative to the outer mandrel, the second slip ring and second contactor configured to rotate relative to one another at the same time they pass power and/or data signal between one another. Element 28: wherein the first contactor includes one or more conductive brushes. Element 29: further including: a third outer mandrel hydraulic communication connection coupled to the outer mandrel; a third inner mandrel hydraulic communication connection coupled to the inner mandrel; and a third passageway extending through the outer mandrel and the inner mandrel, the third passageway configured to provide continuous coupling between the third outer mandrel hydraulic communication connection and the third inner mandrel hydraulic communication connection regardless of a rotation of the inner mandrel relative to the outer mandrel. Element 30: further including: a fourth outer mandrel hydraulic communication connection coupled to the outer mandrel; a fourth inner mandrel hydraulic communication connection coupled to the inner mandrel; and a fourth passageway extending through the outer mandrel and the inner mandrel, the fourth passageway configured to provide continuous coupling between the fourth outer mandrel hydraulic communication connection and the fourth inner mandrel hydraulic communication connection regardless of a rotation of the inner mandrel relative to the outer mandrel. Element 31: further including: a fifth outer mandrel hydraulic communication connection coupled to the outer mandrel; a fifth inner mandrel hydraulic communication connection coupled to the inner mandrel; and a fifth passageway extending through the outer mandrel and the inner mandrel, the fifth passageway configured to provide continuous coupling between the fifth outer mandrel hydraulic communication connection and the fifth inner mandrel hydraulic communication connection regardless of a rotation of the inner mandrel relative to the outer mandrel. Element 32: further including a sealing element on either side of each of the first and second passageways. Element 33: further including at least two sealing elements on either side of each of the first and second passageways. Element 34: wherein the outer mandrel further includes an access port. Element 35: wherein the first outer mandrel communication connection is a first outer mandrel electrical communication connection and the first inner mandrel communication connection is a first inner mandrel electrical communication connection. Element 36: wherein the second outer mandrel electrical communication connection is angularly positioned between the first outer mandrel electrical communication connection and the third outer mandrel hydraulic communication connection. Element 37: wherein the second inner mandrel electrical communication connection is angularly positioned between the first inner mandrel electrical communication connection and the third inner mandrel hydraulic communication connection. Element 38: further including: a fourth outer mandrel hydraulic communication connection coupled to the outer mandrel; a fourth inner mandrel hydraulic communication connection coupled to the inner mandrel; and a fourth passageway extending through the outer mandrel and the inner mandrel, the fourth passageway configured to provide continuous coupling between the fourth outer mandrel hydraulic communication connection and the fourth inner mandrel hydraulic communication connection regardless of a rotation of the inner mandrel relative to the outer mandrel. Element 39: wherein the first and second outer mandrel electrical communication connections are angularly positioned between the third and fourth outer mandrel hydraulic communication connections. Element 40: wherein the fourth inner mandrel hydraulic communication connection is angularly positioned between the second inner mandrel electrical communication connection and the third inner mandrel hydraulic connection. Element 41: further including: a fifth outer mandrel hydraulic communication connection coupled to the outer mandrel; a fifth inner mandrel hydraulic communication connection coupled to the inner mandrel; and a fifth passageway extending through the outer mandrel and the inner mandrel, the fifth passageway configured to provide continuous coupling between the fifth outer mandrel hydraulic communication connection and the fifth inner mandrel hydraulic communication connection regardless of a rotation of the inner mandrel relative to the outer mandrel. Element 42: wherein the fourth outer mandrel hydraulic communication connection is angularly positioned between the first outer mandrel electrical communication connection and the fifth outer mandrel hydraulic communication connection. Element 43: wherein the fifth inner mandrel hydraulic communication connection is angularly positioned between the second inner mandrel electric communication connection and the fourth inner mandrel hydraulic communication connection. Element 44: further including a sealing element on either side of each of the first, second, third, fourth, and fifth passageways.

Those skilled in the art to which this application relates will appreciate that other and further additions, deletions, substitutions and modifications may be made to the described embodiments.

What is claimed is:

1. A downhole rotary slip ring joint, comprising:

an outer mandrel;

an inner mandrel coupled to the outer mandrel and operable to rotate relative to the outer mandrel;

first and second outer mandrel communication connections coupled to the outer mandrel, the first and second outer mandrel communication connections angularly offset and isolated from one another;

first and second inner mandrel communication connections coupled to the inner mandrel, the first and second inner mandrel communication connections angularly offset and isolated from one another;

a first passageway extending through the outer mandrel and the inner mandrel, the first passageway configured to provide continuous coupling between the first outer mandrel communication connection and the first inner mandrel communication connection regardless of a rotation of the inner mandrel relative to the outer mandrel;

a second passageway extending through the outer mandrel and the inner mandrel, the second passageway configured to provide continuous coupling between the second outer mandrel communication connection and the second inner mandrel communication connection regardless of a rotation of the inner mandrel relative to the outer mandrel, wherein the downhole rotary slip ring joint is operable to be coupled to a wellbore access tool; and an axial coupling feature coupled between the outer mandrel and the inner mandrel, the axial coupling feature configured to prevent the outer mandrel and the inner mandrel from axially decoupling from one another downhole.

2. The downhole rotary slip ring joint as recited in claim 1, wherein the first outer mandrel communication connection is a first outer mandrel electrical communication connection and the first inner mandrel communication connection is a first inner mandrel electrical communication connection, and the second outer mandrel communication connection is a second outer mandrel electrical communication connection and the second inner mandrel communication connection is a second inner mandrel electrical communication connection.

3. The downhole rotary slip ring joint as recited in claim 2, wherein the first outer and inner mandrel electrical communication connections are configured as a power source and the second outer and inner mandrel electrical communication connections are configured as a signal source.

4. The downhole rotary slip ring joint as recited in claim 2, further including a first slip ring located in the first passageway to electrically couple the first outer mandrel electrical communication connection and the first inner mandrel communication connection regardless of a rotation of the inner mandrel relative to the outer mandrel.

5. The downhole rotary slip ring joint as recited in claim 4, wherein the first slip ring is rotationally fixed relative to the inner mandrel.

6. The downhole rotary slip ring joint as recited in claim 5, further including a first contactor rotationally fixed relative to the outer mandrel, the first slip ring and first contactor configured to rotate relative to one another at the same time they pass power and/or data signal between one another.

7. The downhole rotary slip ring joint as recited in claim 6, further including a second slip ring located in the second passageway to electrically couple the second outer mandrel electrical communication connection and the second inner mandrel communication connection regardless of a rotation of the inner mandrel relative to the outer mandrel.

8. The downhole rotary slip ring joint as recited in claim 7, wherein the second slip ring is rotationally fixed relative to the inner mandrel.

9. The downhole rotary slip ring joint as recited in claim 8, further including a second contactor rotationally fixed relative to the outer mandrel, the second slip ring and second contactor configured to rotate relative to one another at the same time they pass power and/or data signal between one another.

10. The downhole rotary slip joint as recited in claim 6, wherein the first contactor includes one or more conductive brushes.

11. The downhole rotary slip ring joint as recited in claim 2, further including:

a third outer mandrel hydraulic communication connection coupled to the outer mandrel;

a third inner mandrel hydraulic communication connection coupled to the inner mandrel; and a third passageway extending through the outer mandrel and the inner mandrel, the third passageway configured to provide continuous coupling between the third outer mandrel hydraulic communication connection and the third inner mandrel hydraulic communication connection regardless of a rotation of the inner mandrel relative to the outer mandrel.

12. The downhole rotary slip ring joint as recited in claim 11, further including:

a fourth outer mandrel hydraulic communication connection coupled to the outer mandrel;

a fourth inner mandrel hydraulic communication connection coupled to the inner mandrel; and a fourth passageway extending through the outer mandrel and the inner mandrel, the fourth passageway configured to provide continuous coupling between the fourth outer mandrel hydraulic communication connection and the fourth inner mandrel hydraulic communication connection regardless of a rotation of the inner mandrel relative to the outer mandrel.

13. The downhole rotary slip ring joint as recited in claim 12, further including:

a fifth outer mandrel hydraulic communication connection coupled to the outer mandrel;

a fifth inner mandrel hydraulic communication connection coupled to the inner mandrel; and a fifth passageway extending through the outer mandrel and the inner mandrel, the fifth passageway configured to provide continuous coupling between the fifth outer mandrel hydraulic communication connection and the fifth inner mandrel hydraulic communication connection regardless of a rotation of the inner mandrel relative to the outer mandrel.

14. The downhole rotary slip ring joint as recited in claim 1, further including a sealing element on either side of each of the first and second passageways.

15. The downhole rotary slip ring joint as recited in claim 1, further including at least two sealing elements on either side of each of the first and second passageways.

16. The downhole rotary slip ring joint as recited in claim 1, wherein the outer mandrel further includes an access port, the access port providing access to the axial coupling feature.

17. The downhole rotary slip ring joint as recited in claim 1, wherein the axial coupling feature is a snap ring, the snap ring configured to prevent the outer mandrel and the inner mandrel from axially decoupling from one another downhole.

18. The downhole rotary slip ring joint as recited in claim 1, wherein the axial coupling feature is a first shoulder associated with the outer mandrel and a second opposing shoulder associated with the inner mandrel, the first and second shoulders configured to prevent the outer mandrel and the inner mandrel from axially decoupling from one another downhole.

19. A well system, comprising:

a wellbore;

a wellbore access tool positioned near the wellbore with a conveyance;

a downhole rotary slip ring joint positioned between the conveyance and the wellbore access tool, the downhole rotary slip ring joint including:

an outer mandrel;

an inner mandrel coupled to the outer mandrel and operable to rotate relative to the outer mandrel;

first and second outer mandrel communication connections coupled to the outer mandrel, the first and second outer mandrel communication connections angularly offset and isolated from one another;

first and second inner mandrel communication connections coupled to the inner mandrel, the first and second inner mandrel communication connections angularly offset and isolated from one another;

a first passageway extending through the outer mandrel and the inner mandrel, the first passageway configured to provide continuous coupling between the first outer mandrel communication connection and the first inner mandrel communication connection regardless of a rotation of the inner mandrel relative to the outer mandrel;

a second passageway extending through the outer mandrel and the inner mandrel, the second passageway configured to provide continuous coupling between the second outer mandrel communication connection and the second inner mandrel communication connection regardless of a rotation of the inner mandrel relative to the outer mandrel, wherein the downhole rotary slip ring joint is operable to be coupled to a wellbore access tool; and an axial coupling feature coupled between the outer mandrel and the inner mandrel, the axial coupling feature configured to prevent the outer mandrel and the inner mandrel from axially decoupling from one another downhole; and a first communication line coupled to the first outer mandrel communication connection, a second communication line coupled to the first inner mandrel communication connection, a third communication line coupled to the second outer mandrel communication connection, and a fourth communication line coupled to the second inner mandrel communication connection.

20. The well system as recited in claim 19, wherein the first outer mandrel communication connection is a first outer mandrel electrical communication connection and the first inner mandrel communication connection is a first inner mandrel electrical communication connection, and the second outer mandrel communication connection is a second outer mandrel electrical communication connection and the second inner mandrel communication connection is a second inner mandrel electrical communication connection.

21. The well system as recited in claim 20, wherein the first outer and inner mandrel electrical communication connections are configured as a power source and the second outer and inner mandrel electrical communication connections are configured as a signal source.

22. The well system as recited in claim 20, further including a first slip ring located in the first passageway to electrically couple the first outer mandrel electrical communication connection and the first inner mandrel communication connection regardless of a rotation of the inner mandrel relative to the outer mandrel.

23. The well system as recited in claim 22, wherein the first slip ring is rotationally fixed relative to the inner mandrel.

24. The well system as recited in claim 23, further including a first contactor rotationally fixed relative to the outer mandrel, the first slip ring and first contactor configured to rotate relative to one another at the same time they pass power and/or data signal between one another.

25. The well system as recited in claim 24, further including a second slip ring located in the second passageway to electrically couple the second outer mandrel electrical communication connection and the second inner mandrel communication connection regardless of a rotation of the inner mandrel relative to the outer mandrel.

26. The well system as recited in claim 25, wherein the second slip ring is rotationally fixed relative to the inner mandrel.

27. The well system as recited in claim 26, further including a second contactor rotationally fixed relative to the outer mandrel, the second slip ring and second contactor configured to rotate relative to one another at the same time they pass power and/or data signal between one another.

28. The well system as recited in claim 24, wherein the first contactor includes one or more conductive brushes.

29. The well system as recited in claim 20, further including:

a third outer mandrel hydraulic communication connection coupled to the outer mandrel;

a third inner mandrel hydraulic communication connection coupled to the inner mandrel; and a third passageway extending through the outer mandrel and the inner mandrel, the third passageway configured to provide continuous coupling between the third outer mandrel hydraulic communication connection and the third inner mandrel hydraulic communication connection regardless of a rotation of the inner mandrel relative to the outer mandrel.

30. The well system as recited in claim 29, further including:

a fourth outer mandrel hydraulic communication connection coupled to the outer mandrel;

a fourth inner mandrel hydraulic communication connection coupled to the inner mandrel; and a fourth passageway extending through the outer mandrel and the inner mandrel, the fourth passageway configured to provide continuous coupling between the fourth outer mandrel hydraulic communication connection and the fourth inner mandrel hydraulic communication connection regardless of a rotation of the inner mandrel relative to the outer mandrel.

31. The well system as recited in claim 30, further including:

a fifth outer mandrel hydraulic communication connection coupled to the outer mandrel;

a fifth inner mandrel hydraulic communication connection coupled to the inner mandrel; and a fifth passageway extending through the outer mandrel and the inner mandrel, the fifth passageway configured to provide continuous coupling between the fifth outer mandrel hydraulic communication connection and the fifth inner mandrel hydraulic communication connection regardless of a rotation of the inner mandrel relative to the outer mandrel.

32. The well system as recited in claim 19, further including a sealing element on either side of each of the first and second passageways.

33. The well system as recited in claim 19, further including at least two sealing elements on either side of each of the first and second passageways.

34. The well system as recited in claim 19, wherein the outer mandrel further includes an access port, the access port providing access to the axial coupling feature.

35. A method for accessing a wellbore, comprising:

coupling a wellbore access tool to a conveyance, the wellbore access tool and the conveyance having a downhole rotary slip ring joint positioned therebetween, the downhole rotary slip ring joint including:

an outer mandrel;

an inner mandrel coupled to the outer mandrel and operable to rotate relative to the outer mandrel;

first and second outer mandrel communication connections coupled to the outer mandrel, the first and second outer mandrel communication connections angularly offset and isolated from one another;

first and second inner mandrel communication connections coupled to the inner mandrel, the first and second inner mandrel communication connections angularly offset and isolated from one another;

a first passageway extending through the outer mandrel and the inner mandrel, the first passageway configured to provide continuous coupling between the first outer mandrel communication connection and the first inner mandrel communication connection regardless of a rotation of the inner mandrel relative to the outer mandrel;

a second passageway extending through the outer mandrel and the inner mandrel, the second passageway configured to provide continuous coupling between the second outer mandrel communication connection and the second inner mandrel communication connection regardless of a rotation of the inner mandrel relative to the outer mandrel, wherein the downhole rotary slip ring joint is operable to be coupled to a wellbore access tool;

an axial coupling feature coupled between the outer mandrel and the inner mandrel, the axial coupling feature configured to prevent the outer mandrel and the inner mandrel from axially decoupling from one another downhole; and a first communication line coupled to the first outer mandrel communication connection, a second communication line coupled to the first inner mandrel communication connection, a third communication line coupled to the second outer mandrel communication connection, and a fourth communication line coupled to the second inner mandrel communication connection; and positioning the wellbore access tool near a wellbore as the inner mandrel rotates relative to the outer mandrel.

* * * * *